US011478674B1

(12) United States Patent
Kuka

(10) Patent No.: US 11,478,674 B1
(45) Date of Patent: Oct. 25, 2022

(54) TRAINING SYSTEM AND APPARATUS

(71) Applicant: MoveStrong Functional Fitness Equipment, LLC, Charleston, SC (US)

(72) Inventor: Jared Kuka, Charleston, SC (US)

(73) Assignee: MoveStrong Functional Fitness Equipment LLC, Charleston, SC (US)

( * ) Notice: Subject to any disclaimer, the term of this patent is extended or adjusted under 35 U.S.C. 154(b) by 21 days.

(21) Appl. No.: 17/100,432

(22) Filed: Nov. 20, 2020

Related U.S. Application Data

(60) Provisional application No. 62/939,502, filed on Nov. 22, 2019.

(51) Int. Cl.

| | |
|---|---|
| ***A63B 21/06*** | (2006.01) |
| ***A63B 21/08*** | (2006.01) |
| ***A63B 21/16*** | (2006.01) |
| ***A63B 21/072*** | (2006.01) |
| ***A63B 21/00*** | (2006.01) |

(52) U.S. Cl.
CPC ..... *A63B 21/0615* (2013.01); *A63B 21/0728* (2013.01); *A63B 21/08* (2013.01); *A63B 21/169* (2015.10); *A63B 21/4035* (2015.10); *A63B 21/4047* (2015.10)

(58) Field of Classification Search
CPC ..... A63B 21/0004; A63B 21/00058; A63B 21/00061; A63B 21/00065; A63B 21/00072; A63B 21/012; A63B 21/018; A63B 21/02; A63B 21/04; A63B 21/0421; A63B 21/0442; A63B 21/055; A63B 21/0555; A63B 21/06; A63B 21/0608; A63B 21/0615; A63B 21/0616; A63B 21/0617; A63B 21/072; A63B 21/0724; A63B 21/075; A63B 21/08; A63B 21/1681; A63B 21/22; A63B 21/4023; A63B 21/4033; A63B 21/4047; A63B 21/4049
See application file for complete search history.

(56) References Cited

U.S. PATENT DOCUMENTS 4,323,236 A * 4/1982 Szabo ..... A63B 21/0615 482/97
4,344,619 A * 8/1982 Szabo ..... A63B 21/0615 248/161

(Continued)

*Primary Examiner* — Nyca T Nguyen
*Assistant Examiner* — Zachary T Moore
(74) *Attorney, Agent, or Firm* — Patterson Intellectual Property Law, P.C.; Ryan D. Levy; Alex H. Huffstutter

(57) ABSTRACT

The present disclosure provides training systems and apparatus for working out. The training system includes a pivotal bracket and a workout bar. The pivotal bracket includes a first portion and a second portion pivotally coupled to the first portion. The first portion is couplable to a support surface. The workout bar is coupled to the second portion of the pivotal bracket. The workout bar includes a cylindrical weight receiving portion positioned distal relative to the second portion of the pivotal bracket and a rectangular intermediate portion positioned between the second portion of the pivotal bracket and the cylindrical weight receiving portion. The weight bar may include a plurality of pairs of holes spaced apart along a length of the bar for receiving various attachment members for performing landmine workout movements. The training system may include other support structures to which the pivotal bracket is connected.

21 Claims, 55 Drawing Sheets

(56) References Cited

U.S. PATENT DOCUMENTS

| | | | | | |
|---|---|---|---|---|---|
| 4,502,681 | A * | 3/1985 | Blomqvist | A63B 21/04 | 482/130 |
| 4,923,195 | A * | 5/1990 | Calderone | A63B 21/0615 | 482/97 |
| 5,244,444 | A * | 9/1993 | Wostry | A63B 21/0615 | 482/109 |
| 5,358,462 | A * | 10/1994 | Calderone | A63B 21/0615 | 482/102 |
| 5,487,712 | A * | 1/1996 | Kann | A63B 21/0615 | 482/148 |
| 9,289,646 | B2 * | 3/2016 | Tully | A63B 21/16 | |
| 2005/0148445 | A1 * | 7/2005 | Carle | A63B 21/4035 | 482/97 |
| 2007/0155595 | A1 * | 7/2007 | Rogers | A63B 21/4035 | 482/94 |
| 2016/0008653 | A1 * | 1/2016 | Dipasquale | A63B 21/0724 | 482/107 |
| 2017/0087400 | A1 * | 3/2017 | Chen | A63B 21/08 | |
| 2017/0087402 | A1 * | 3/2017 | Chen | A63B 21/0615 | |
| 2018/0255885 | A1 * | 9/2018 | Sarazen | A45B 9/04 | |

* cited by examiner

TRAINING SYSTEM AND APPARATUS

CROSS-REFERENCES TO RELATED APPLICATIONS

This application claims benefit of the following patent application which is hereby incorporated by reference: U.S. Provisional Application No. 62/939,502 filed Nov. 22, 2019, entitled "Training System and Apparatus."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present invention relates generally to landmine workout brackets. More particularly, the present invention relates to a landmine style workout apparatus and system thereof.

BACKGROUND

Typical landmine workout systems include a bracket which may be coupled to vertical support of a workout rig or which can be attached to a ground surface. The bracket is configured to receive an end of a barbell opposite its attachment point and is capable of enabling pivotal movement, both vertically and horizontally, of an end of the barbell positioned distally from the bracket. As typical landmine systems are configured to be mounted to vertical supports of a rig or directly to a ground surface, they lack certain storage features for attachments and weights that are helpful for keeping weights and attachments handy while also keeping the gym space organized and clean. The attachments are helpful for performing various workouts using the landmine system and should be kept with the landmine equipment as they are specifically designed for landmine workout movements.

As landmine workout systems are typically configured to receive a cylindrical barbell, which do not have attachment points along their length. The lack of attachment points along the length of a barbell may limit the types of attachments which are compatible with the barbell to those that can slide over the end of the barbell before or after the weight is received on the end of the barbell. This is a short coming of landmine systems that require the use of a barbell.

Certain workout movements that are performed with a landmine workout system begin at shoulder height. Because the barbell begins on the ground, the loaded barbell must be picked up off the ground and lifted to a shoulder position before beginning a given movement. This can be difficult and have associated safety issues when performing extremely heavy movements. The also limits the potential users of the landmine system to those who have use of their legs because the barbell must always be picked up from the ground and moved to the shoulder position before beginning a movement.

A user's foot placement while performing workout movements using a landmine workout system can be extremely important, not only in terms of movement form and safety, but also in terms of gains, consistency and repeatability. The effects of a user's poor foot placement may be amplified when performing complex movements with the landmine workout system which require a starting foot position and an ending foot position for each repetition of the movement.

When teaching user to perform new complex movements with a landmine system, trainers may draw starting lines and finishing lines on the floor using caulk so as to be a visual teaching queue. Alternatively, trainers may use tape to create said markings. There are obvious consistency and repeatability issues with manually drawing or sticking tape to the ground surface for each new user. These can create inconsistencies between workouts on different days, as an extra step in getting ready to perform a workout and adds an additional step when cleaning up after your workout, as the chalk or tape must be cleaned or removed.

Certain workout movements can benefit from the use of banded resistance. Resistance bands may add variety to a movement while also increasing stabilization and core activation benefits to the movement. Typical landmine workout systems are not designed for use with resistance bands as barbells do not include proper attachment points along their length for securely and properly coupling with resistance bands.

BRIEF SUMMARY

Accordingly, a need exists for an improved landmine workout system that addresses and solves the issues and problems associated with previous landmine workout systems, as outline above. It is one object of the invention to provide a training system (i.e., an improved landmine workout system) that is a stand-alone piece of workout equipment that includes storage features for holding weights and other various attachments for use with the system. In accordance with this aspect of the invention, the training system may include a workout bar with attachment points along its length. The attachment points allow for the various attachments to be coupled to the workout bar at various locations, thus enabling a user to attach the attachment to a proper location on the workout bar that is best suited for the particular user.

It is another object of the invention to provide floor markings that emanating from the bracket which can help users to better position their feet for performing various exercises to thereby decrease the risk of injury, improve movement form, and increase consistency and repeatability between workouts.

Another object of the invention is to provide at least one dock bracket configured to receive and hold the workout bar in an elevated position (e.g., similar to that of a racked position) so that workout movements that begin at the shoulder position may avoid the hassle of having to lift the workout bar of the ground before starting the movement. The dock bracket also allows for heavier weight to be lifted overhead that may have been constrained due to a user's limitations with lifting the workout bar off the ground to begin the movement.

A further aspect of the invention is an attachment bracket positioned long the workout bar for receiving at least one resistance band and at least one attachment bracket on the floor for attaching to the at least one resistance band. Preferably, the invention includes two attachment brackets, each positioned on opposite sides and equidistantly from the floor markings. These brackets and bands can help alter certain workouts, resistances, and increase core activation and stability. In accordance with the aspect, it is important that the floor brackets be minimized so as not to become a tripping hazard in the gym for other users walking by this training system.

According to one aspect of the present disclosure, there is provided a training system comprising a pivotal bracket and a workout bar. The pivotal bracket may include a first portion and a second portion. The first portion may be pivotally coupled to the second portion. The first portion may be couplable to a support surface. The workout bar may be coupled to the second portion of the pivotal bracket. The workout bar may include a cylindrical weight receiving portion positioned distal relative to the second portion of the pivotal bracket and a rectangular intermediate portion positioned between the second portion of the pivotal bracket and the cylindrical weight receiving portion.

According to another aspect of the training system of the present disclosure, the second portion of the pivotal bracket may pivot omnidirectionally relative to the first portion of the pivotal bracket.

According to another aspect of the training system of the present disclosure, the pivotal bracket may further include a first pivot axis and a second pivot axis oriented perpendicular to the first pivot axis. The first pivot axis and the second pivot axis may be positioned between the first and second portions of the pivotal bracket. The first pivot axis and the second pivot axis may enable omnidirectional pivotal movement between the first and second portions of the pivotal bracket.

According to another aspect of the training system of the present disclosure, the workout bar may include a bar length and a square cross-sectional profile defined perpendicular to the bar length.

According to another aspect of the training system of the present disclosure, the workout bar may include a plurality of pairs of holes defined through opposite sides of the workout bar. The plurality of pairs of holes may be spaced apart along the bar length.

According to another aspect of the training system of the present disclosure, each pair of the plurality of pairs of holes may be aligned in a direction parallel to a horizontal axis of the pivotal bracket.

According to another aspect of the training system of the present disclosure, wherein the training system may further comprise an attachment member selectively couplable to at least one hole of the plurality of pairs of holes along the bar length.

According to another aspect of the training system of the present disclosure, the attachment member is a user engagement attachment. In accordance with this aspect, the user engagement attachment may include a rectangular channel, first and second handles spaced apart from opposite side walls of the rectangular channel, and an engagement pin extending through one of the opposite side walls of the rectangular channel. The engagement pin may be configured to releasably engage one of hole of the plurality of pairs of holes.

According to another aspect of the training system of the present disclosure, the attachment member is a band engagement attachment. In accordance with this aspect, the band engagement attachment may include a rectangular channel and a pair of hooks extending from opposite side walls of the rectangular channel.

According to another aspect of the training system of the present disclosure, wherein the training system may further comprise a pair of band anchors. Each of the pair of band anchors may include a housing couplable to one of the support surface or a ground surface and a retractable hook pivotally coupled within the housing. The pair of band anchors may be spaced apart from each other in a first direction and spaced apart from the pivotal bracket in a second direction perpendicular to the first direction. In accordance with this aspect, at least one resistance band may be coupled between one of pair of band anchors and one hook of a pair of hook of a band engagement attachment coupled along the rectangular intermediate portion of the workout bar.

According to another aspect of the training system of the present disclosure, wherein the training system may further comprise a weight horn attachment selectively couplable to the rectangular intermediate portion of the workout bar. The weight horn attachment may include a rectangular channel and a pair of weight receivers extending from opposite side walls of the rectangular channel.

According to another aspect of the training system of the present disclosure, wherein the training system may further comprise a user engagement attachment couplable to the cylindrical weight receiving portion of the workout bar. The user engagement attachment may include at least one handle. In accordance with this aspect, the cylindrical weight receiving portion may include a hole defined closer to a free end of the cylindrical weight receiving portion than to the rectangular intermediate portion. Further in accordance with this aspect, the user engagement attachment may include an engagement pin configured to releasably engage the hole.

According to another aspect of the training system of the present disclosure, wherein the training system may further comprise a base station supported by a ground surface. In accordance with this aspect, the base station may comprise first and second base supports, a bracket support plate, a vertical support post, and at least one dock bracket. The first base support may be oriented perpendicularly to the second base support. The bracket support plate may extend from a free end of the first base support. The bracket support plate may define the support surface. The vertical support post may extend from the second base support. The at least one dock bracket may be coupled to the vertical support post. The at least one dock bracket may be configured to receive the rectangular intermediate portion of the workout bar and position the cylindrical weight receiving portion of the workout bar offset from the ground surface.

According to another aspect of the training system of the present disclosure, the workout bar may be angled relative to the ground surface at an angle of at least 25 degrees when received by the at least one dock bracket.

According to another aspect of the training system of the present disclosure, wherein the training system may further comprise a base station supported by a ground surface. In accordance with this aspect, the base station may comprise first and second base supports, a support plate, a vertical bracket post, a vertical support post, and at least one dock bracket. The first base support may be oriented perpendicularly to the second base support. The support plate may extend from a free end of the first base support. The vertical bracket post may extend from the support plate and include a plurality of points spaced along the vertical bracket post. The vertical bracket post may define the support surface. The vertical support post may extend from the second base support. The at least one dock bracket may be coupled to the vertical support post and may be configured to receive the rectangular intermediate portion of the workout bar and position the cylindrical weight receiving portion of the workout bar offset from the ground surface. In accordance with this aspect, the first portion of the pivotal bracket may be configured to be releasably coupled to one of the plurality of attachment points of the vertical bracket post.

According to another aspect of the training system of the present disclosure, wherein the training system may further comprise a base station supported by a ground surface. In accordance with this aspect, the base station may comprise a base plate, a rectangular vertical support post, and at least one dock bracket. The base plate may be couplable to the ground surface. The rectangular vertical support post may extend from the base plate and may include four side walls. One side wall of the four side walls may define the support surface. The at least one dock bracket may be coupled to a different side wall of the rectangular vertical support post and may be configured to receive the rectangular intermediate portion of the workout bar and position the cylindrical weight receiving portion of the workout bar offset from the ground surface.

According to another aspect of the training system of the present disclosure, wherein the training system may further comprise a base station supported by a ground surface. In accordance with this aspect, the base station may comprise a base plate, a rectangular vertical support post, and a storage bracket. The base plate may be couplable to the ground surface. The rectangular vertical support post may extend from the base plate and may include four side walls. One side wall of the four side walls may define the support surface. The storage bracket may be coupled to the rectangular vertical support post above the pivotal bracket and may include a rectangular channel and an engagement pin extending through one side wall of a pair of opposite side walls of the rectangular channel. In accordance with this aspect, the engagement pin may be configured to releasably engage one of hole of a plurality of pairs of holes defined along the rectangular intermediate portion of the weight bar.

According to another aspect of the training system of the present disclosure, the support surface may be a wall surface.

According to another aspect of the training system of the present disclosure, wherein the training system may further comprise a storage bracket coupled to the support surface above the pivotal bracket. The storage bracket may include a rectangular channel and an engagement pin extending through one side wall of a pair of opposite side walls of the rectangular channel. In accordance with this aspect, the engagement pin may be configured to releasably engage one hole of a plurality of pairs of holes defined along the rectangular intermediate portion of the weight bar.

According to another aspect of the training system of the present disclosure, the support surface may be defined by a workout rig including a plurality of holes defined therein. In accordance with this aspect, the first portion of the pivotal bracket may include a rig mount may be configured to engage one hole of the plurality of holes for the workout bar for pivotally coupling the workout bar to the workout rig.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
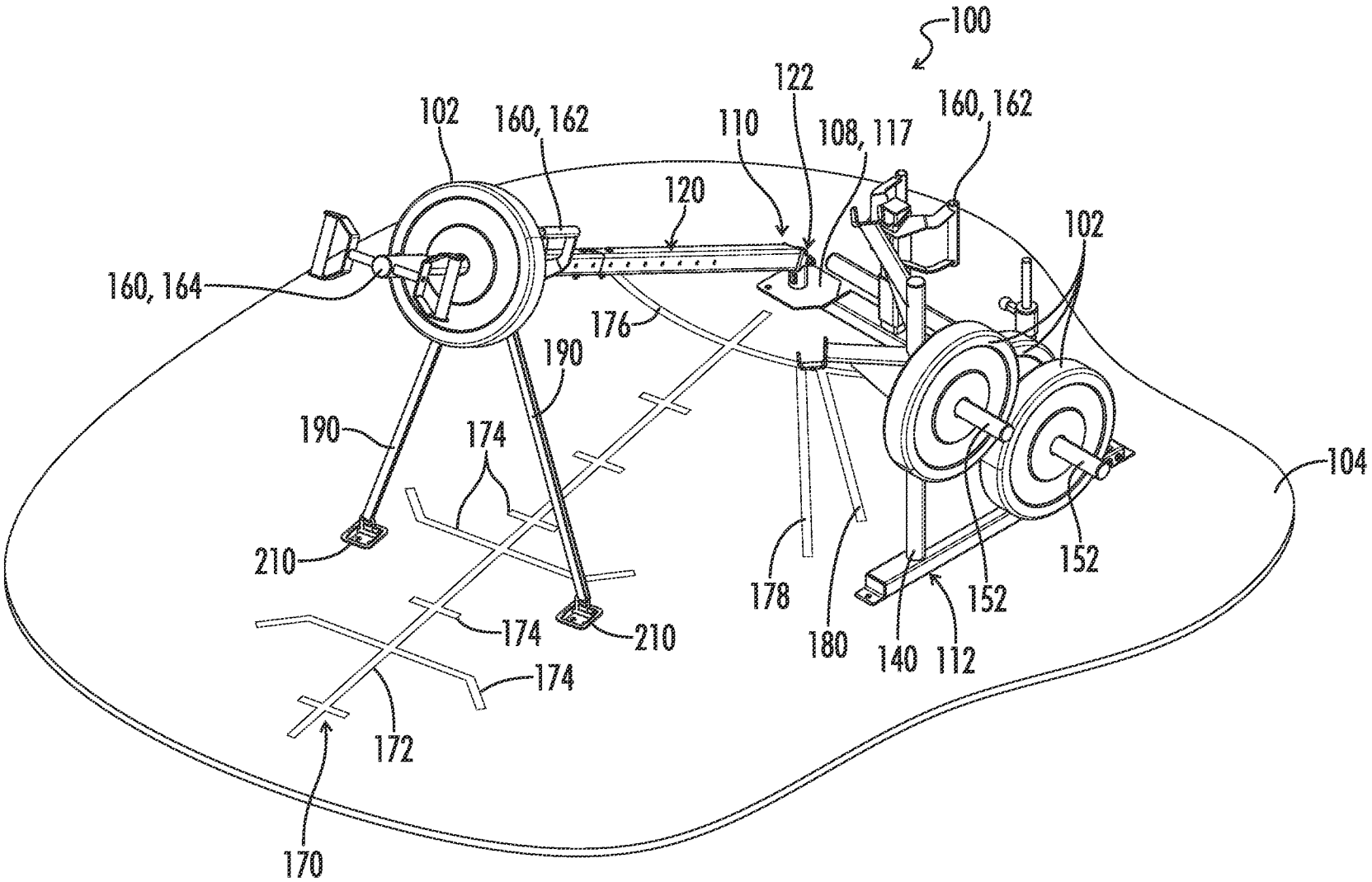
FIG. 1 is a front right top perspective view of a training system including a first embodiment of a training apparatus in accordance with the present disclosure.
Figure 2:
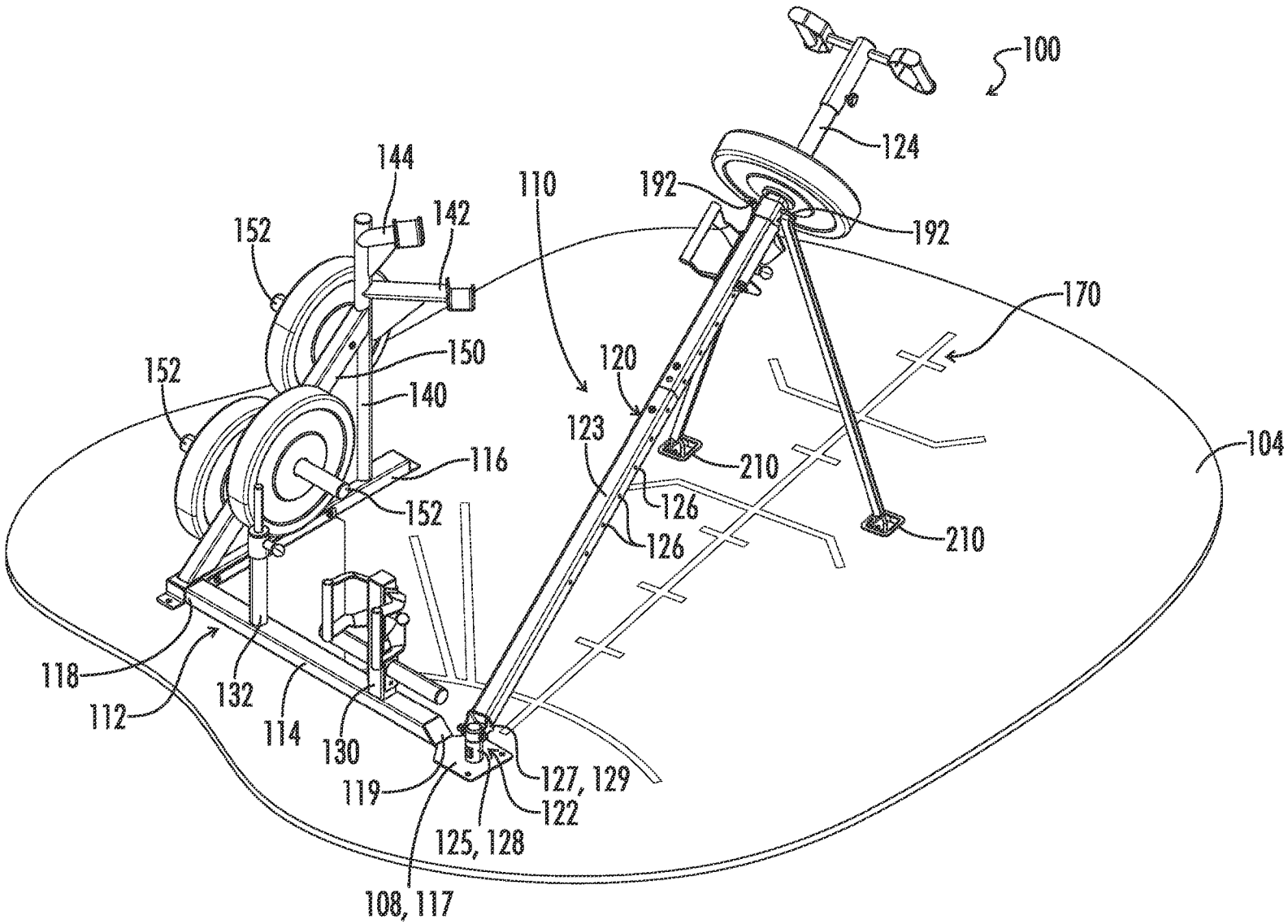
FIG. 2 is a back left top perspective view of the training system of FIG. 1 in accordance with the present disclosure.
Figure 3:
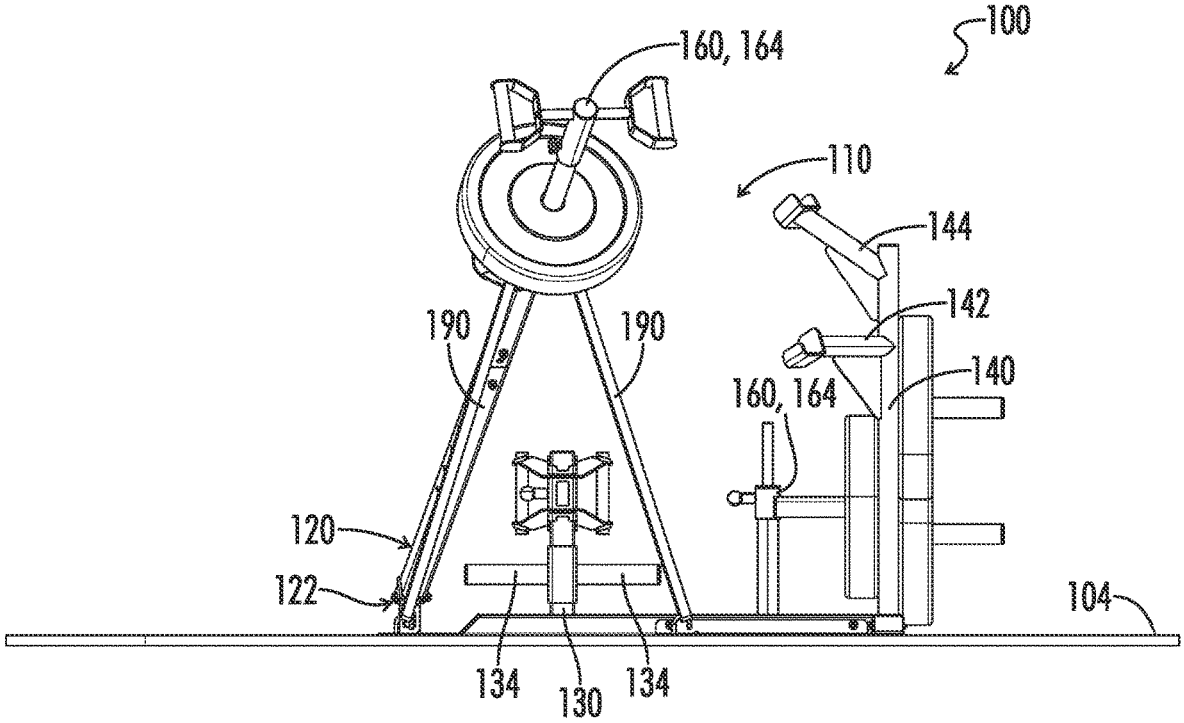
FIG. 3 is a front elevation view of the training system of FIG. 1 in accordance with the present disclosure.
Figure 4:
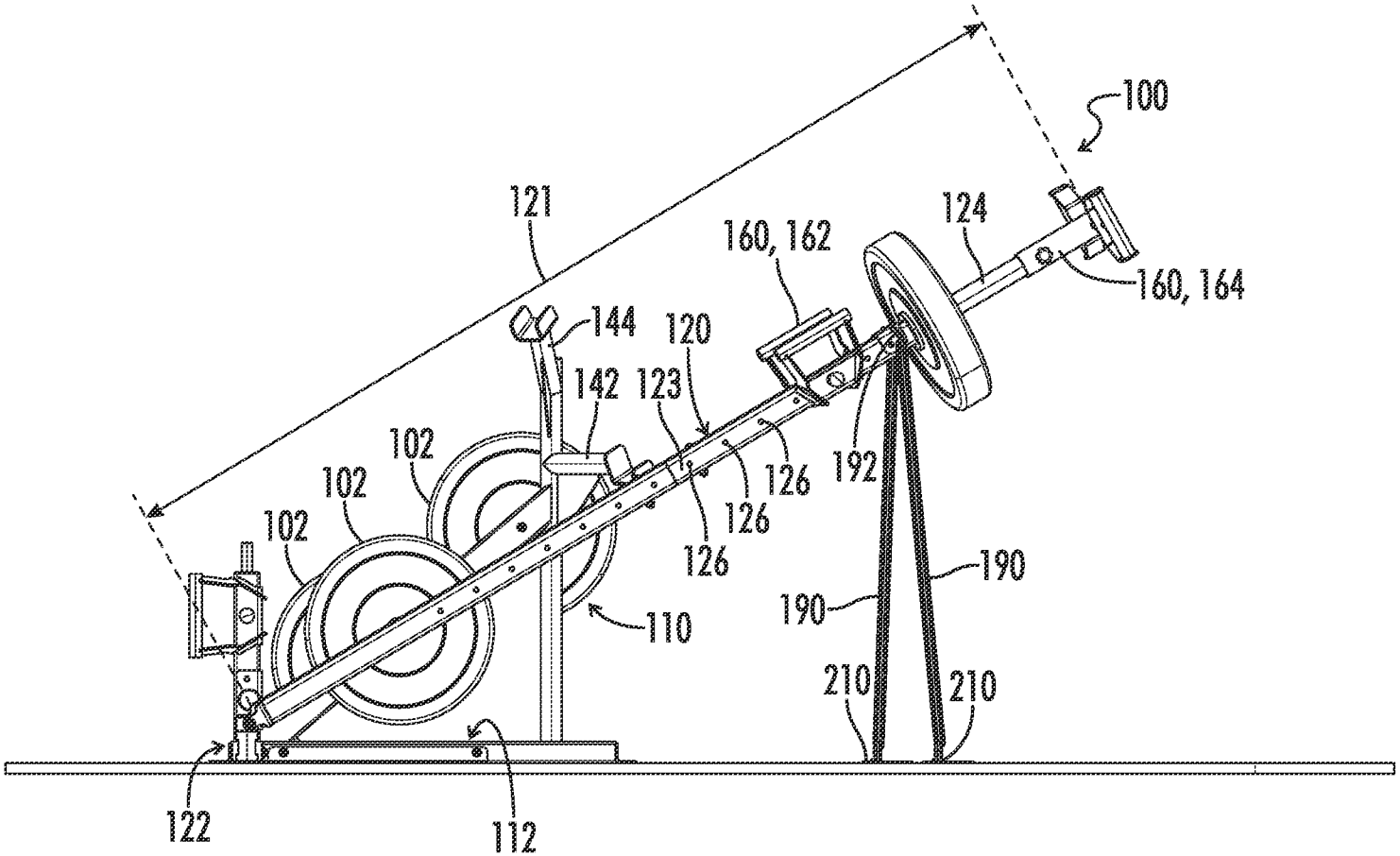
FIG. 4 is a left elevation view of the training system of FIG. 1 in accordance with the present disclosure.
Figure 5:
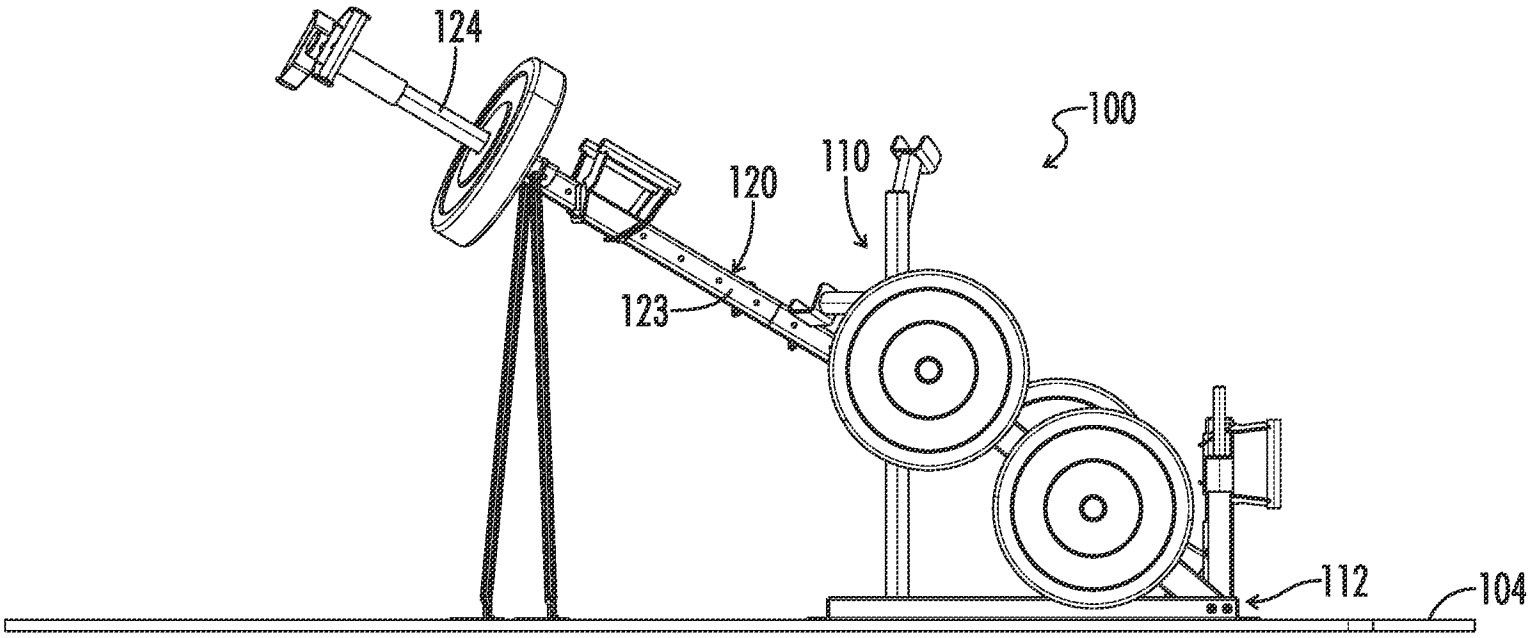
FIG. 5 is a right elevation view of the training system of FIG. 1 in accordance with the present disclosure.
Figure 6:
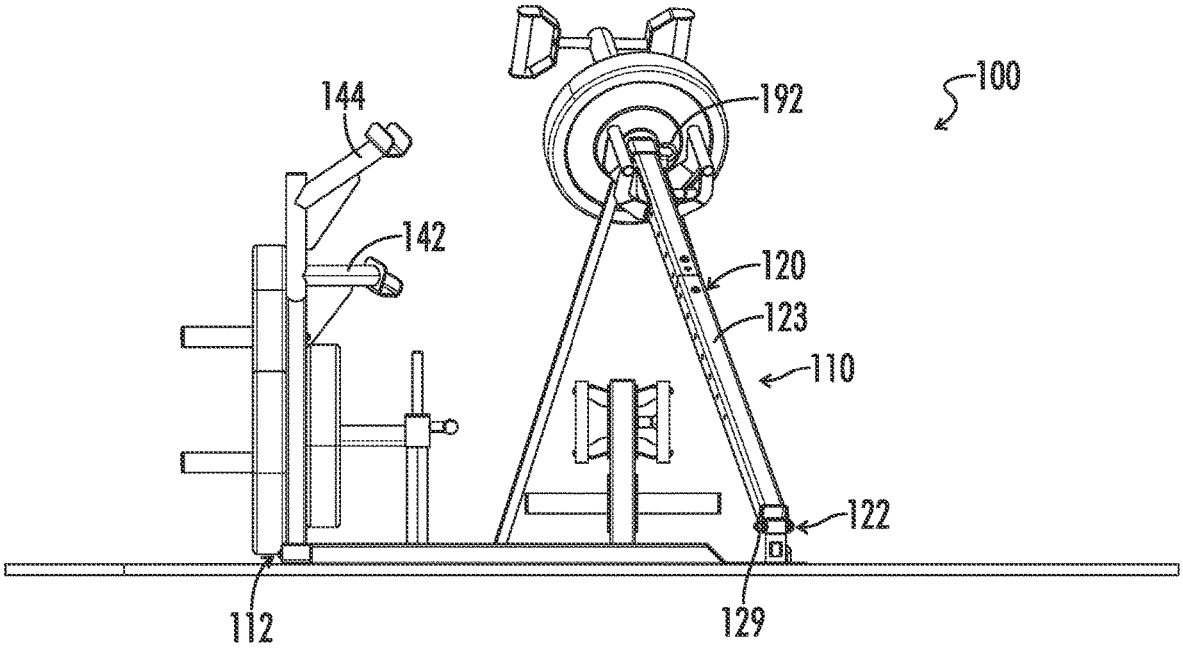
FIG. 6 is a back elevation view of the training system of FIG. 1 in accordance with the present disclosure.

Referring to FIGS. 1-10, a ground rotational workout (GRW) system 100 is shown. The training system 100 may include a first embodiment of a training apparatus 110. The training system 100 may also be referred to herein as a ground rotational workout system 100 or a GRW system 100. The training apparatus 110 may also be referred to herein as a ground rotational training apparatus 110 or a GRT apparatus 110. The training apparatus 110 may include a L-shaped base 112 supported by a ground surface 104 and having a first base support 114 and a second base support 116 extending perpendicularly from an end of the first base support at a connection point 118. The L-shaped base 112 may also be referred to herein as a base station. The L-shaped base 112 may further include a bracket support plate 117 coupled to a free end 119 of the first base support 114. The training apparatus 110 further includes a workout bar 120 pivotally coupled to a free end of the first base support 114, namely the bracket support plate 117, using a landmine bracket 122. The workout bar 120 includes a bar length 121, as shown in FIG. 4. The workout bar 120 may also be referred to herein as a square bar. The landmine bracket 122 may also be referred to herein as a pivot mechanism 122 or pivotal bracket 122. The workout bar is pivotally attached such that it can rotate horizontally as well as vertically. In other embodiments (not shown), the workout bar 120 can be disconnected from the landmine bracket 122 and a socket bracket can be attached in its place. The socket bracket being configured to receive an end of a traditional barbell.

Figure 42:
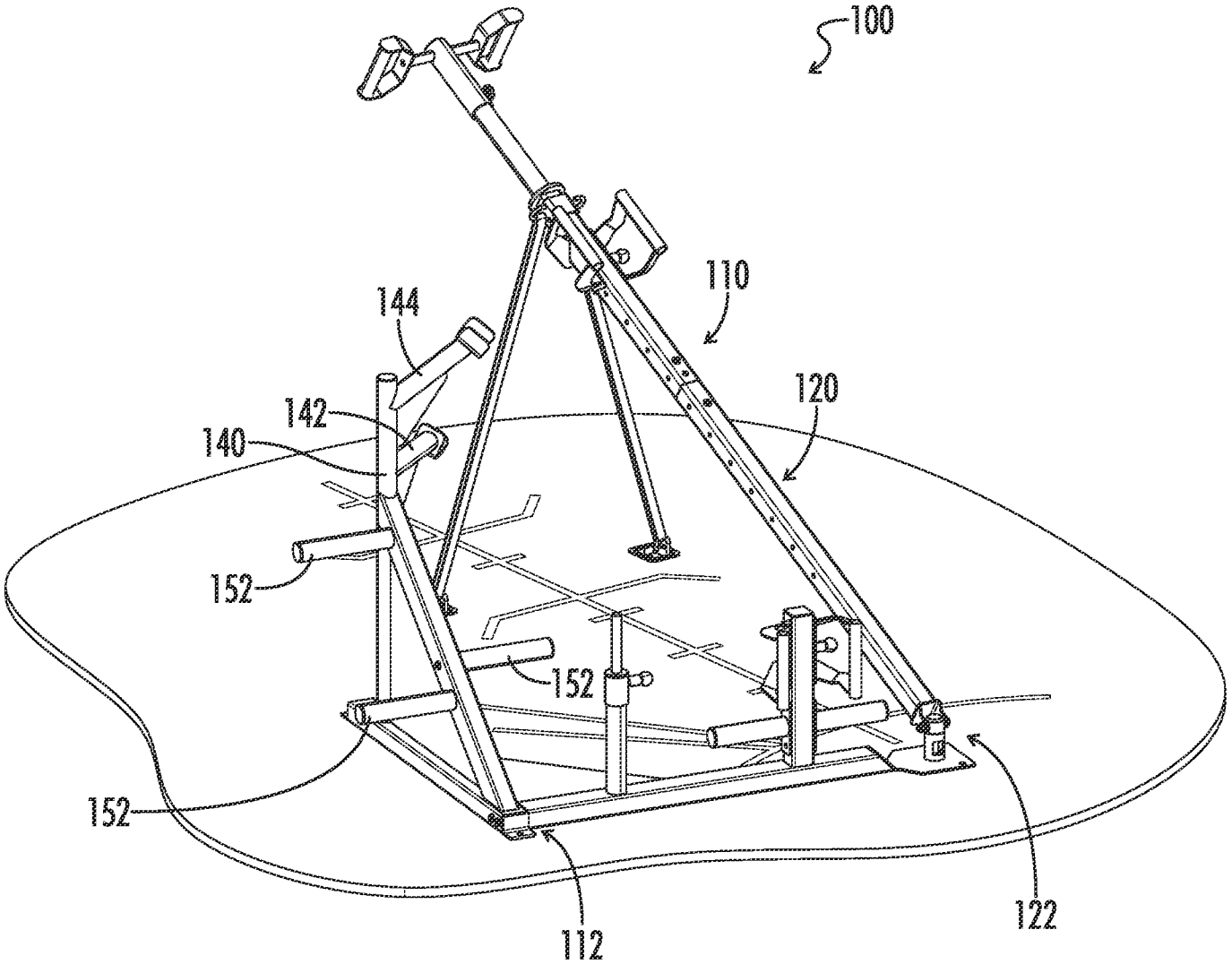
FIG. 42 is a back right top perspective view of the training system of FIG. 41 in accordance with the present disclosure.
Figure 43A:
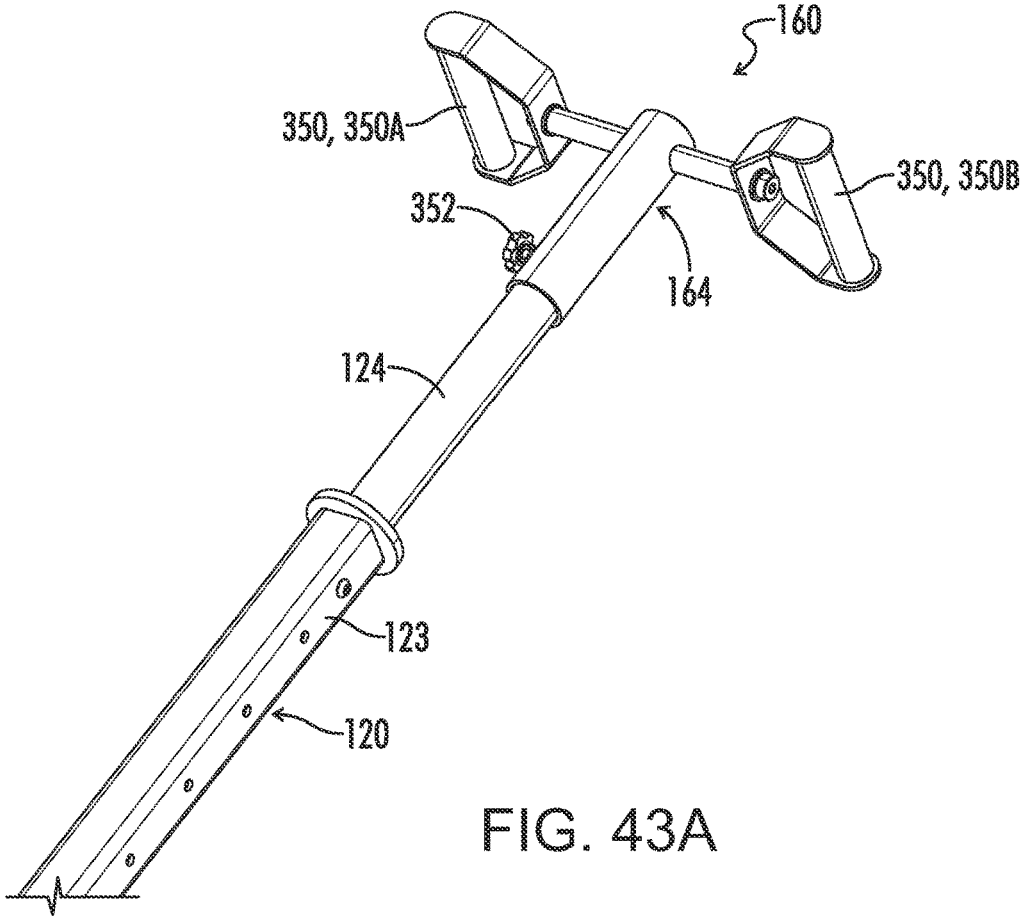
FIG. 43A is an enlarged perspective view of a workout bar of the training system of FIG. 1 with a first embodiment of an attachment positioned thereon in accordance with the present disclosure.
Figure 43B:
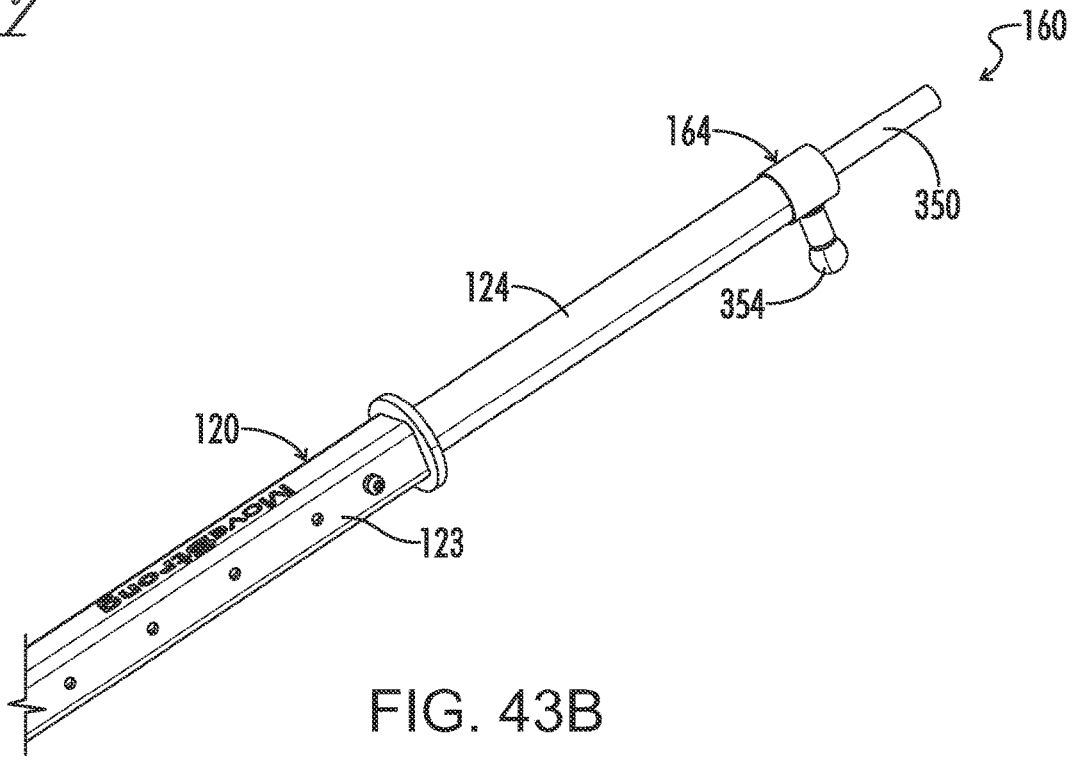
FIG. 43B is an enlarged perspective view of a workout bar of the training system of FIG. 1 with a second embodiment of an attachment positioned thereon in accordance with the present disclosure.

The workout bar 120 including a a cylindrical bar end portion 124 positioned distal relative to the landmine bracket 122 and a rectangular intermediate portion 123 positioned between the landmine bracket 122 and the cylindrical bar end portion 124. The cylindrical bar end portion 124 is configured to receive typical weight plates 102 found at most gyms. Accordingly, the cylindrical bar end portion 124 has a diameter that is less than or equal to two inches. As can best be seen in FIGS. 42 and 43, the training systems 100 and more specifically, the training apparatus 110 is shown with the weight plates 102 removed.

Figure 55:
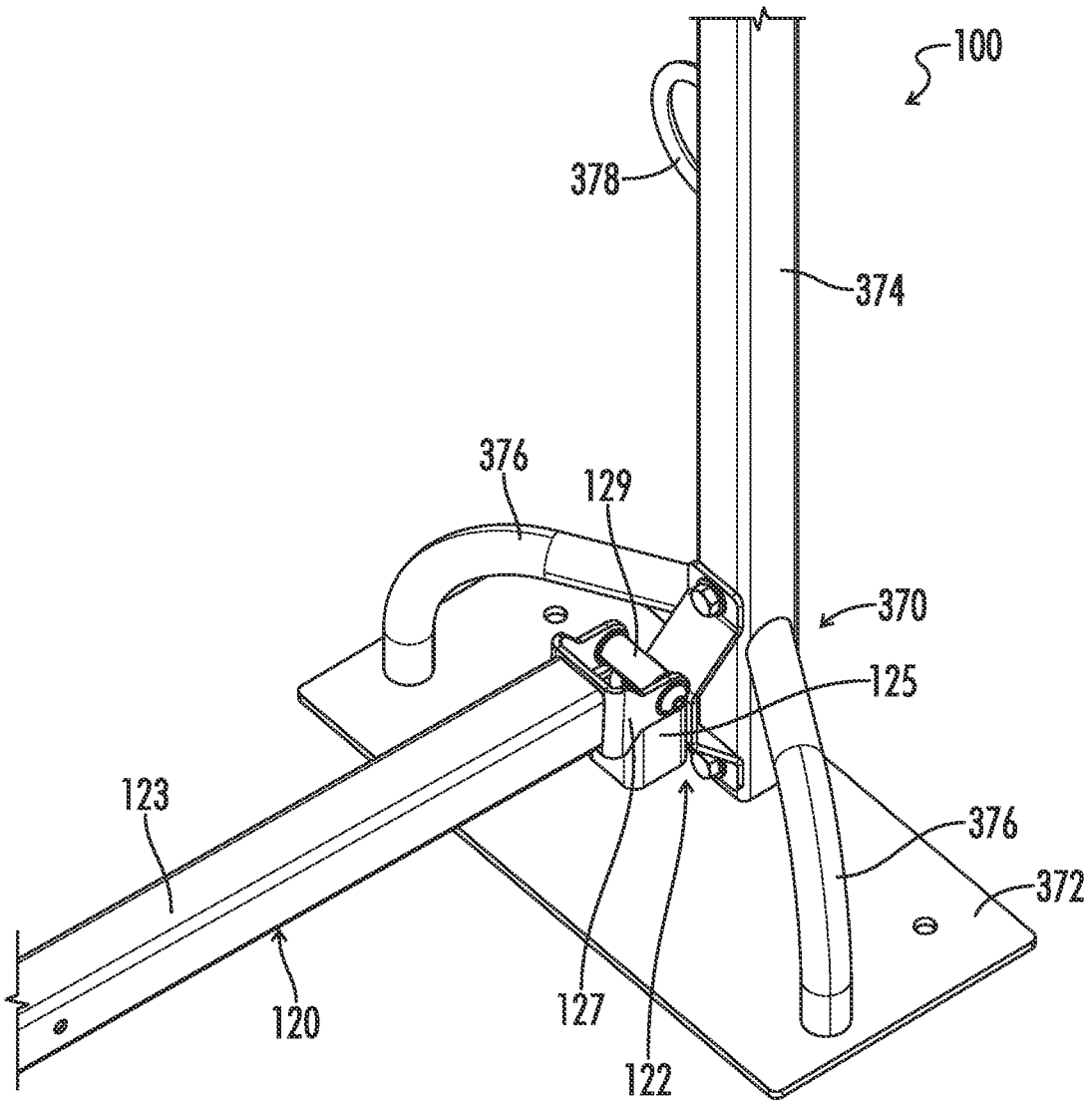
FIG. 55 is an enlarged perspective view of the training system of FIG. 54A taken of area 55-55 of FIG. 54A in accordance with the present disclosure.

The landmine bracket 122 may include a first portion 125 and a second portion 127. The first portion 125 is configured to be pivotally coupled to the second portion 127. The first portion 125 is couplable to a support surface 108. As shown in FIGS. 1-10, the support surface 108 is defined by the bracket support plate 117. The second potion 127 is coupled to the rectangular intermediate portion 123 of the workout bar 120. As can best be seen in FIG. 55, the landmine bracket 122 further includes a first (or vertical) pivot axis 128 and a second (or horizontal) pivot axis 129 oriented perpendicularly to the first pivot axis 128. The first pivot axis 128 and the second pivot axis 129 are positioned between the first portion 125 and the second potion 127 of the landmine bracket 122. The first pivot axis 128 and the second pivot axis 129 enable omnidirectional pivotal movement between the first portion 125 and the second potion 127 of the landmine bracket 122.

Figure 46:
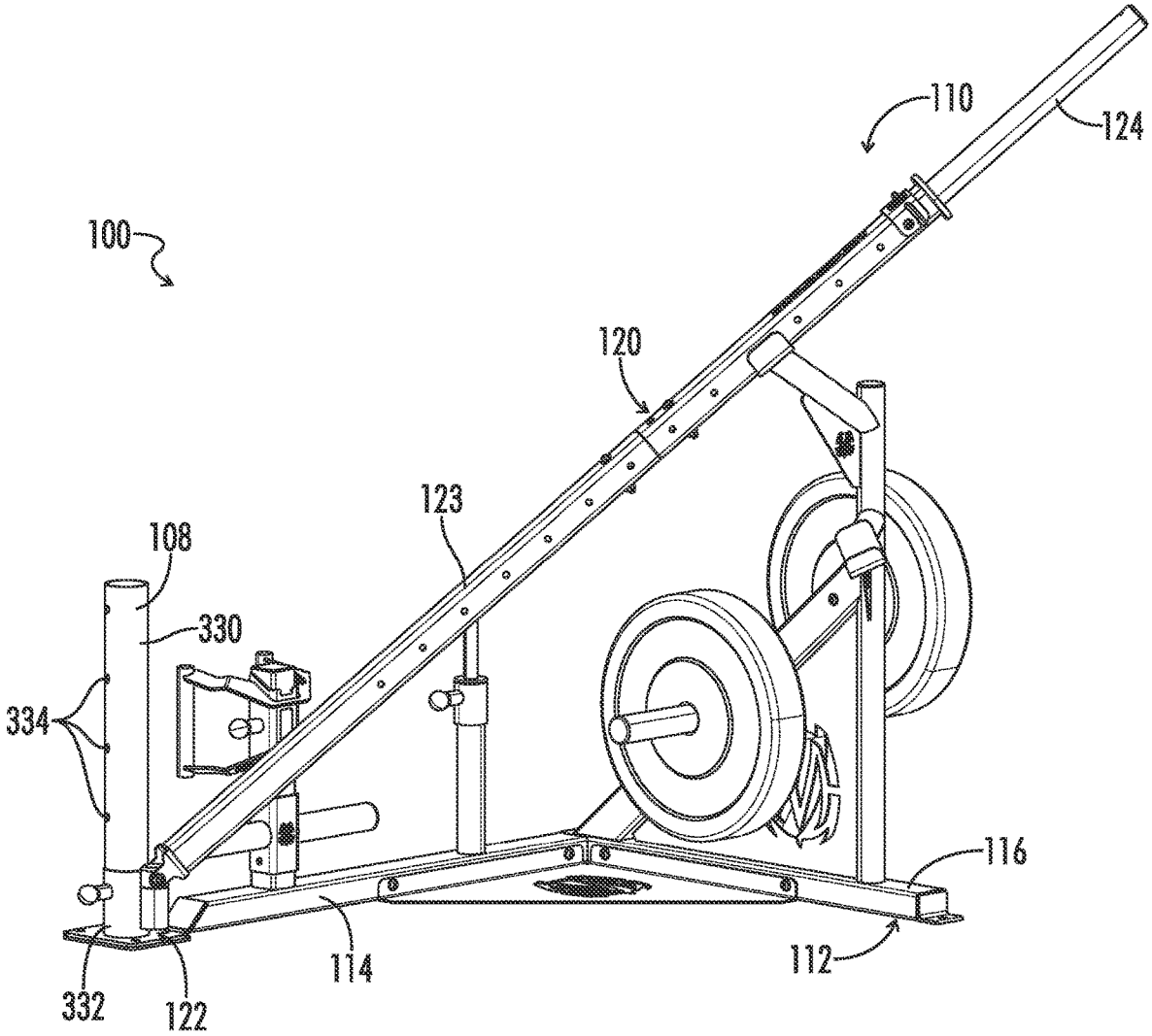
FIG. 46 is a perspective view of the training apparatus of FIG. 1 with a height adjustable landmine bracket in accordance with the present disclosure.

As illustrated in FIGS. 1-10, the landmine bracket 122 is coupled directly to the free end of the first base support 114, or more specifically to the bracket support plate 117. In other embodiments, as can best be seen in FIG. 46, the landmine bracket 122 may include a height adjustment post 330 and an adjustable pivot mechanism 332 coupled to the first portion of the landmine bracket 122. The height adjustment post 330 may extend vertically from the bracket support plate 117 and the adjustable pivot mechanism 332 may be adjustable positioned thereon. For example, the adjustable pivot mechanism 332 may selectively interact with a plurality of points 334 spaced along the height adjustment post 330. As shown in FIG. 46, the height adjustment post 330 may define the support surface 108. Accordingly, a height or pivot point of a proximal end of the workout bar 120 may be adjusted in order to add variations to may normal landmine workout movements.

Figure 51:
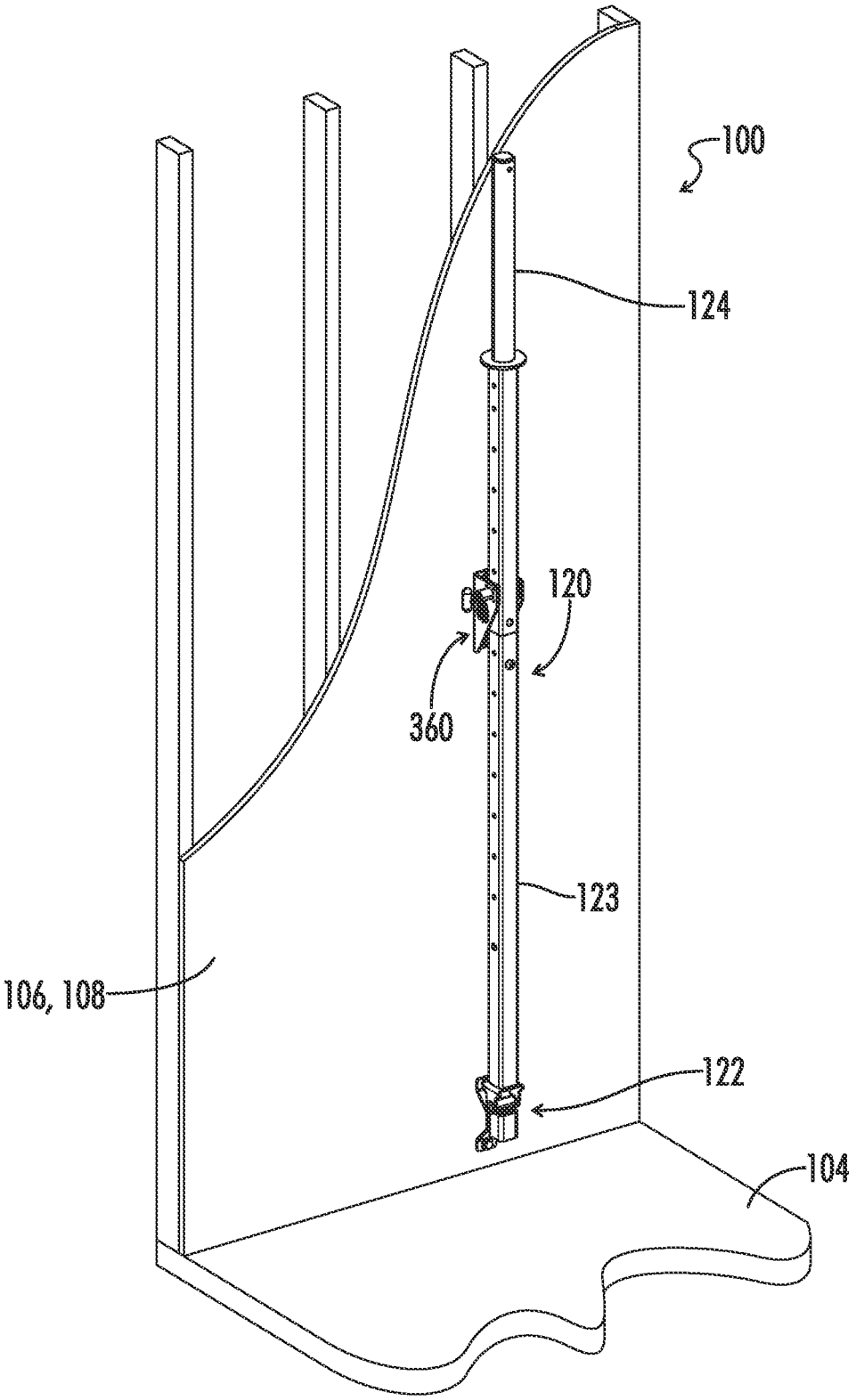
FIG. 51 is a perspective view of a workout bar of the training system of FIG. 1 with a landmine bracket and a storage bracket thereof coupled to a wall surface in accordance with the present disclosure.
Figure 52:
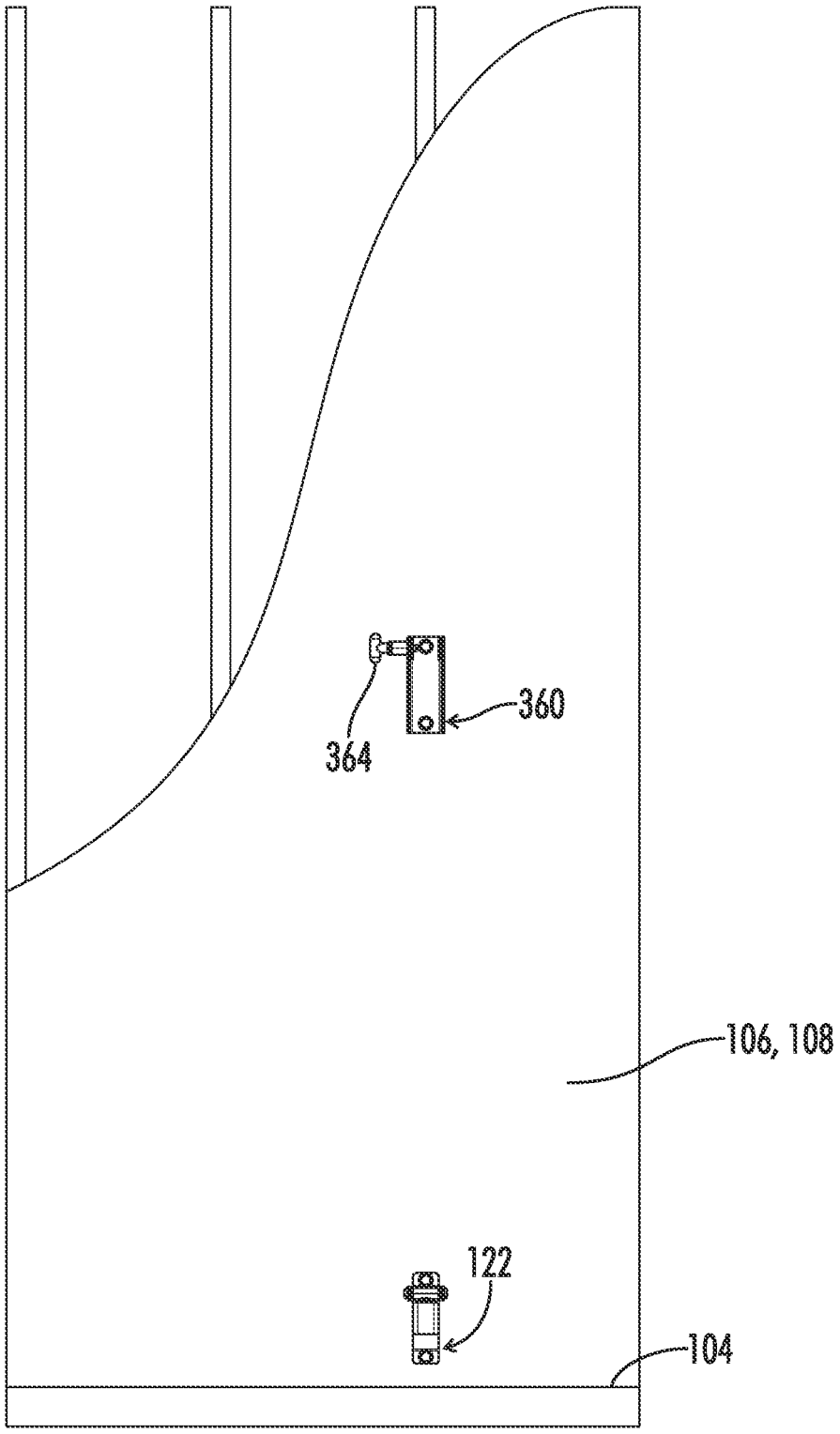
FIG. 52 is a front elevation view of the landmine bracket and storage bracket of FIG. 51 coupled to a wall surface in accordance with the present disclosure.
Figure 53A:
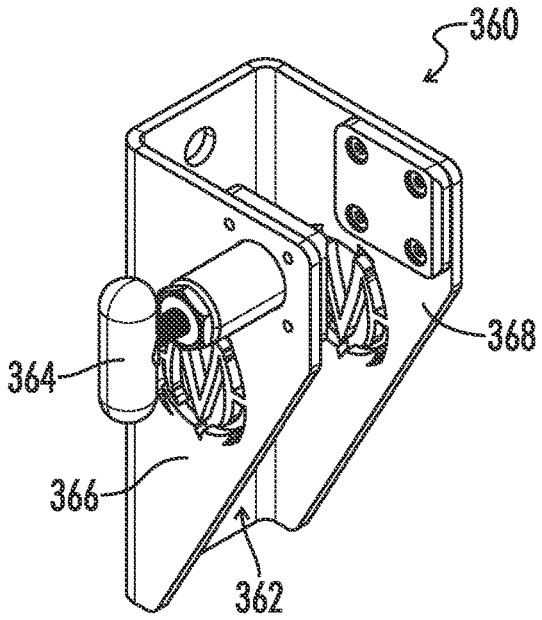
FIG. 53A is an upper front left perspective view of the storage bracket of FIG. 51 in accordance with the present disclosure.
Figure 53B:
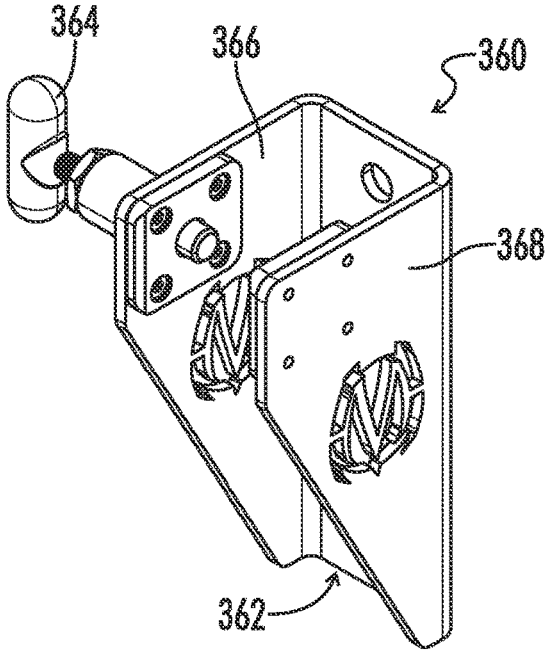
FIG. 53B is an upper front right perspective view of the storage bracket of FIG. 53A in accordance with the present disclosure.
Figure 53C:
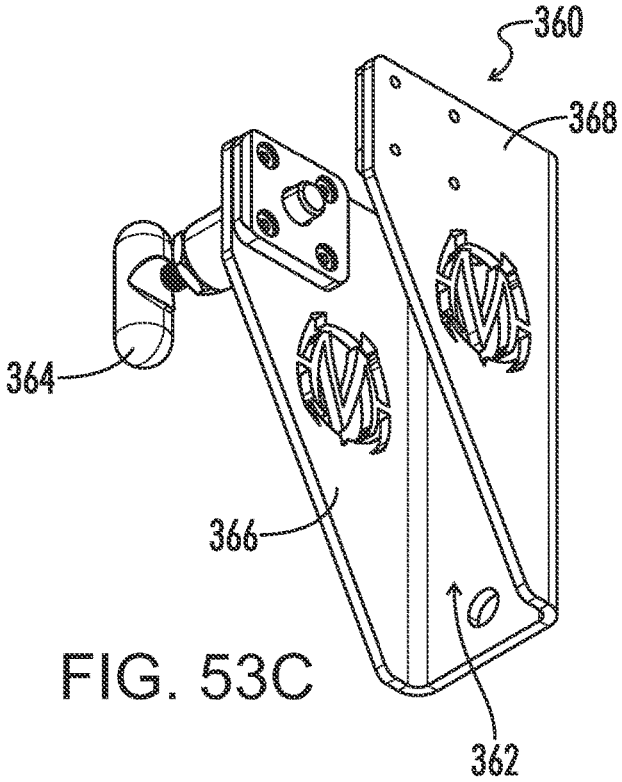
FIG. 53C is an lower front right perspective view of the storage bracket of FIG. 53A in accordance with the present disclosure.
Figure 54A:
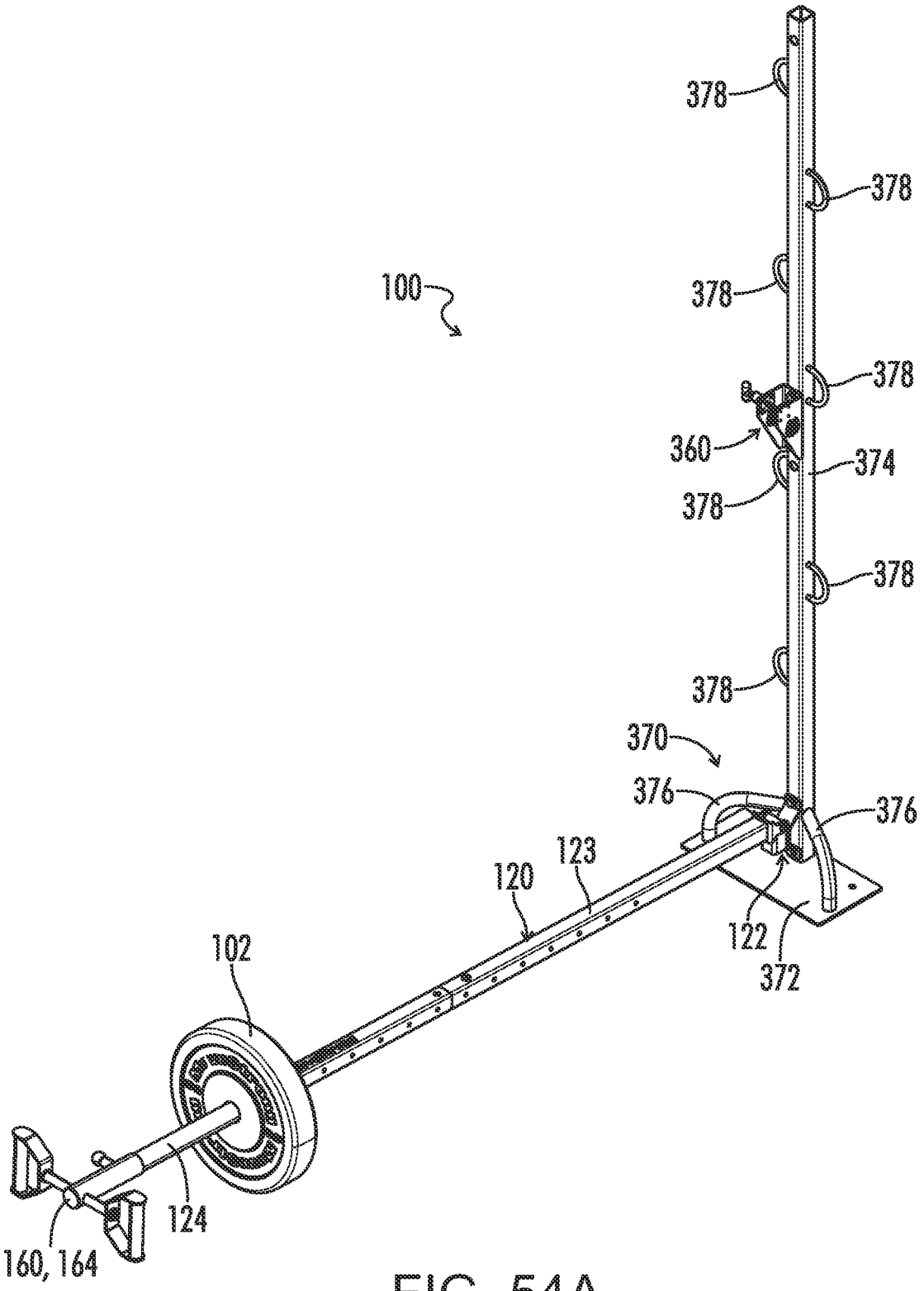
FIG. 54A is a perspective view of a training system including a base station with a workout bar of the training system in a non-stored position in accordance with the present disclosure.
Figure 54B:
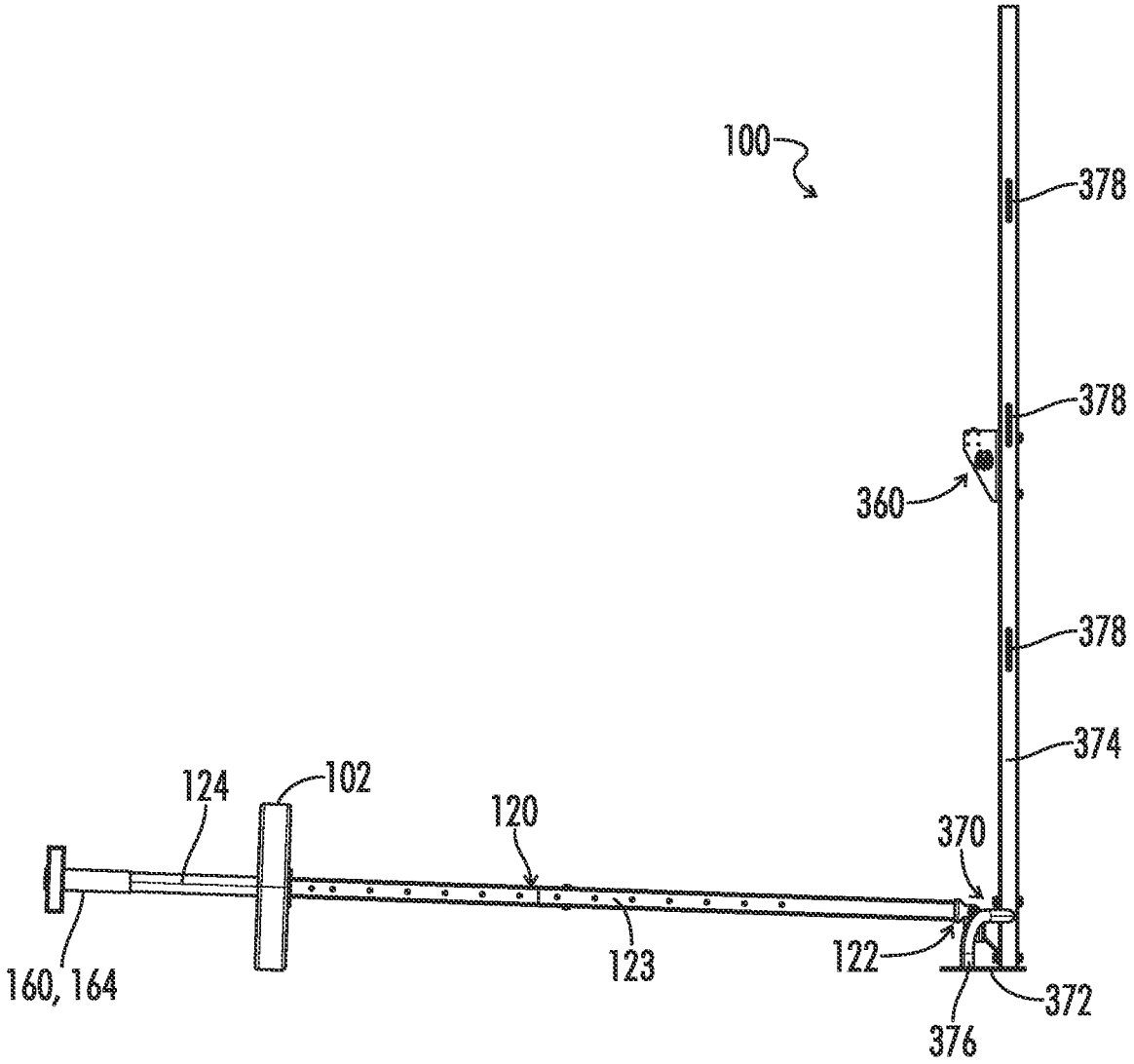
FIG. 54B is a right side elevation view of the training system of FIG. 54A in accordance with the present disclosure.
Figure 54C:
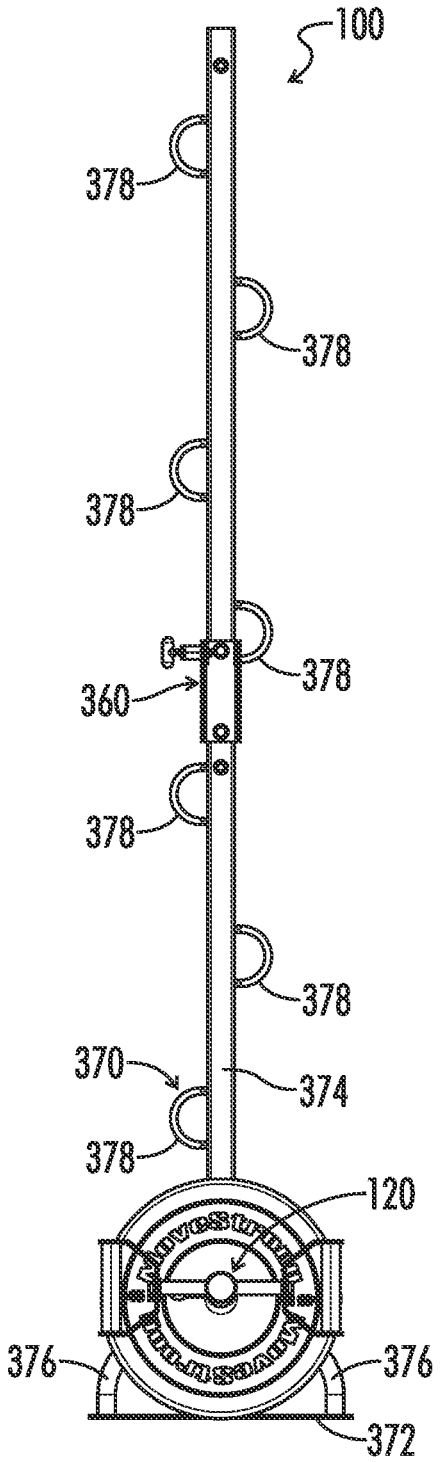
FIG. 54C is a front elevation view of the training system of FIG. 54A in accordance with the present disclosure.
Figure 54D:
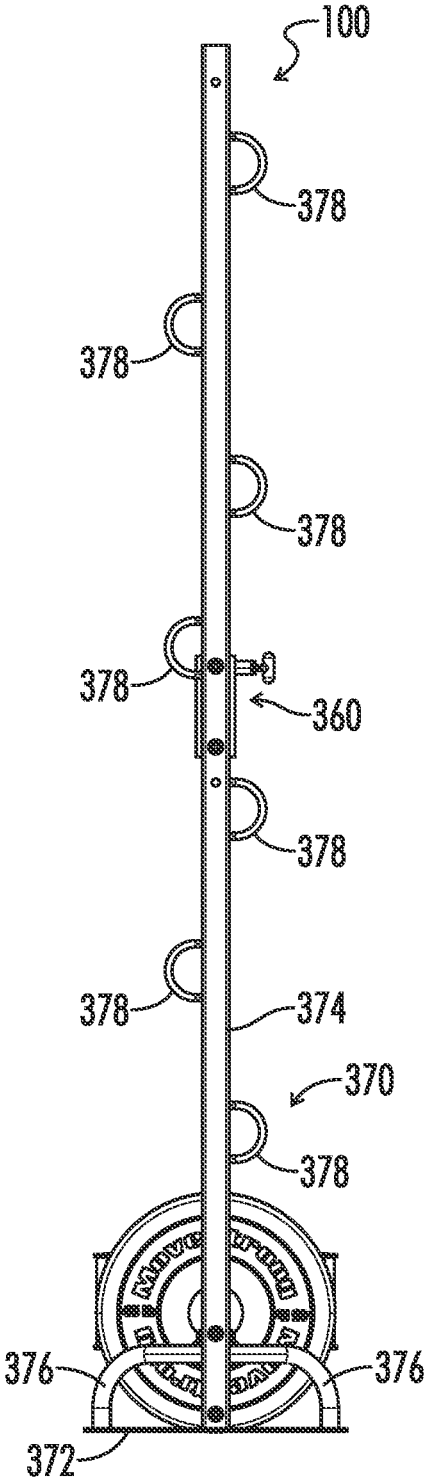
FIG. 54D is a rear elevation view of the training system of FIG. 54A in accordance with the present disclosure.
Figure 54E:
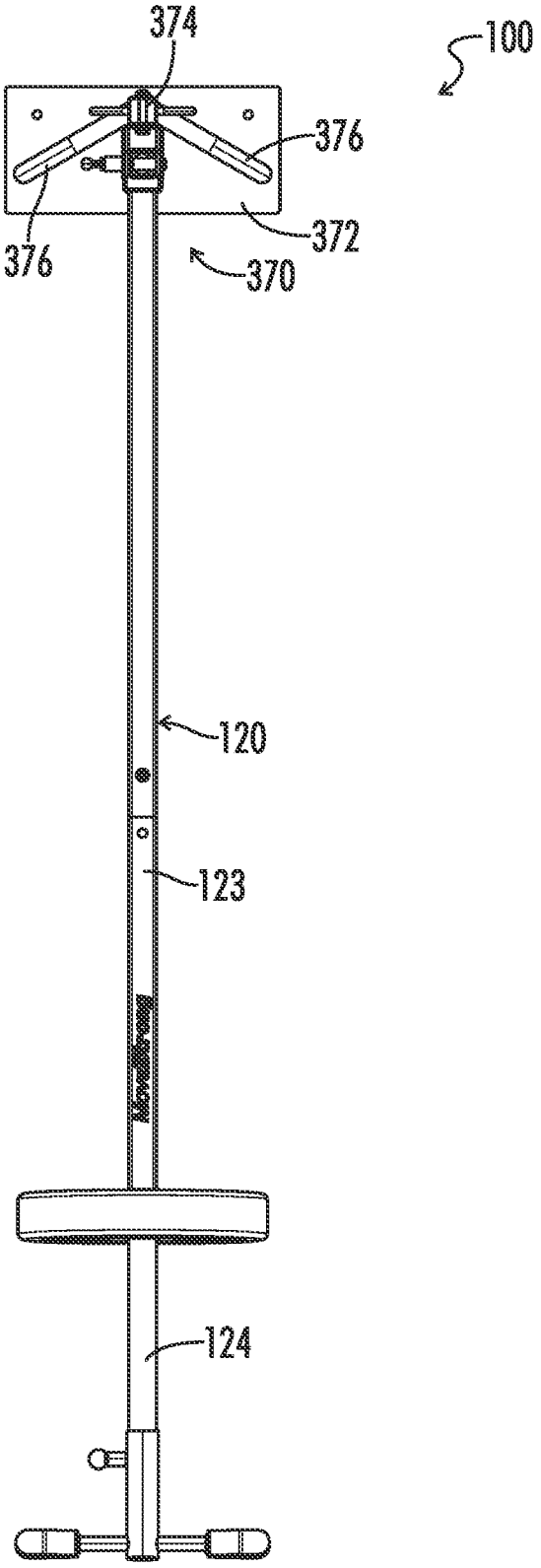
FIG. 54E is a top plan view of the training system of FIG. 54A in accordance with the present disclosure.

In further embodiments, as can best be seen in FIGS. 49A, 49B, 51, and 52, the support surface 108 may be a wall surface 106. Accordingly, the landmine bracket 122 of the training system 100 may include a wall mount 340 coupled to the first portion for coupling the workout bar 120 to the wall surface 106. In accordance with this embodiment, the training system 100 may further include a storage bracket 360 coupled to the support surface 108 above the landmine bracket 122, as shown in FIGS. 51 and 52. As shown in FIGS. 53A-53C, the storage bracket 360 includes a rectangular channel 362 and an engagement pin 364. The engagement pin 364 is configured to extend through one side wall of a pair of opposite side walls 366, 368 of the rectangular channel 362. The engagement pin 364 may be configured to releasable engage one hole of the plurality of pairs of holes 126 of the workout bar 120 for storing the workout bar 120 vertically.

In other embodiments, having similarities to the one described directly above and illustrated in FIGS. 54A-54E, the training system 100 further includes, beyond the landmine bracket 122 and the workout bar 120, a base station 370 supported by the ground surface 104. The base station 370 includes a base plate 372, a rectangular vertical support post 374, and the storage bracket 360. The base plate 372 is couplable to the ground surface 104. The rectangular vertical support post 374 extends from the base plate and includes four side walls, one of which defines the support surface 108 upon which the landmine bracket 122 attaches. As illustrated in FIGS. 54A-54E, the workout bar 120 is positioned in a non-stored position, however it should be noted that the workout bar 120 may be positioned vertically in a stored position (not shown). The storage bracket 360 is coupled to the support surface 108 above the landmine bracket 122. The base station 370 includes two battle rope anchors 376 coupled between the base pate 372 and the rectangular vertical support post 374. The base station 370 further includes a plurality of band anchors 378 positioned along a length of the rectangular vertical support post 374. The band anchors configured to receive a workout band as illustrated.

Figure 50:
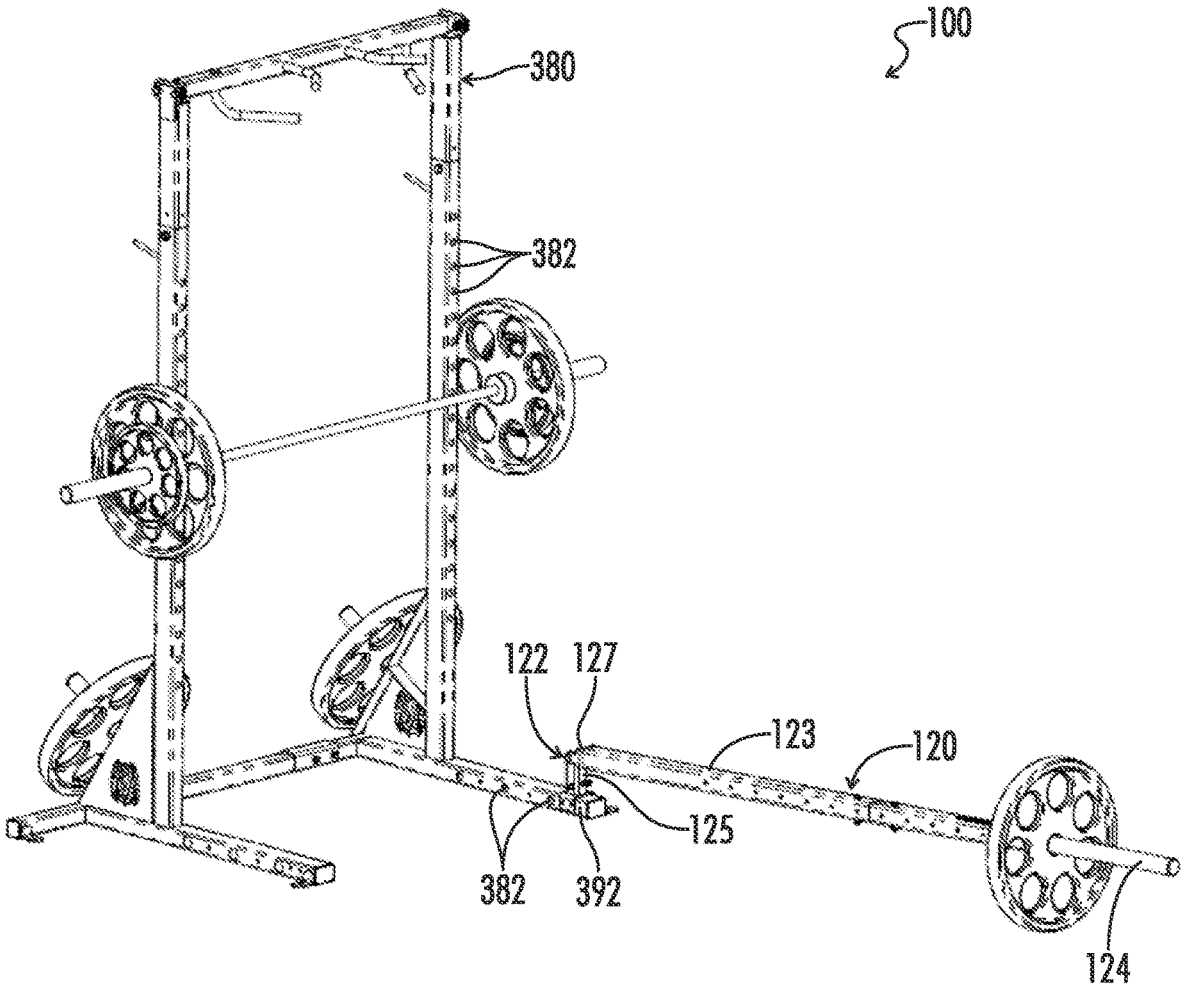
FIG. 50 is a perspective view of a workout bar of the training system of FIG. 1 with a landmine bracket thereof coupled to a squat rack in accordance with the present disclosure.

In still further embodiments, as can best be seen in FIG. 50, the first portion 125 of the landmine bracket 122 of the training system 100 may be coupleable to a rig mount 342 for coupling the workout bar 120 to a squat rack 380 or a typically larger workout rig (not shown). The squat rack 380 may also be referred to herein as a workout rig. Accordingly, the support surface 108 is defined by the squat rack 380. The squat rack 380 includes a plurality of holes 382 defined therein. The rig mount 342 is configured to engage one of the plurality of holes 382 of the squat rack 380 for removably coupling the landmine bracket 122 to the squat rack 380 using, for example, an engagement pin (not shown).

The first base support 114 includes at least a first vertical post 130 and a second vertical 132 coupled thereto and extending vertically therefrom. The first and second vertical posts 130, 132 may be positioned between the connection point 118 and the free end of the first base support 114 where the landmine bracket 122 is located. The first vertical post 130 may be positioned closer to the landmine bracket 122 than to the connection point 118 of the first base support 114. The second vertical post 132 may be positioned closer to the connection point 118 than to the landmine bracket 122. The first vertical post 130 may have square cross-sectional profile matching that of the workout bar 120. The first vertical post 130 may further include a pair of horizonal cylindrical pipes 134 extending from opposite sides thereof. The pair of horizonal cylindrical pipes 134 are positioned parallel to the first base support 114 and may be coupled closer to the first base support 114 than to a free end of the first vertical post 130. The pair of horizonal cylindrical pipes 134 may be configured to receive a battle rope (not shown) for performing various rope exercises. The second vertical post 132 may include a cylindrical cross-sectional profile matching that of the cylindrical barbell end portion 122. In other embodiments (not shown), the positioning of the first and second vertical posts 130, 132 may be switched.

Figure 44:
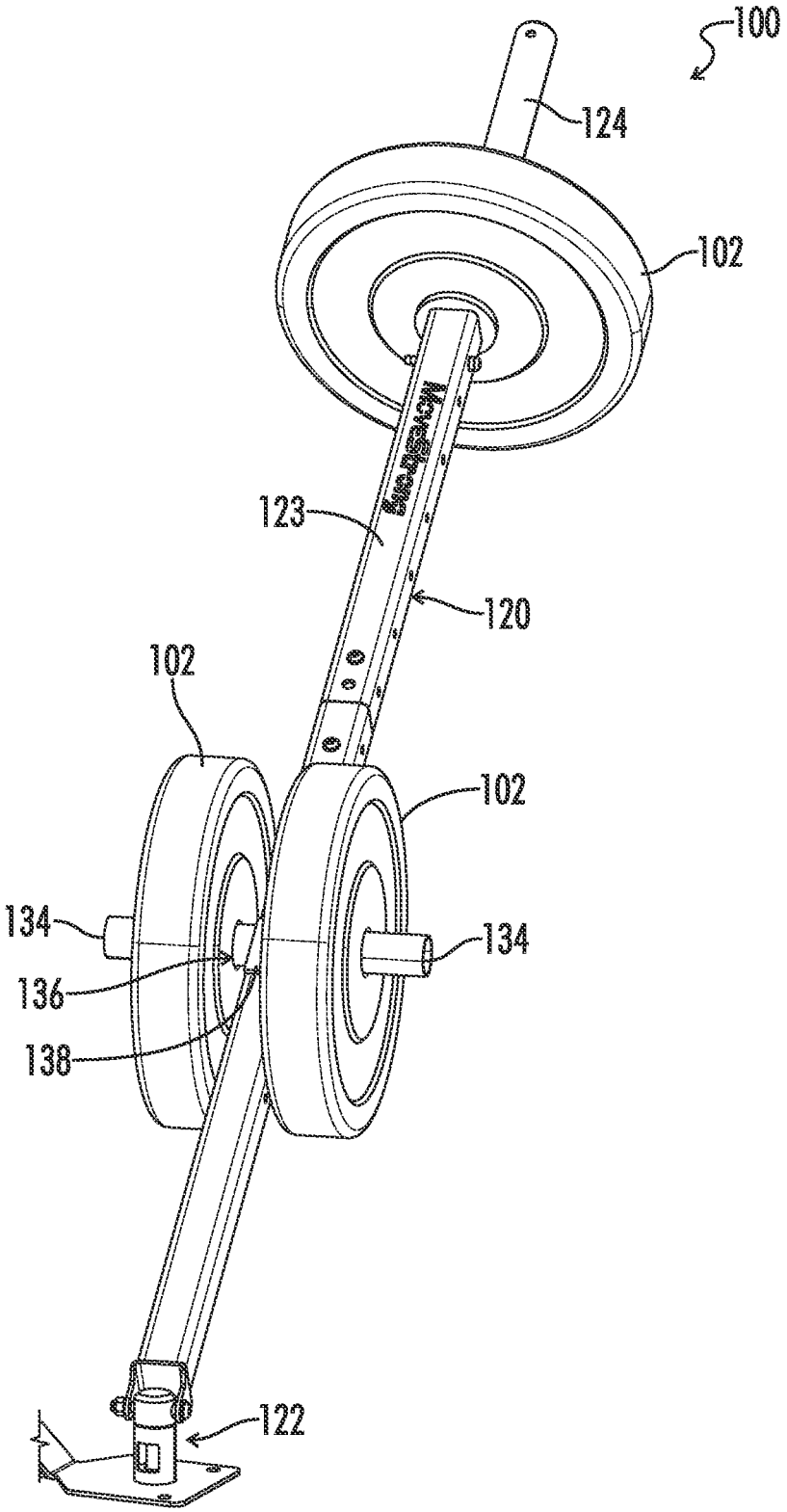
FIG. 44 is an enlarged perspective view of a workout bar of the training system of FIG. 1 with a weight horn attachment coupled thereto in accordance with the present disclosure.

Alternatively, and as can best be seen in FIG. 44, the pair of horizontal cylindrical pipes 134 may be part of a weight horn attachment 136 which may be selectively attached to the workout bar 120 for adding additional weight plates 102 to the workout bar. The pair of cylindrical pipes 134 may also be referred to herein as a pair of weight receivers. The pair of cylindrical pipes 134 may extend from opposite side walls of a rectangular channel 138 of the weight horn attachment 136. When not in use, the weight horn attachment 136 may be attached to the first vertical post 130 for storage purposes, or for use to attach a battle rope thereto. Traditional landmine setups are limited because you cannot easily add weight along a length of a traditional workout bar.

Figure 47:
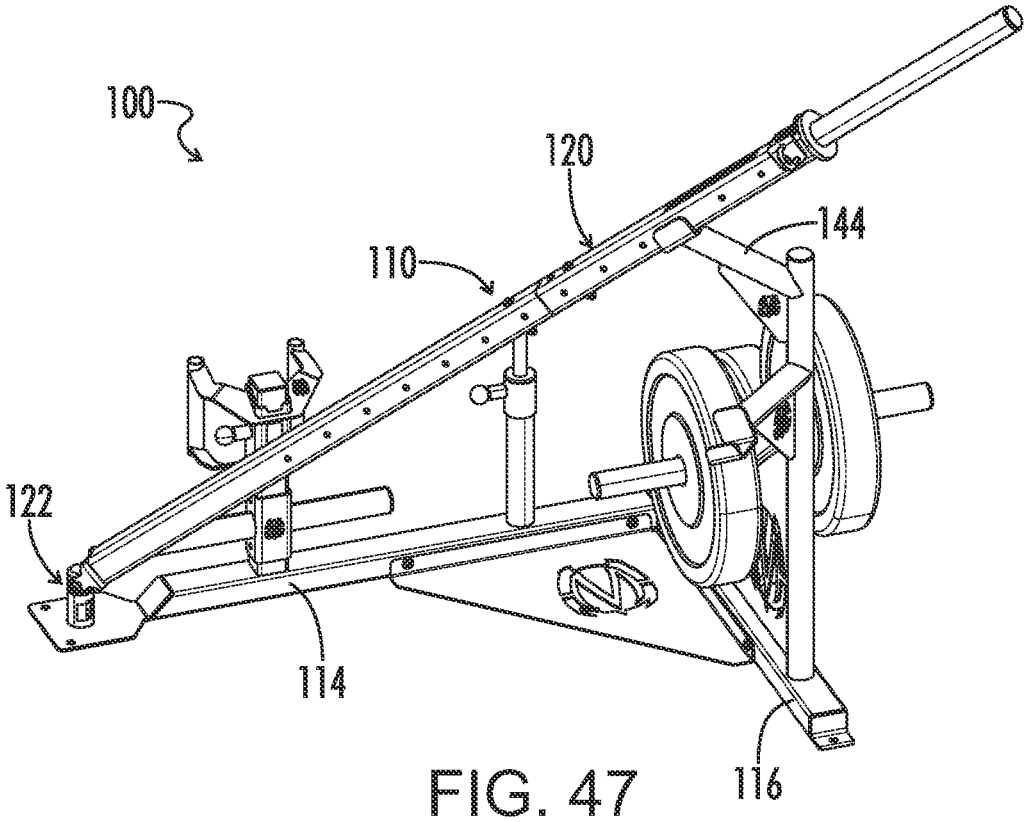
FIG. 47 is a perspective view of the training apparatus of FIG. 1 configured in a right hand configuration in accordance with the present disclosure.
Figure 48:
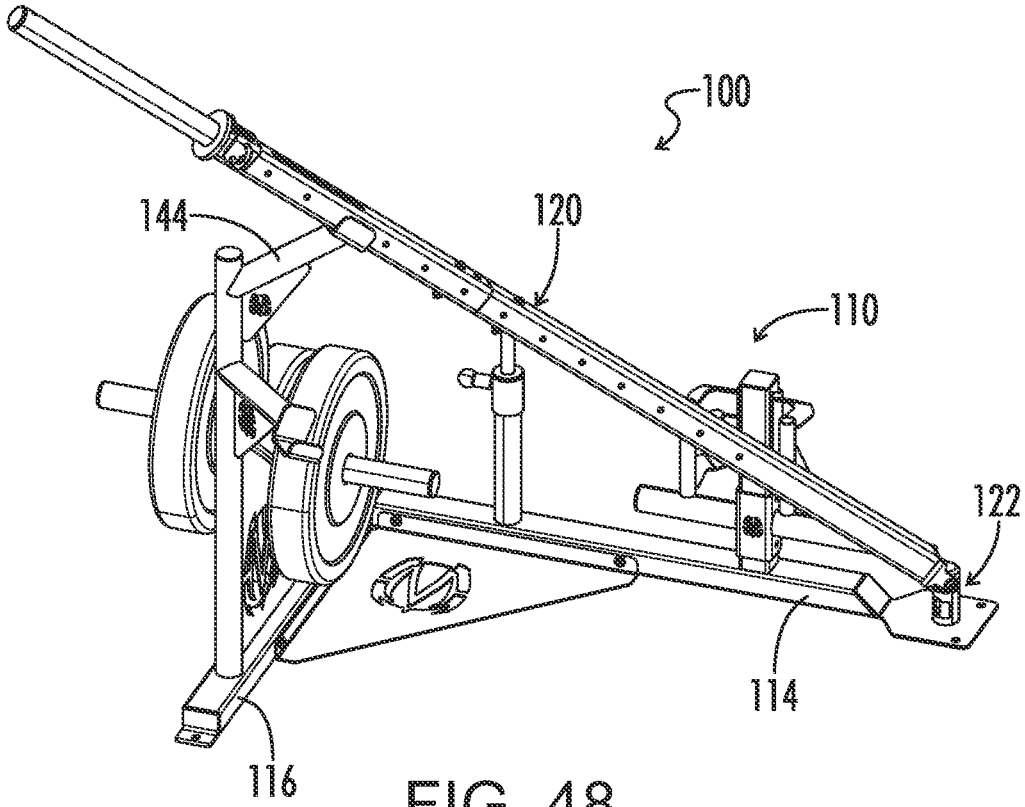
FIG. 48 is a perspective view of the training apparatus of FIG. 1 configured in a left hand configuration in accordance with the present disclosure.
Figure 49A:
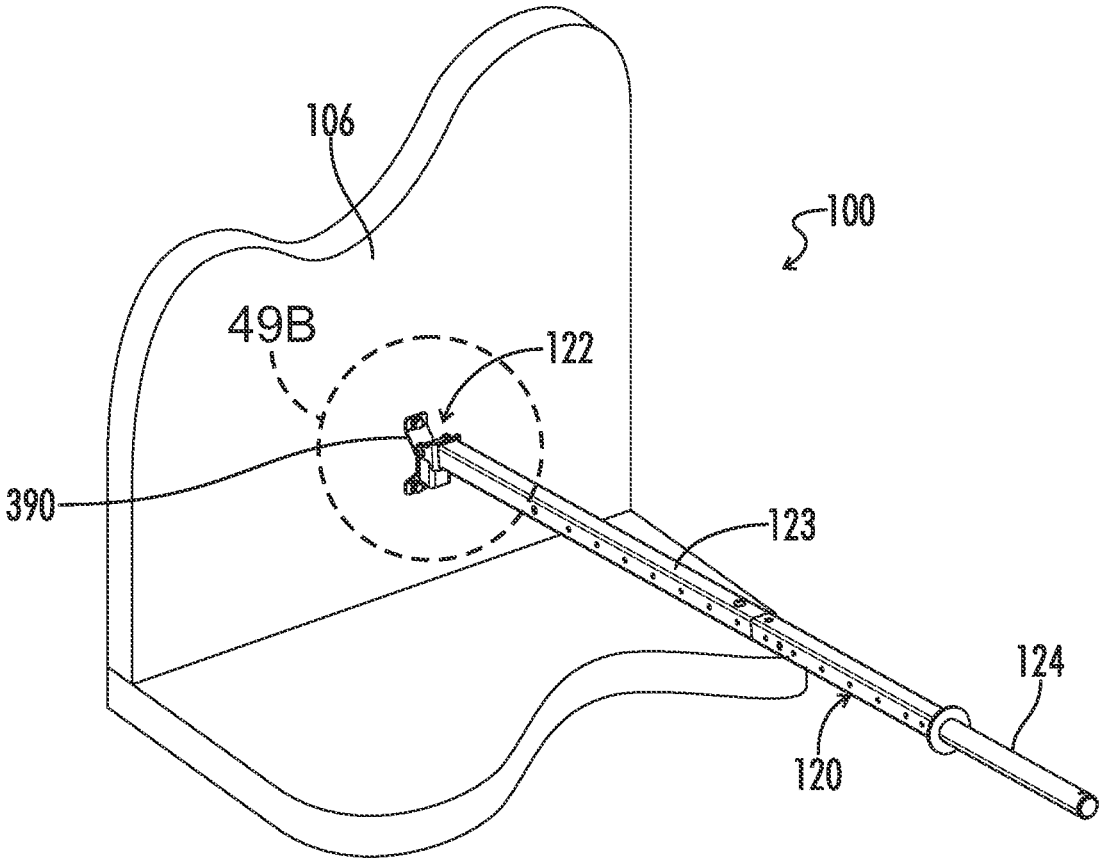
FIG. 49A is a perspective view of a workout bar of the training system of FIG. 1 with a landmine bracket thereof coupled to a wall in accordance with the present disclosure.
Figure 49B:
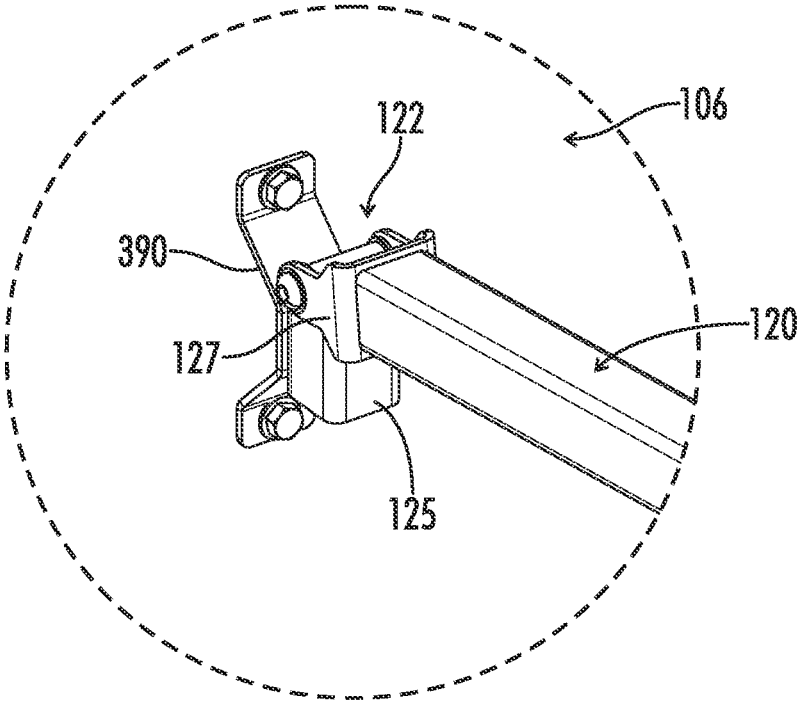
FIG. 49B is an enlarged perspective view of the workout bar and the landmine bracket of FIG. 49A taken of area 49B-49B of FIG. 49A in accordance with the present disclosure.

As can best be seen in FIGS. 47 and 48, the L-shaped base 112 may be configured according to a right hand configuration or a left hand configuration. For the most part, the right and left hand configurations can be accomplished by switching the positioning of the first base support 114 and the second base support 116. The ability to modularly assemble the L-shaped base allows for greater customizability when fitting and installing the training apparatus 110 in different spaces having different sizing and special constraints such as corners.

The second base support 116 includes a main vertical support post 140 extending vertically therefrom and coupled closer to a free end of the second base support than to the connection point 118 of the second base support 116. Alternatively, the main vertical support post 140 may be coupled proximate to the free end of the second base support 116. The main vertical support post 140 further includes a low dock bracket 142 and high dock bracket 144. The low dock bracket 142 and the high docket bracket 144 may be referred to herein as at least one docket bracket. The low and high dock brackets 142, 144 extend from the main vertical support post 140 in directions similar to that of the first base support 114. As can best be seen in FIG. 7, the low dock bracket 142 extends from the main vertical support post 140 at a first angle 146 relative to the second base support 116. The high dock bracket 144 extends from the main vertical support post 140 at a second angle 148 relative to the second base support 116. The first angle 146 is generally greater than or equal to 90° and the second angle 148 is generally less than or equal to 90°. The low and high dock brackets 142, 144 may be angled upwardly, downwardly, or generally perpendicular to the main vertical support post 140. Each of the low and high dock brackets 142, 144 includes a dock receiver positioned at an end thereof. Each dock receiver is configured to receive the workout bar 120 (shown in FIGS. 9 and 10). The low and high dock brackets 142, 144 may be useful for performing workout movements that begin in a high position and which may be loaded up with such a weight that it is difficult or impractical to begin the movement from the floor. As can best be seen in FIG. 9, the workout bar 120 is supported by the low dock bracket 142. As can best be seen in FIG. 10, the workout bar 120 is positioned in the high dock bracket 144.

The workout bar may be angled relative to the ground surface 104 at an angle 149 of at least 25 degrees when received by either the low dock bracket 142 or the high dock bracket 144.

The second base support 116 may further include a diagonal support 150 coupled between the connection point 118 and the main vertical support post 140 at a location below the low and high dock brackets 142, 144. In other embodiments (not shown), the diagonal support 150 may be coupled to the main vertical support post 140 between or above the low and high dock brackets 142, 144. The diagonal support 150 is configured to strengthen and support the main vertical support post 140 and may be especially important when the workout bar 120 is supported by one of the low or high dock brackets 142, 144. The diagonal support 150 may include a plurality of cylindrical pipes 152 extending perpendicularly from opposite sides of the diagonal support 150. The plurality of cylindrical pipes 152 may be configured to receive and store the weight plates 102 when not in use.

The training system 100 may further include a plurality of workout attachment members 160. The plurality of attachment members 160 may include at least one square bar handle attachment 162 (shown in FIG. 43C) and at least one cylindrical barbell end portion handle attachment 164 (shown in FIGS. 43A and 43B). Each of the at least one square bar handle attachment 162 and the at least one cylindrical barbell end portion handle attachment 164 may also be referred to herein as an attachment member or user engagement attachment. The at least one square bar handle attachment 162 is configured to be attached to the workout bar 120 for performing various workout movements. The workout bar 120 includes a plurality of pairs of holes 126 extending therethrough opposite sides of the workout bar 120 spaced along the bar length 121. The plurality of pairs of holes 126 are aligned in a direction parallel with the second (or horizontal) pivot axis 129.

Figure 43C:
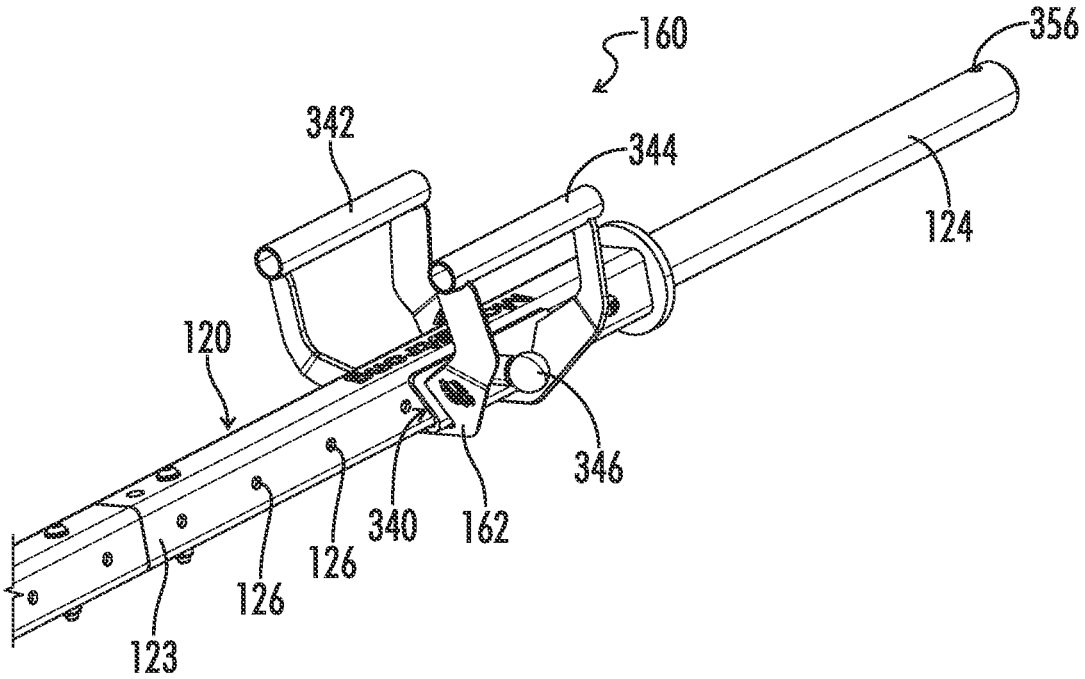
FIG. 43C is an enlarged perspective view of a workout bar of the training system of FIG. 1 with a third embodiment of an attachment positioned thereon in accordance with the present disclosure.

The at least one square bar handle attachment 162 may be coupled at any point along the length of the workout bar 120 using at least one hole of the plurality of pairs of holes 126 of the workout bar 120. The profile of the workout bar 120 and the plurality of holes allow the at least one square bar handle attachment 162 to be securely attached to the workout bar 120 while performing various movements. The at least one square bar handle attachment 162 may be stored on the first vertical post 130 and may be coupled to a hole of the first vertical post 130 for secure, neat and organized storage thereof. As illustrated in FIG. 43C, the at least one square bar handle attachment 162 includes a rectangular channel 340, first and second handles 342, 344 spaced apart from opposite side walls of the rectangular channel 340, and an engagement pin 346 extending through one of the opposite side walls of the rectangular channel 340. The engagement pin 346 is configured to releasably engage one hole of the plurality of pairs of holes 126.

Figure 45:
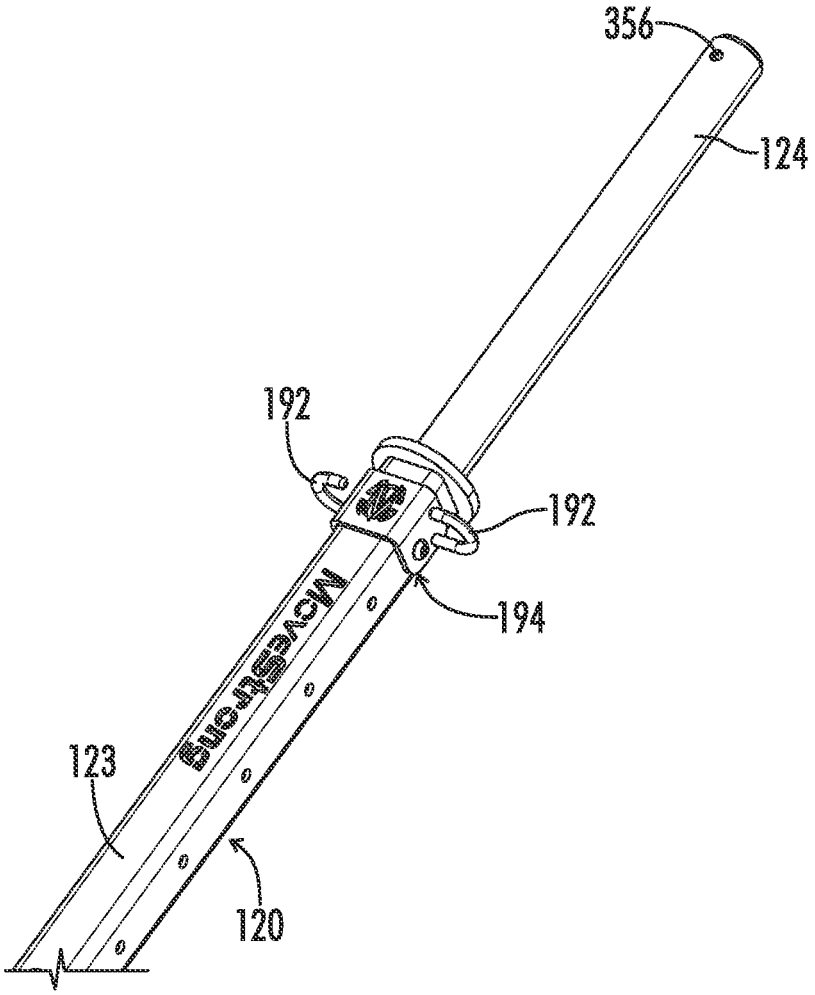
FIG. 45 is an enlarged perspective view of a workout bar of the training system of FIG. 1 with a hook bracket coupled thereto in accordance with the present disclosure.

The at least one cylindrical barbell end portion handle attachment 164 is configured to be slid over an end of the cylindrical bar end portion 124 and securely attached thereto. The at least one cylindrical barbell end portion handle attachment 164 may also be referred to herein as a user engagement attachment. The at least one cylindrical barbell end portion handle attachment 164 includes at least one handle 350. The at least one cylindrical barbell end portion handle attachment 164 may be securely attached to the cylindrical bar end portion 124 using a screw like tightening bracket 352 (shown in FIG. 43A), engagement pin 354 (shown in FIG. 43B), or the like. The engagement pin 354 may engage a hole 356 (shown in FIGS. 43C and 45) defined in the cylindrical bar end portion 124 closer to a free end of the cylindrical bar end portion 124 than to the rectangular intermediate portion 123 of the workout bar 120. Two cylindrical barbell end portion handle attachments 164 are illustrated, one having a single post step-down style handle 350 (shown in FIG. 43B) extending therefrom and the other having two handles 350A, 350B extending in a T-shaped configuration (shown in FIG. 43A). The single post version may have a diameter smaller than that of the cylindrical bar end portion 124. The single post and double handle cylindrical barbell end portion handle attachments may each be used for performing various different movements using the training apparatus 110. The at least one cylindrical barbell end portion handle attachment 164 may be stored on the second vertical post 132 when not being used. The at least one cylindrical barbell end portion handle attachment 164 may also be stored on one of the plurality of cylindrical pipes 152.

The training system 100 may further include floor markings 170 configured to help a user position their feet for performing various exercises. The floor markings 170 may include a main line 172 emanating from landmine bracket 122. The main line 172 may include a plurality of hash marks spaced along a length of the main line 172 for helping to orient a user's feet while performing different exercise movements. The floor markings 170 may further include an arc 176 surrounding the landmine bracket 122 and intersecting the main line 172. Finally, the floor markings 170 may include a low dock line 178 and a high dock line 180 each emanating from the arc 176 and aligned between the landmine bracket 122 and one of the low dock bracket 142 or the high dock bracket 144, respectively.

The main line 172 may be slightly angled toward the second base support 116 for minimizing a footprint of the training apparatus 110 when in use. As can best be seen in FIG. 7, the main line 172 may be angled at a main line angle 182 relative to the first base support 114 towards the second base support 116. The main line angle 182 may be acute angle.

The floor markings 170 may be applied to a ground surface 104 such as a decal, sticker, or the like. In other embodiments, the floor markings 170 may be applied to the floor using paint and stencil (not shown). The floor markings 170 need to be durable and securely attached to the floor so as not to be easily removed or torn by a person's shoes scuffing up against them. The floor markings 170 may be extremely useful for users performing various movements in which their feet move between starting and ending positions, such as a push jerk. The floor markings 170 help the user orient their feet, move their feet and then reorient their feet simply and easily so as to add consistency and repeatability to the workout movement.

Figure 7:
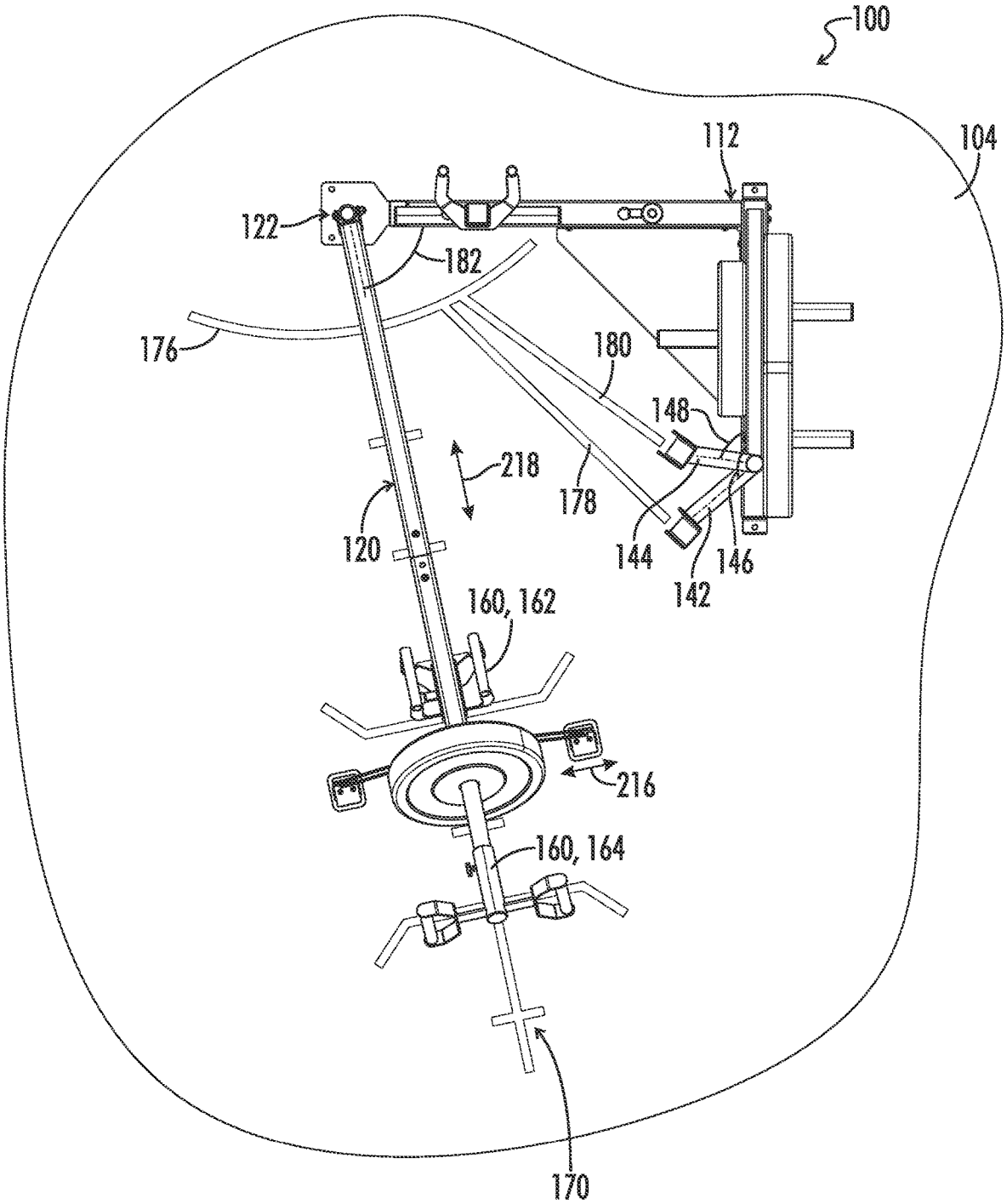
FIG. 7 is a top plan view of the training system of FIG. 1 in accordance with the present disclosure.
Figure 8:
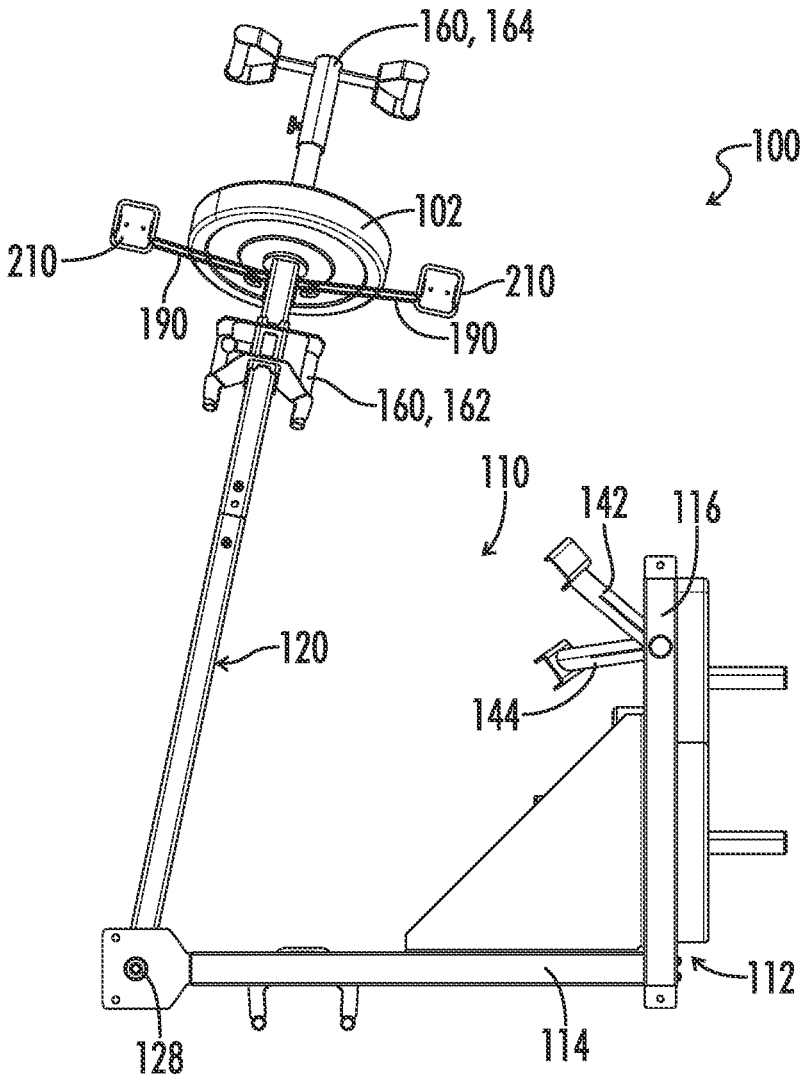
FIG. 8 is a bottom plan view of the training system of FIG. 1 with ground surface removed in accordance with the present disclosure.
Figure 9:
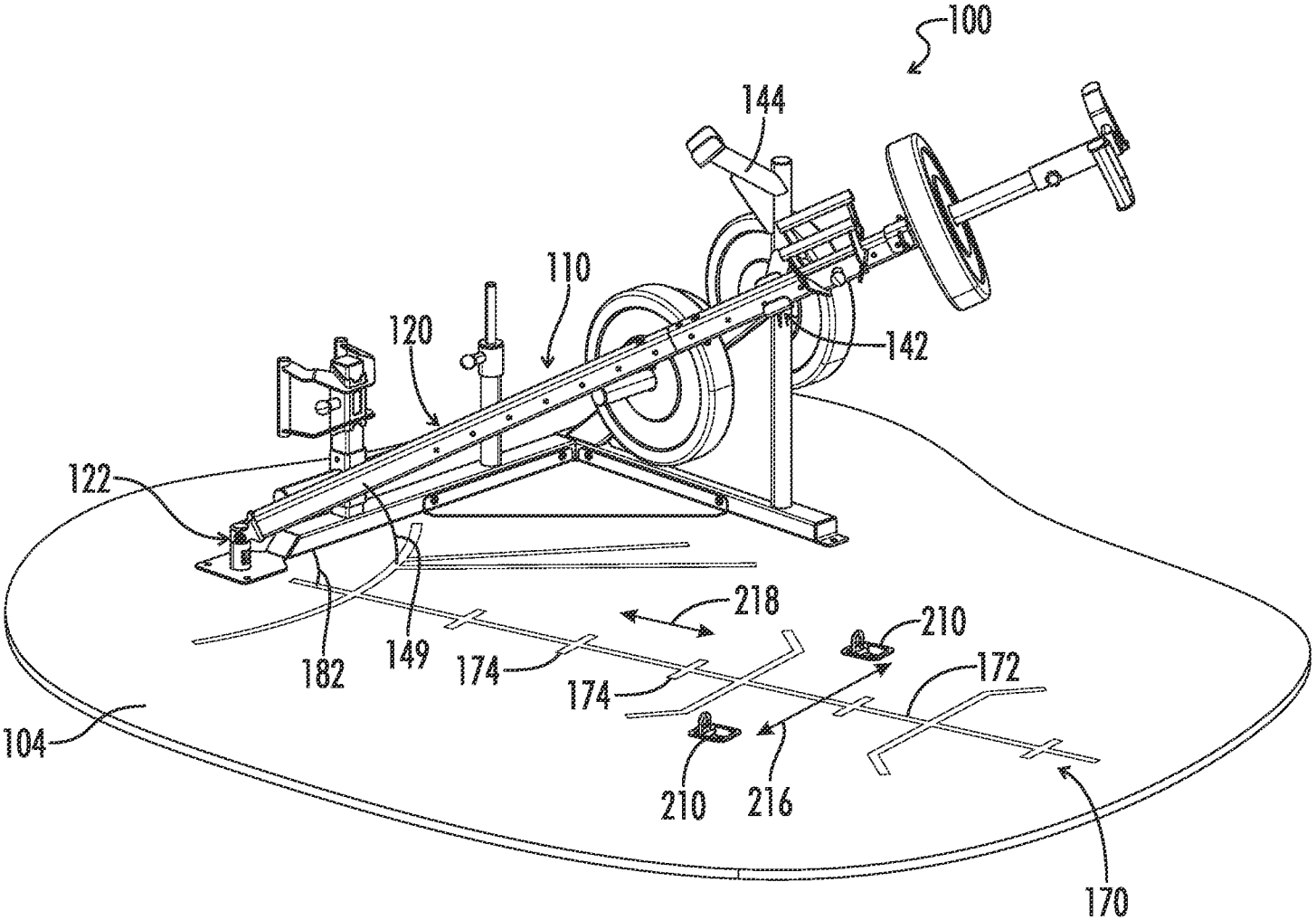
FIG. 9 is a front left top perspective view of the training system of FIG. 1 with a workout bar resting on a low dock bracket of the training apparatus in accordance with the present disclosure.
Figure 10:
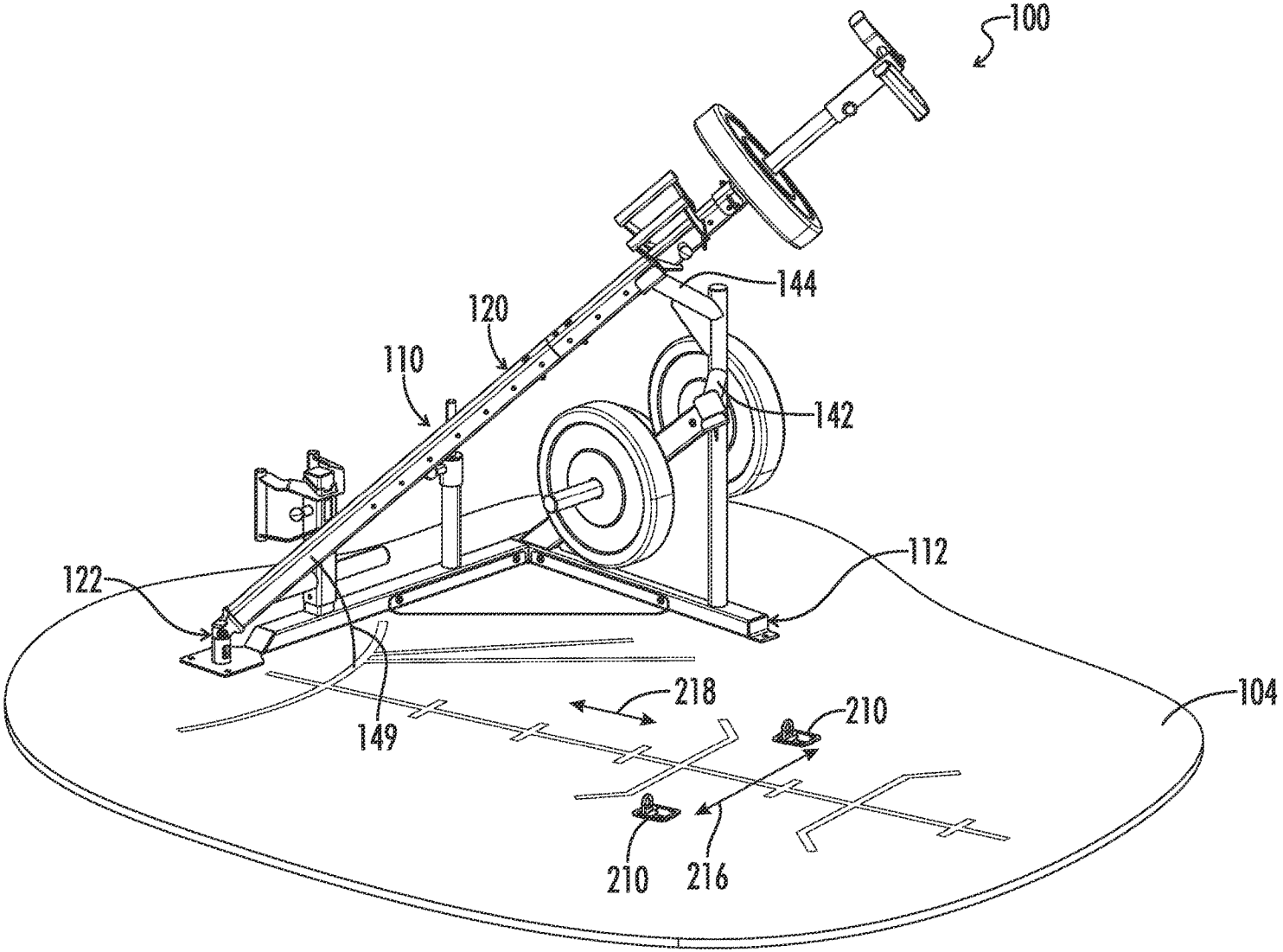
FIG. 10 is a front left top perspective view of the training system of FIG. 1 with a workout bar resting on a high dock bracket of the training apparatus in accordance with the present disclosure.
Figure 11:
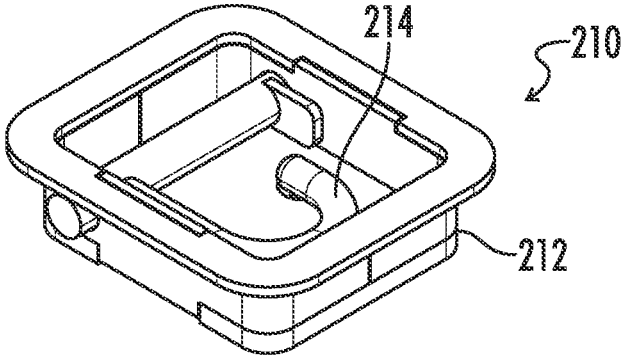
FIG. 11 is a front left top perspective view of a first embodiment of a floor anchor of the training system of FIG. 1 with a hook in a retracted position in accordance with the present disclosure.
Figure 12A:
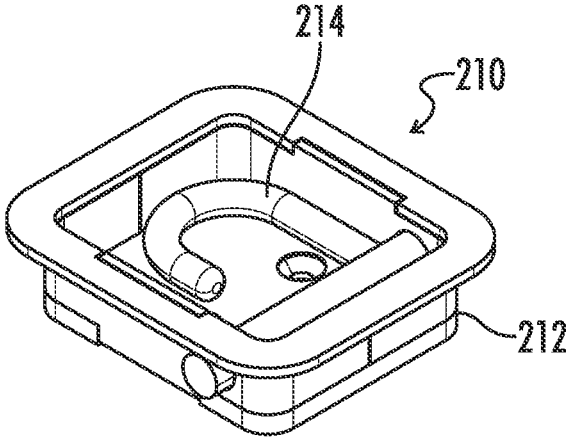
FIG. 12A is a back right top perspective view of the floor anchor of FIG. 11 in accordance with the present disclosure.
Figure 12B:
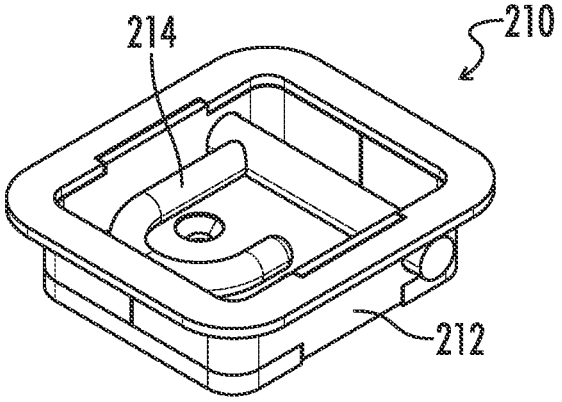
FIG. 12B is a front right top perspective view of the floor anchor of FIG. 11 in accordance with the present disclosure.
Figure 13:
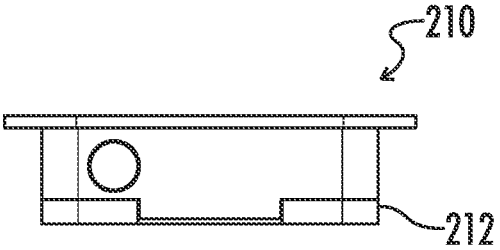
FIG. 13 is a left side elevation view of the floor anchor of FIG. 11, the right side elevation view being an identical mirror image thereto in accordance with the present disclosure.
Figure 15:
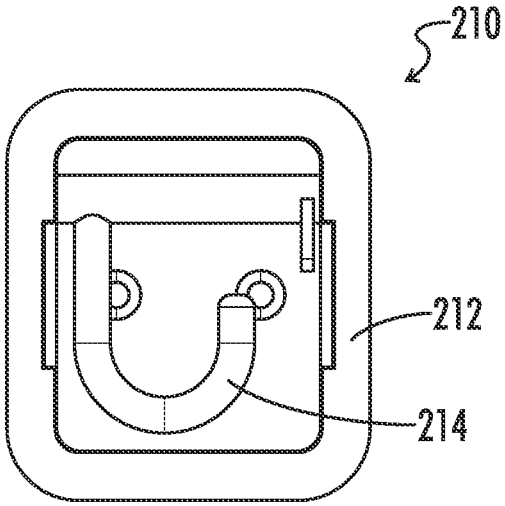
FIG. 15 is a top plan view of the floor anchor of FIG. 11 in accordance with the present disclosure.
Figure 14:
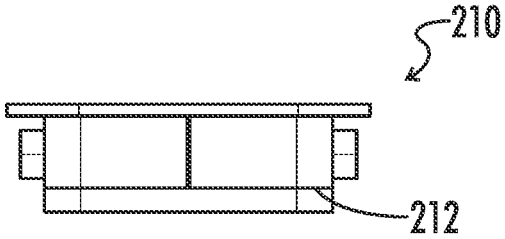
FIG. 14 is a front elevation view of the floor anchor of FIG. 11, the rear elevation view being an identical mirror image thereto in accordance with the present disclosure.
Figure 16:
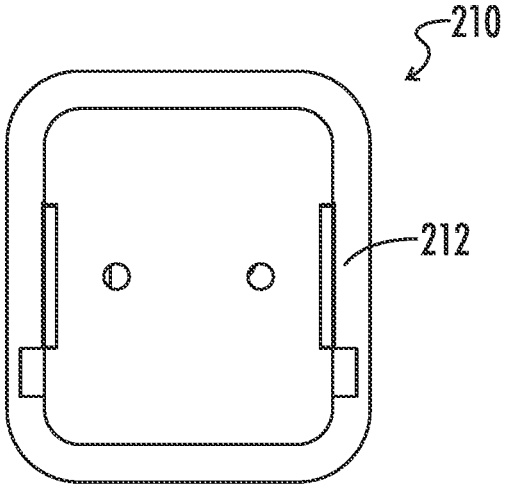
FIG. 16 is a bottom plan view of the floor anchor of FIG. 11 in accordance with the present disclosure.
Figure 17:
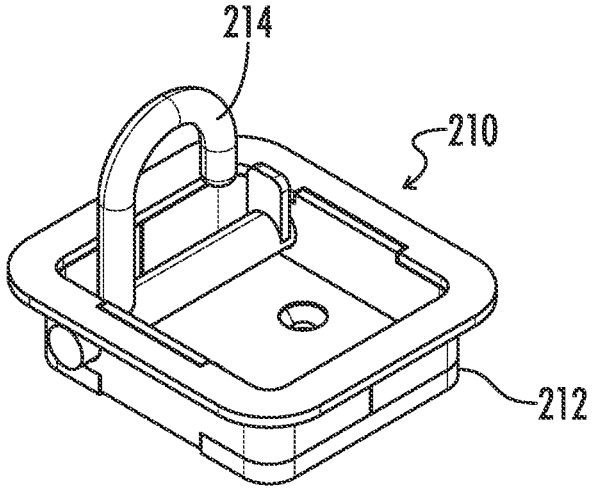
FIG. 17 is a front left top perspective view of the floor anchor of FIG. 11 with the hook in an extended position in accordance with the present disclosure.
Figure 18A:
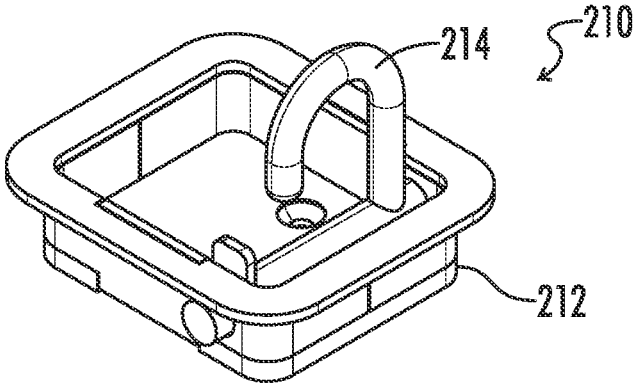
FIG. 18A is a back right top perspective view of the floor anchor of FIG. 17 in accordance with the present disclosure.
Figure 18B:
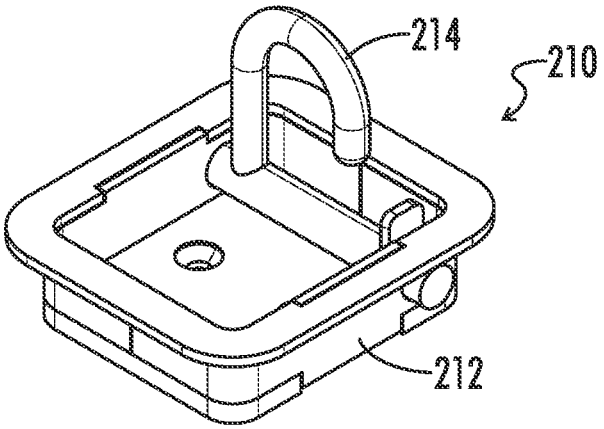
FIG. 18B is a front right top perspective view of the floor anchor of FIG. 17 in accordance with the present disclosure.
Figure 18F:
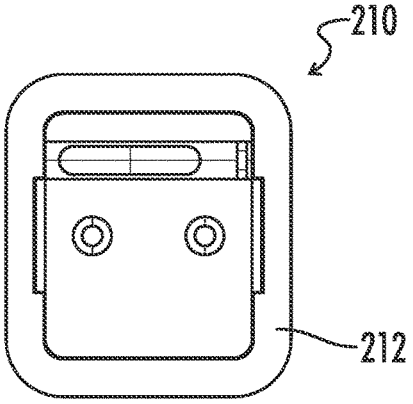
FIG. 18F is a top plan view of the floor anchor of FIG. 17 in accordance with the present disclosure.
Figure 18D:
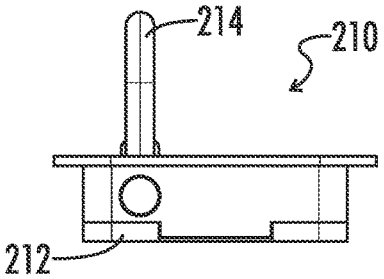
FIG. 18D is a left side elevation view of the floor anchor of FIG. 17 in accordance with the present disclosure.
Figure 18C:
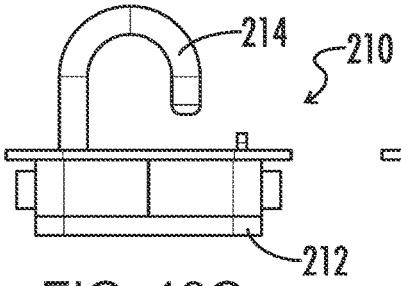
FIG. 18C is a front elevation view of the floor anchor of FIG. 17 in accordance with the present disclosure.
Figure 18E:
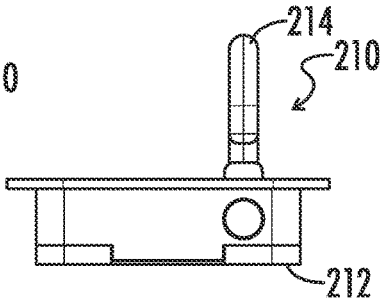
FIG. 18E is a right side elevation view of the floor anchor of FIG. 17 in accordance with the present disclosure.
Figure 18G:
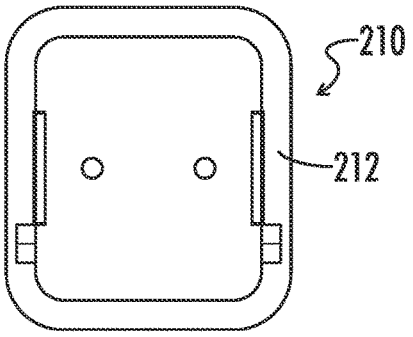
FIG. 18G is a bottom plan view of the floor anchor of FIG. 17 in accordance with the present disclosure.
Figure 19:
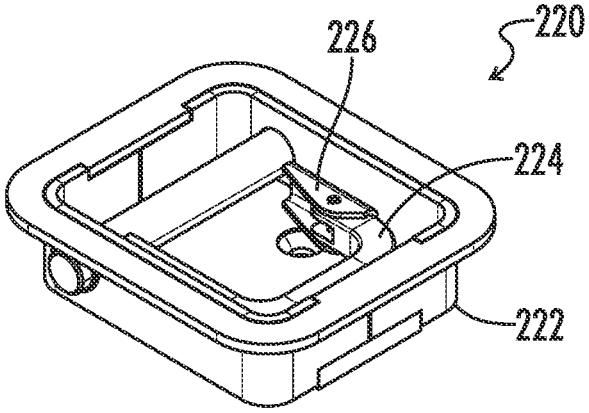
FIG. 19 is a front left top perspective view of a second embodiment of a floor anchor of the training system with a hook in a retracted position in accordance with the present disclosure.
Figure 20A:
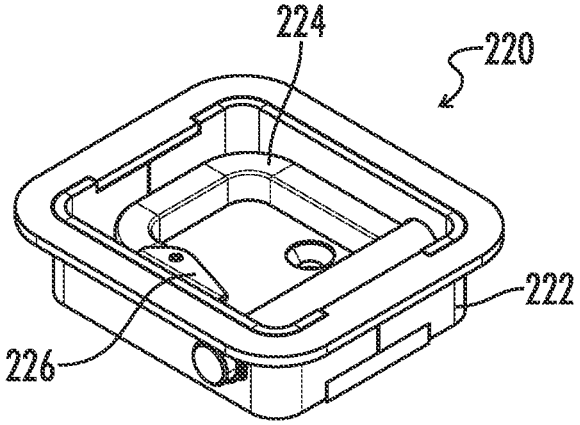
FIG. 20A is a back right top perspective view of the floor anchor of FIG. 19 in accordance with the present disclosure.
Figure 20B:
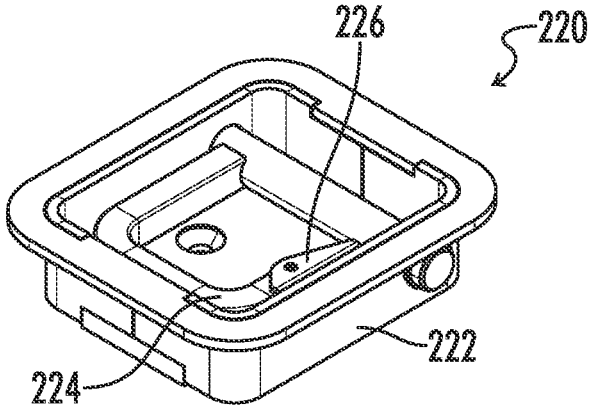
FIG. 20B is a front right top perspective view of the floor anchor of FIG. 19 in accordance with the present disclosure.
Figure 21:
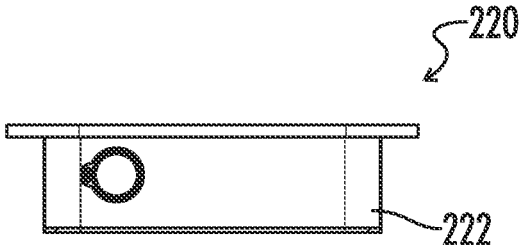
FIG. 21 is a left side elevation view of the floor anchor of FIG. 19, the right side elevation view being an identical mirror image thereto in accordance with the present disclosure.
Figure 23:
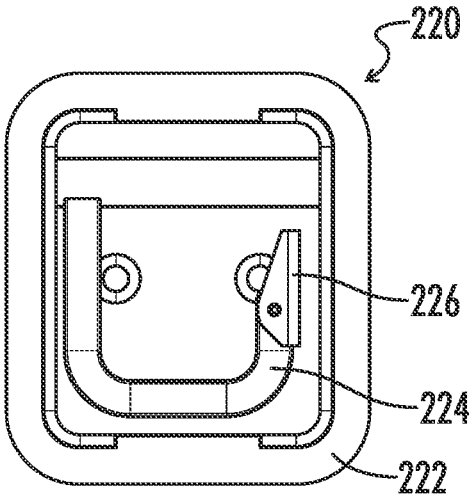
FIG. 23 is a top plan view of the floor anchor of FIG. 19 in accordance with the present disclosure.
Figure 22:
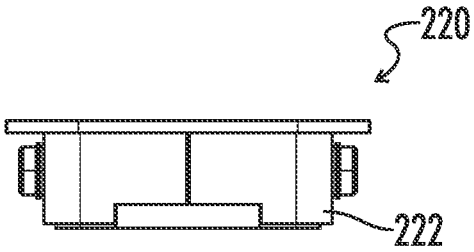
FIG. 22 is a front elevation view of the floor anchor of FIG. 19, the rear elevation view being an identical mirror image thereto in accordance with the present disclosure.
Figure 24:
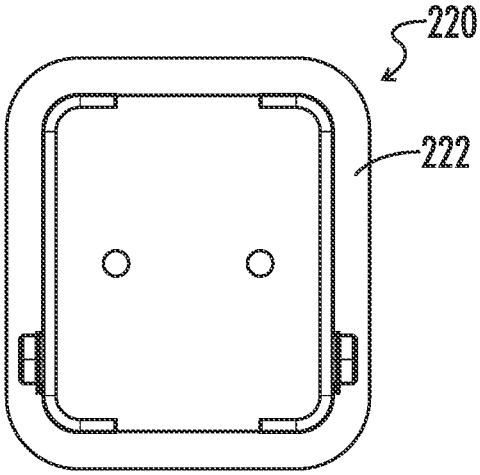
FIG. 24 is a bottom plan view of the floor anchor of FIG. 19 in accordance with the present disclosure.

The training system 100 may further include at least one resistance band and at least one floor anchor. As illustrated, the training system 100 includes a pair of resistance bands 190 and a pair of floor anchors 210. The pair of floor anchors 210 may also be referred to as a pair of band anchors. The pair of resistance bands 190 may be coupled between the workout bar 120 and respective floor anchors of the pair of floor anchors 210. Each resistance band of the pair of resistance bands 190 may be coupled to one hook of a pair of hooks 192 of the workout bar 120 which extending from opposite sides of the workout bar 120. Alternatively, and as can best be seen in FIG. 45, the pair of hooks 192 may be part of a hook bracket 194 which may be coupled to and removed from the workout bar 120, more specifically the rectangular intermediate portion 123, when needed for interfacing with the pair of resistance bands 190. The hook bracket 194 may also be referred to herein as an attachment member or a band engagement attachment. The hook bracket 194 may be coupled to the first vertical post 130 for storage when not in use. The pair of resistance bands 190 may be used to change a weight or resistance of the workout bar 120 for added difficulties or different training exercises using the training system 100. As can best be seen in FIGS. 1 and 2, the pair of floor anchors may be flush mount floor anchors inset into the ground surface 104 such that they present little to no tripping hazard when the training system 100 is not in use. As can best be seen in FIGS. 11-18G, each floor anchor of the pair of floor anchors 210 may include a housing 212 and a retractable hook 214 positioned in and coupled to the housing 212. As can best be seen in FIGS. 11-16, the retractable hook 214 may be configured in a retracted position when not in use so as to not trip or be a hazard to anyone walking around the space in which the training system 100 is installed. As can best be seen in FIGS. 17 and 18G, the retractable hook 214 may be configured in an extended position when in use and coupled to one of the pair of resistance bands 190. The pair of floor anchors 210 when flush mounted may be best suited for platform floors or rubber floors like those installed in many gyms over existing floors, such as concrete floors. As shown in FIGS. 7, 9, and 10, the pair of floor anchors 210 may be spaced apart from each other in a first direction 216 and may be spaced apart from the landmine bracket 122 in a second direction 218 perpendicular to the first direction 216.

Figure 25:
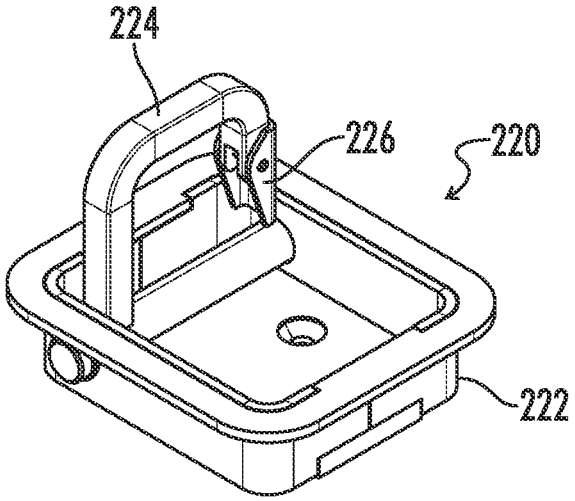
FIG. 25 is a front left top perspective view of the floor anchor of FIG. 19 with the hook in an extended position in accordance with the present disclosure.
Figure 26A:
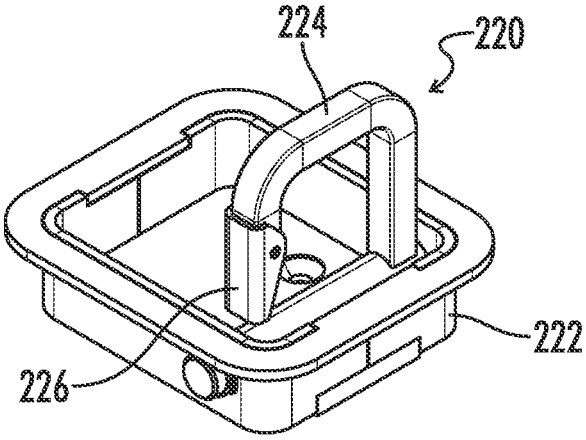
FIG. 26A is a back right top perspective view of the floor anchor of FIG. 25 in accordance with the present disclosure.
Figure 26B:
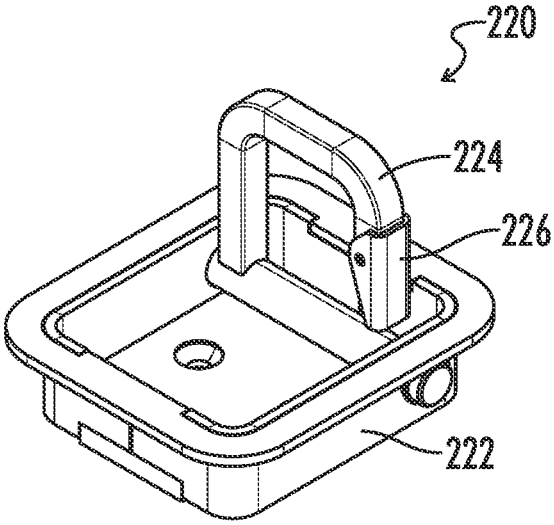
FIG. 26B is a front right top perspective view of the floor anchor of FIG. 25 in accordance with the present disclosure.
Figure 26F:
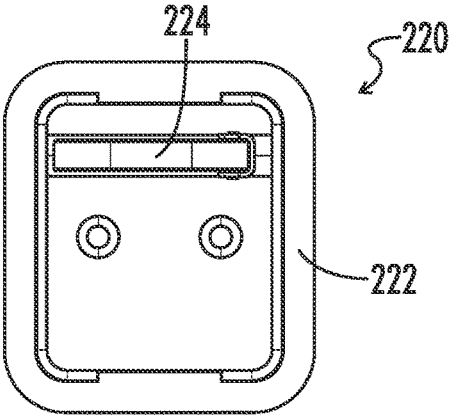
FIG. 26F is a top plan view of the floor anchor of FIG. 25 in accordance with the present disclosure.
Figure 26D:
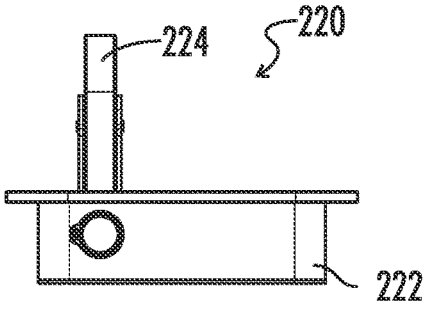
FIG. 26D is a left side elevation view of the floor anchor of FIG. 25 in accordance with the present disclosure.
Figure 26C:
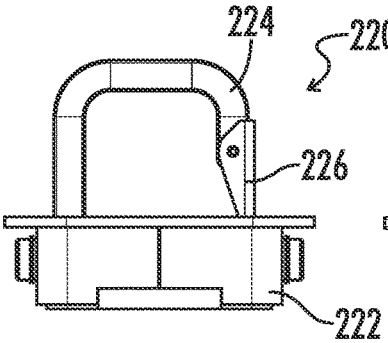
FIG. 26C is a front elevation view of the floor anchor of FIG. 25 in accordance with the present disclosure.
Figure 26E:
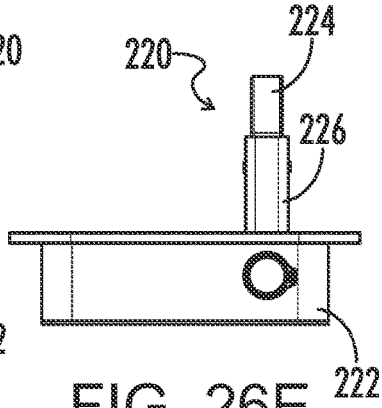
FIG. 26E is a right side elevation view of the floor anchor of FIG. 25 in accordance with the present disclosure.
Figure 26G:
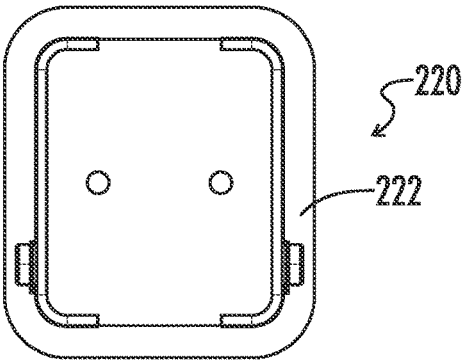
FIG. 26G is a bottom plan view of the floor anchor of FIG. 25 in accordance with the present disclosure.
Figure 27:
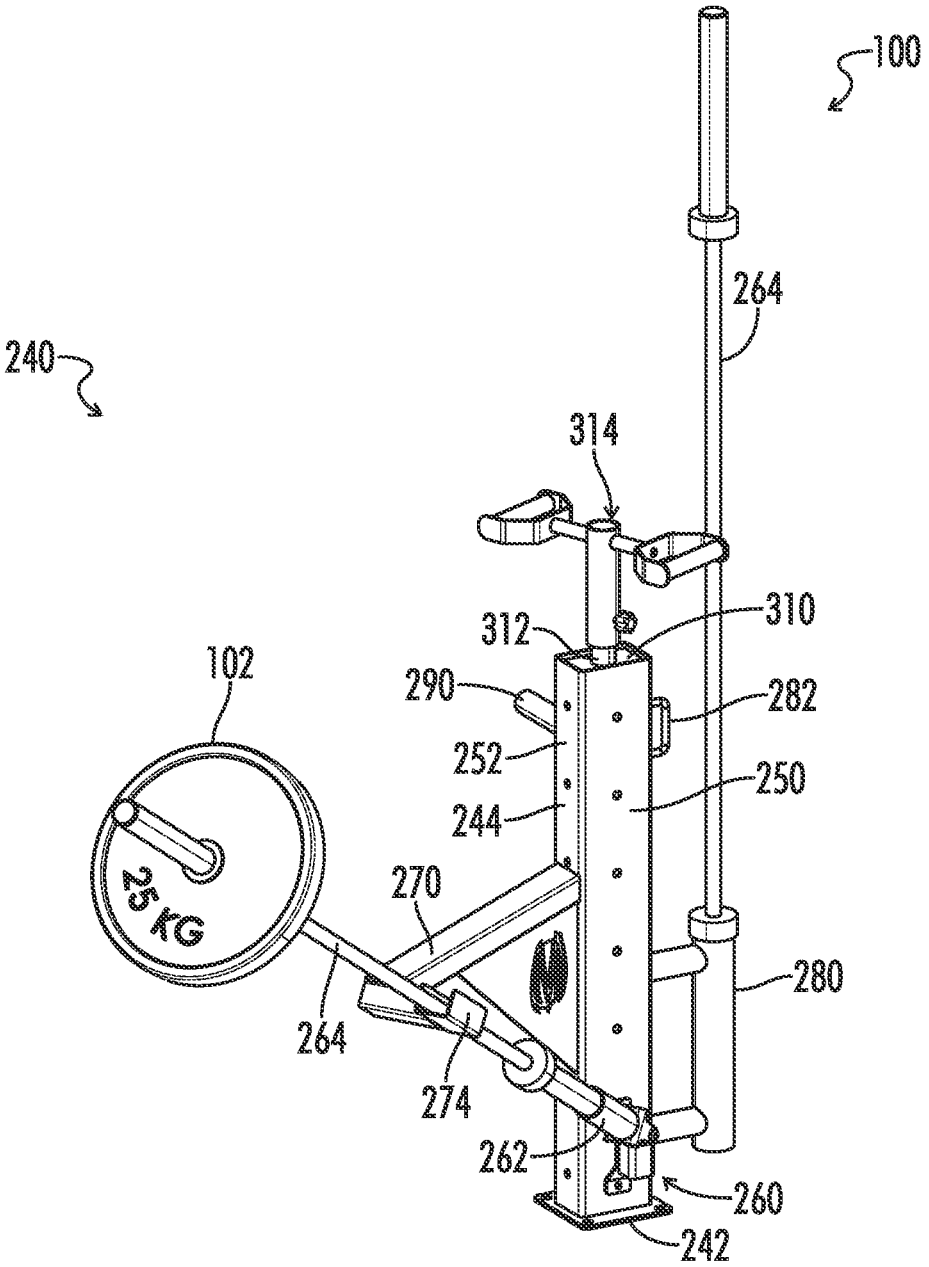
FIG. 27 is a front left top perspective view of a second embodiment of a training apparatus of the training system with a workout bar resting on a dock bracket in accordance with the present disclosure.
Figure 28A:
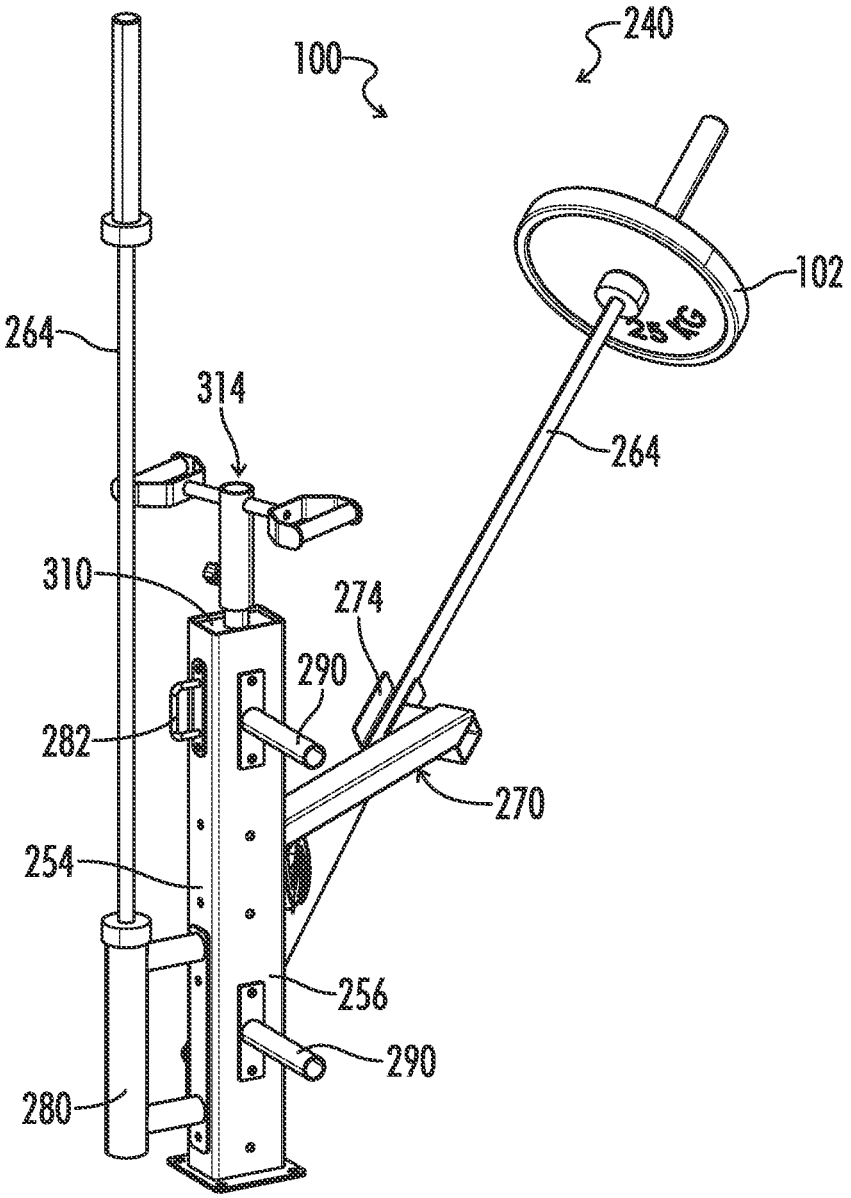
FIG. 28A is a back right top perspective view of the ground trainer apparatus of FIG. 27 in accordance with the present disclosure.
Figure 28B:
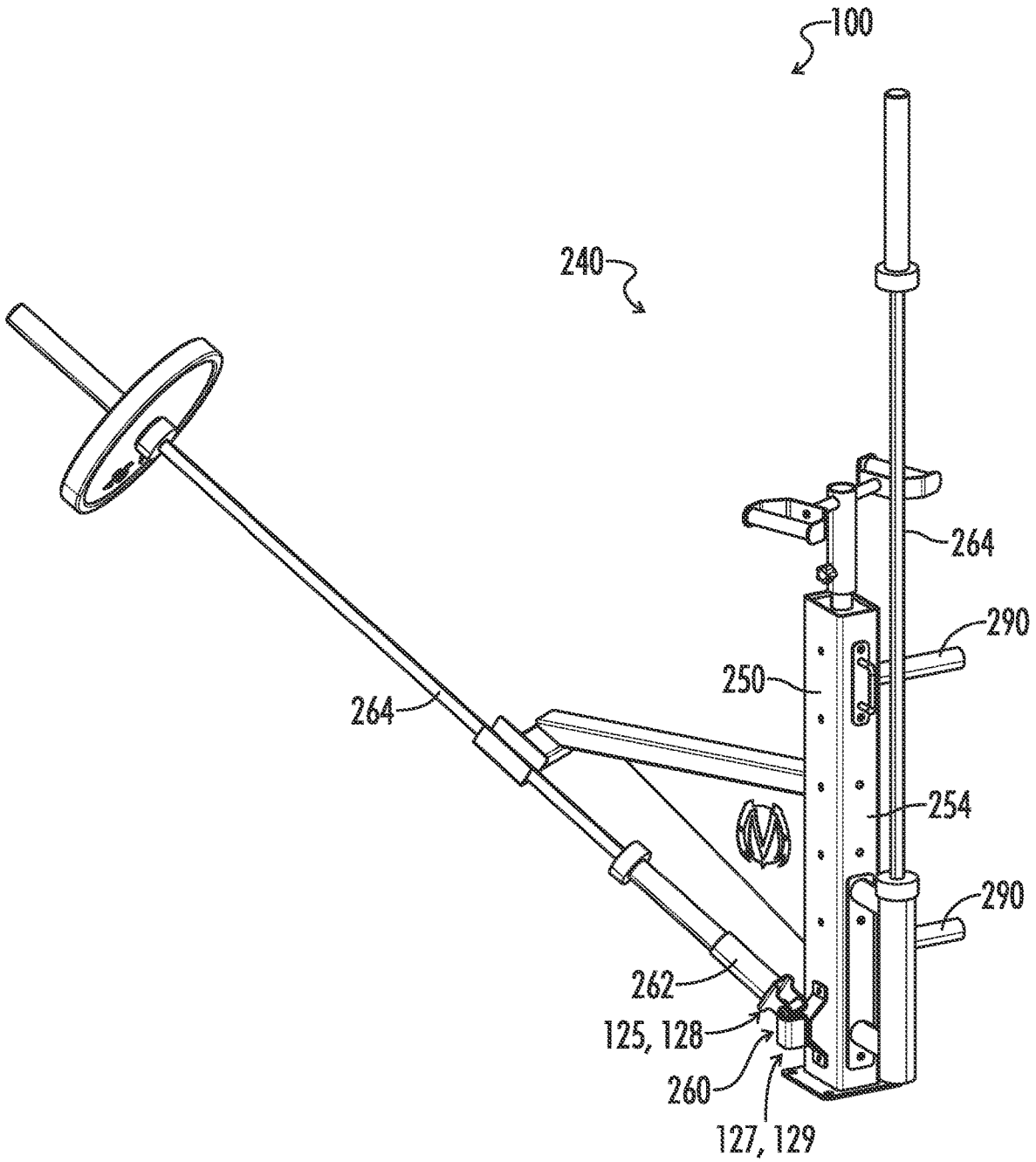
FIG. 28B is a front right top perspective view of the ground trainer apparatus of FIG. 27 in accordance with the present disclosure.
Figure 29:
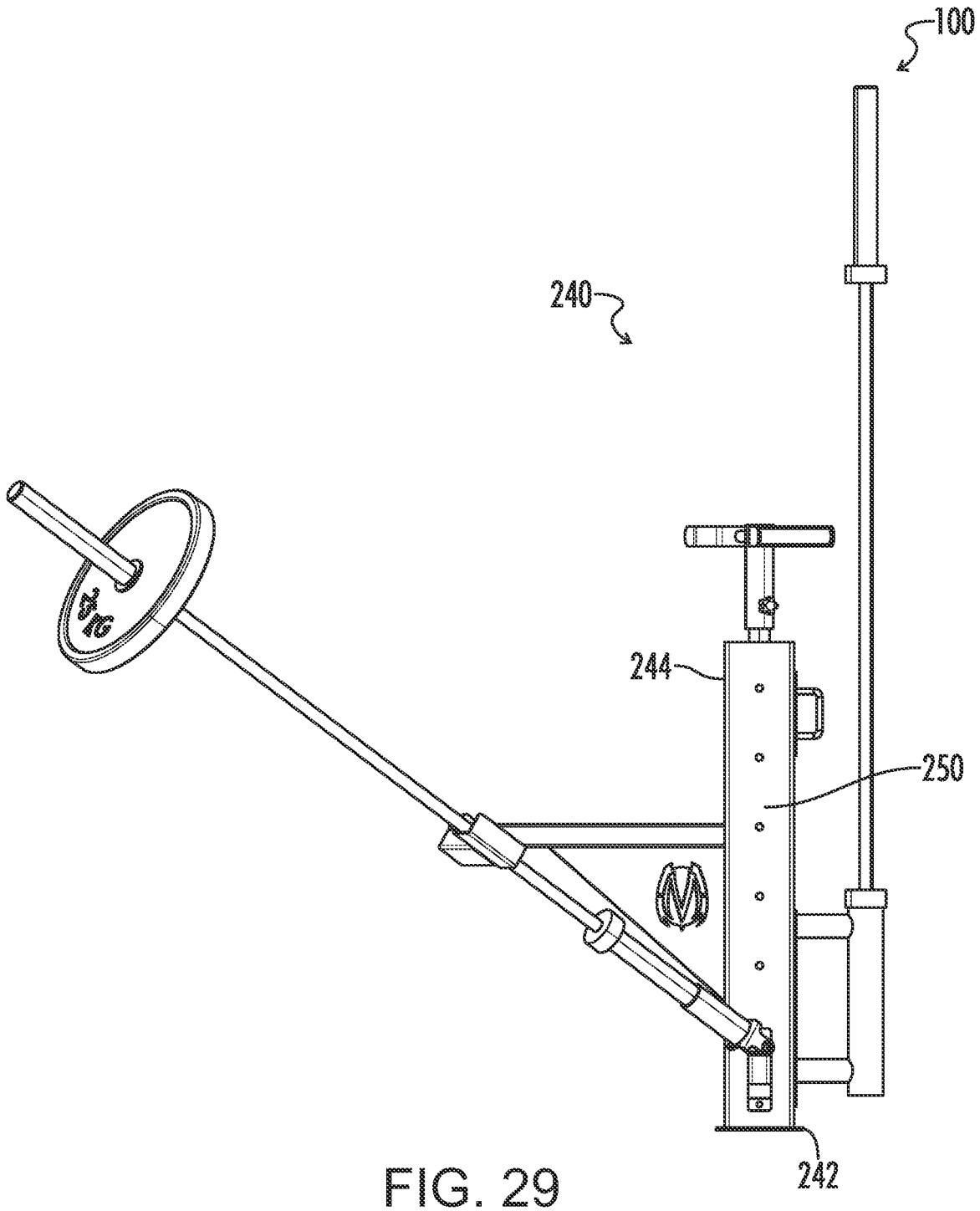
FIG. 29 is a front elevation view of the training apparatus training apparatus of FIG. 27 in accordance with the present disclosure.
Figure 30:
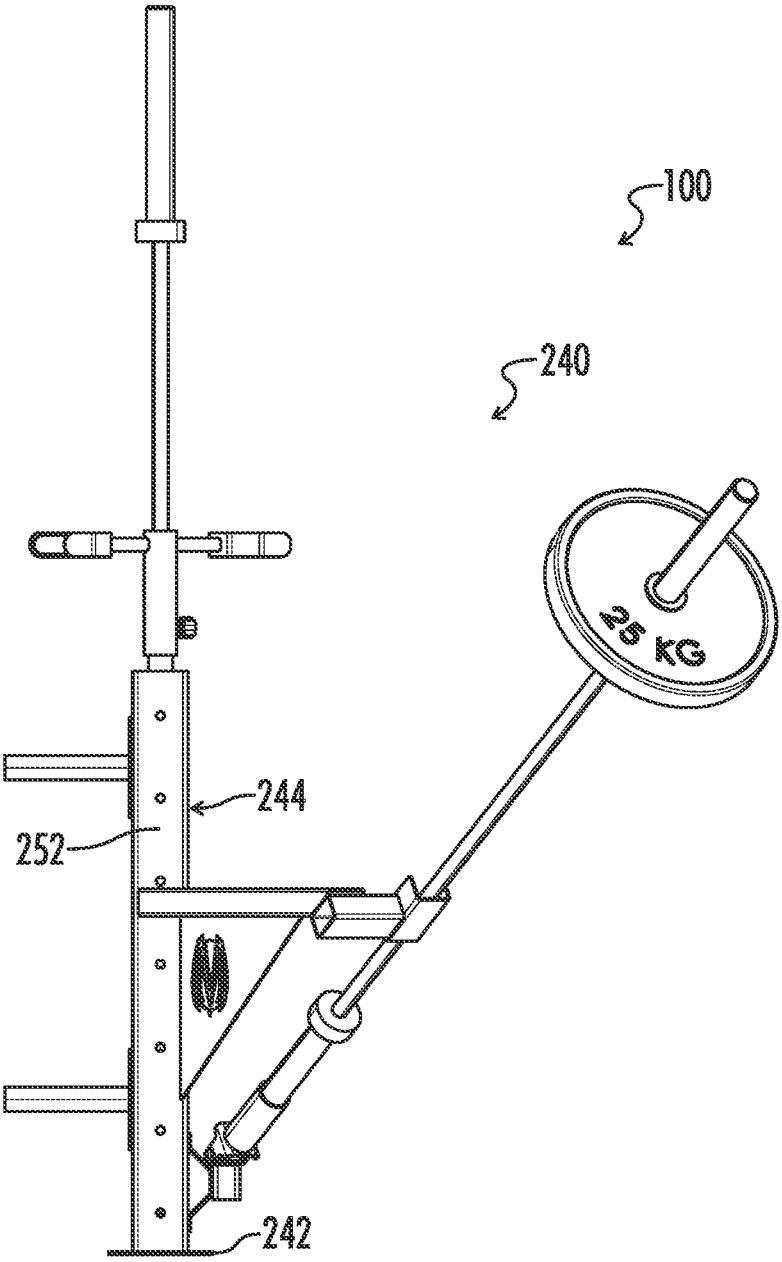
FIG. 30 is a left elevation view of the training apparatus of FIG. 27 in accordance with the present disclosure.
Figure 31:
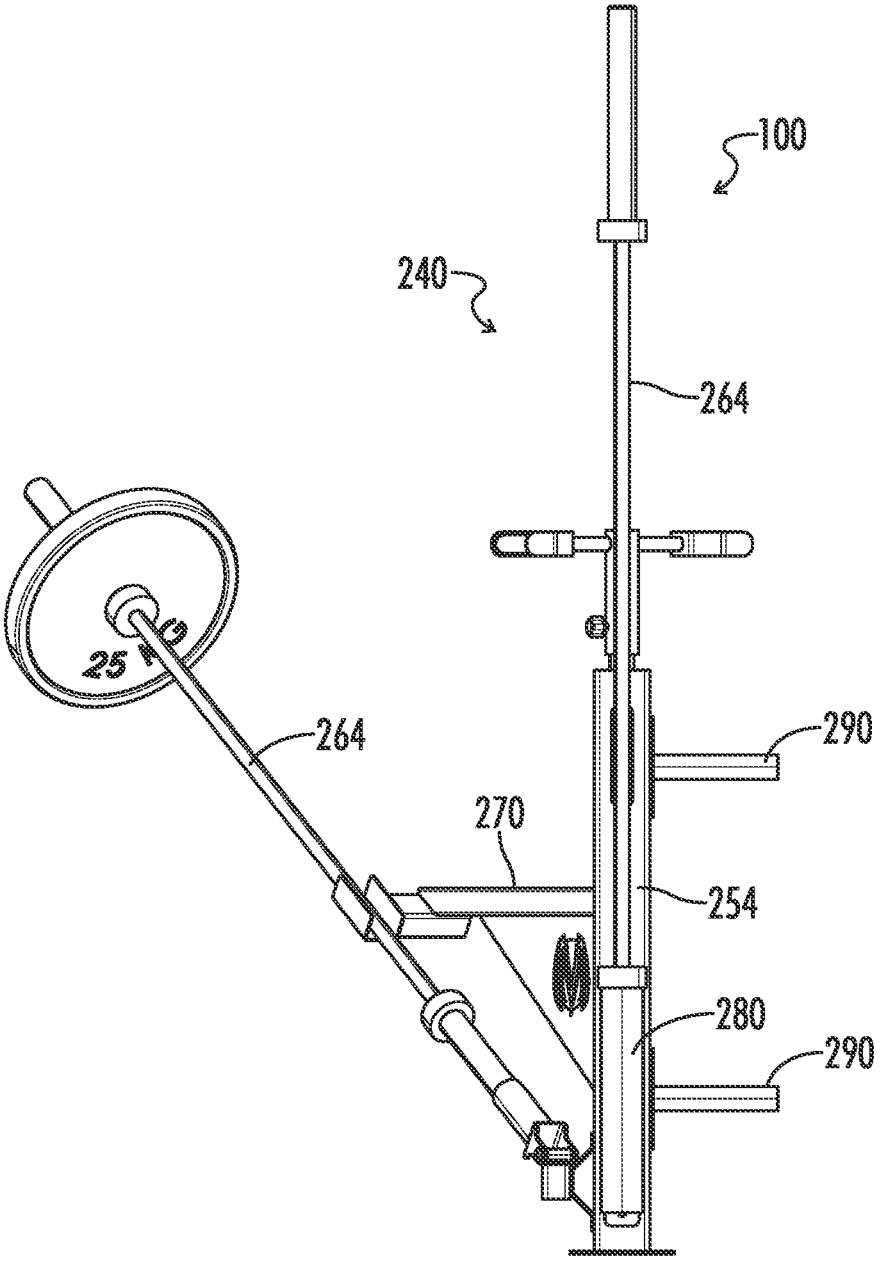
FIG. 31 is a right elevation view of the training apparatus of FIG. 27 in accordance with the present disclosure.
Figure 32:
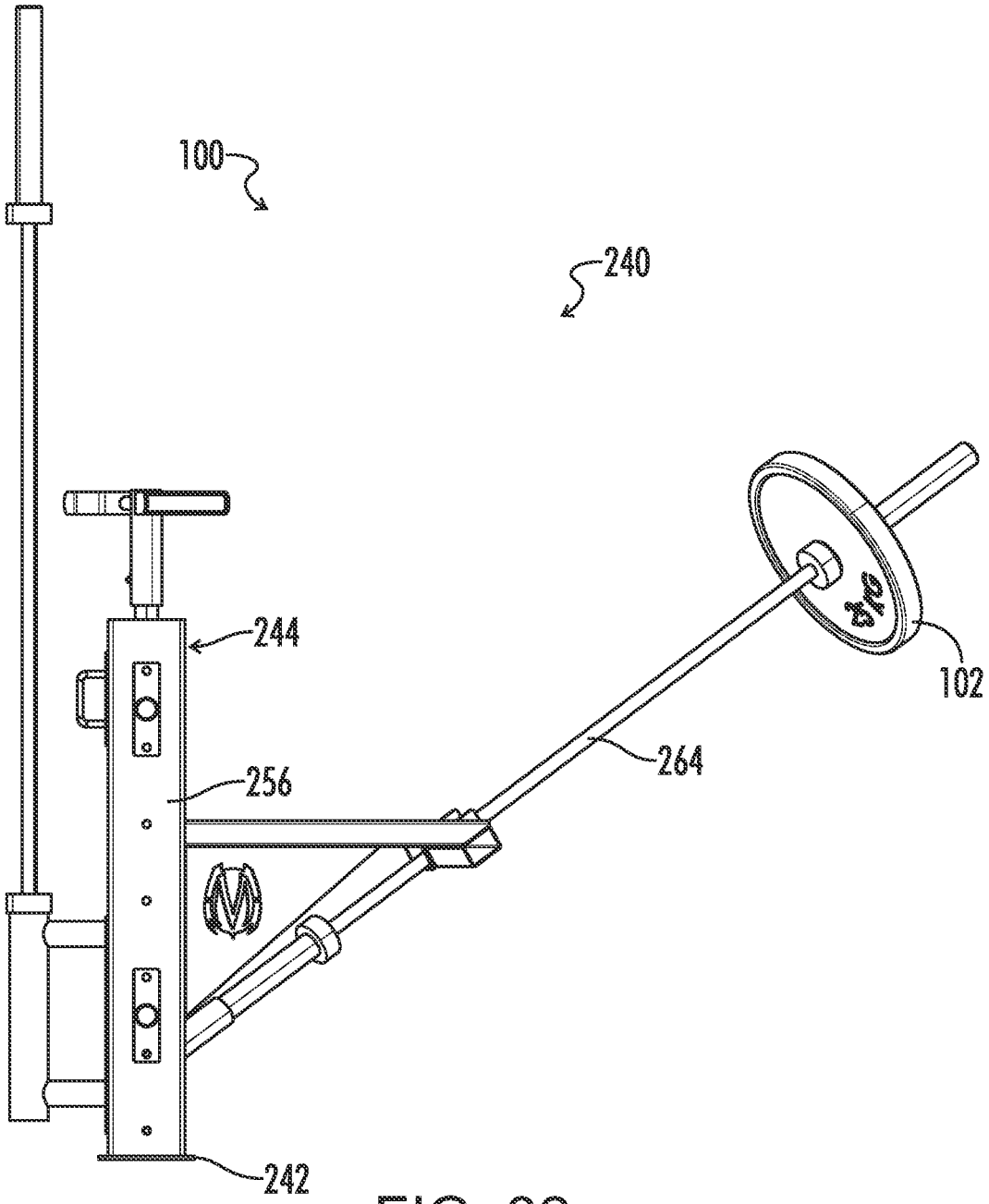
FIG. 32 is a back elevation view of the training apparatus of FIG. 27 in accordance with the present disclosure.
Figure 33:
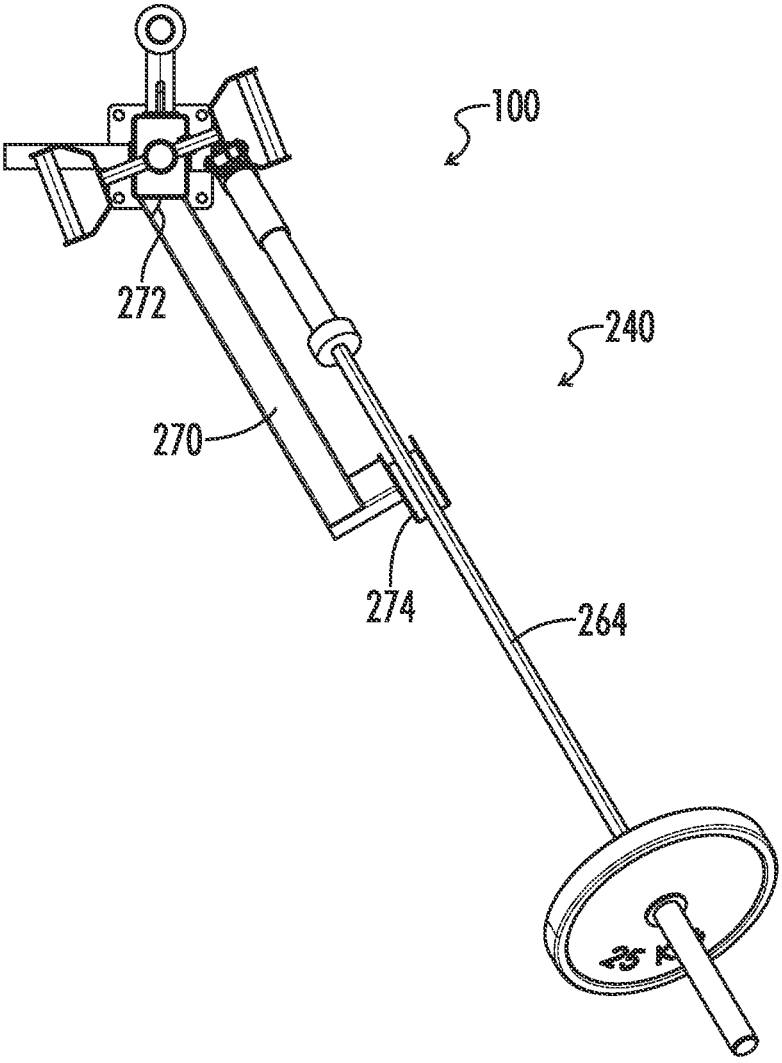
FIG. 33 is a top plan view of the training apparatus of FIG. 27 in accordance with the present disclosure.
Figure 34:
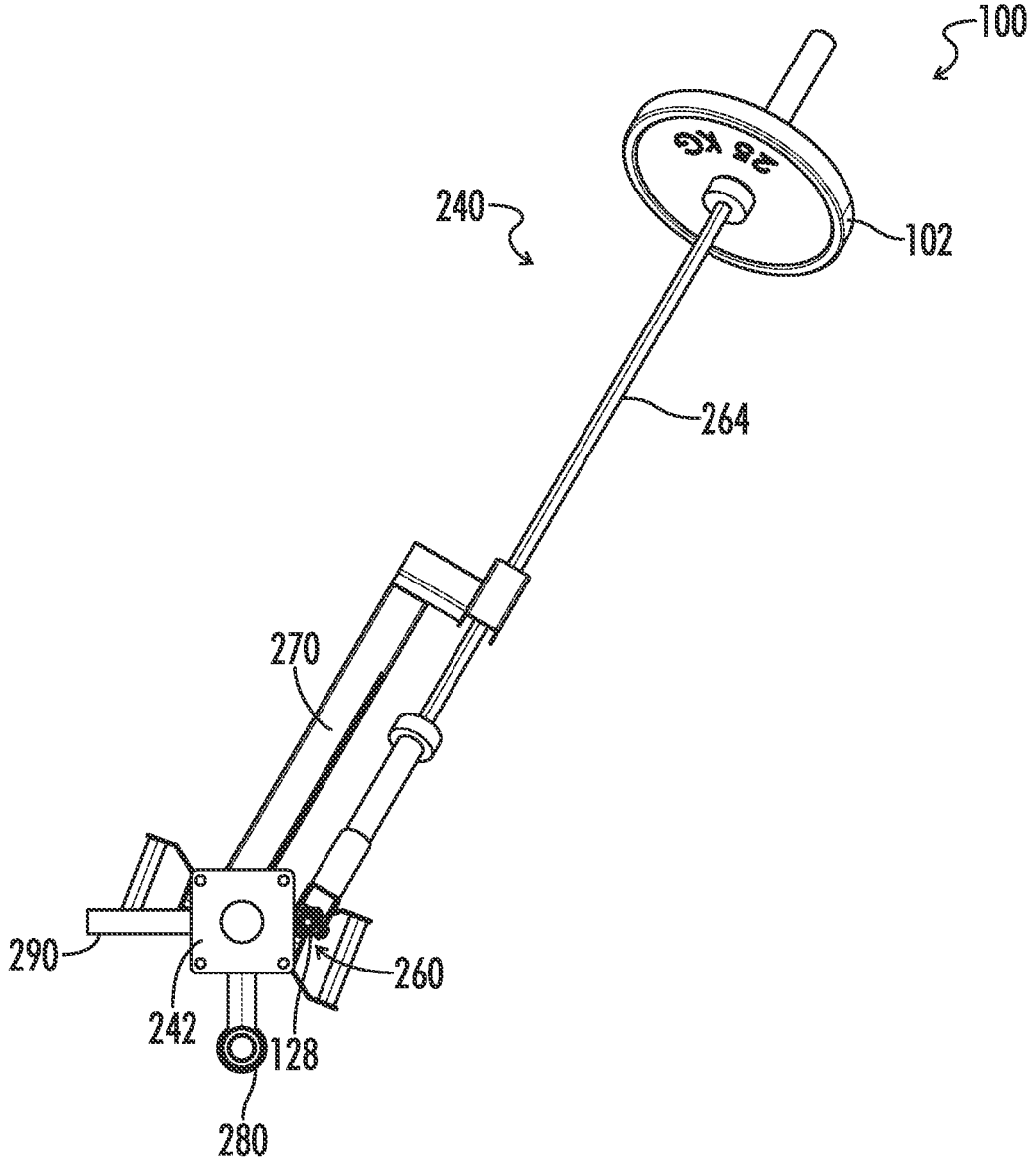
FIG. 34 is a bottom plan view of the training apparatus of FIG. 27 in accordance with the present disclosure.
Figure 35:
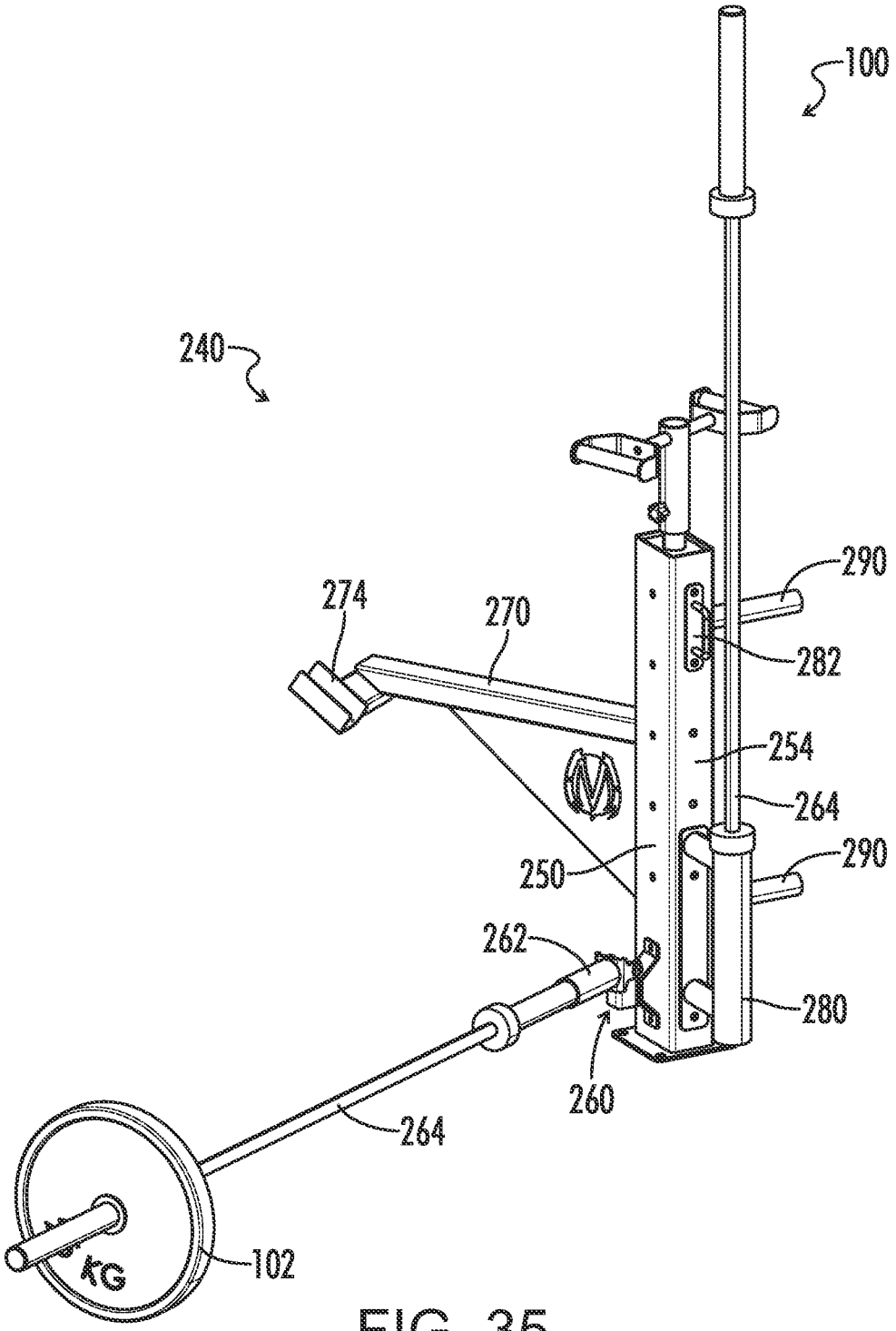
FIG. 35 is a front right top perspective view of the training apparatus of FIG. 27 with a workout bar resting on a ground surface in accordance with the present disclosure.
Figure 36:
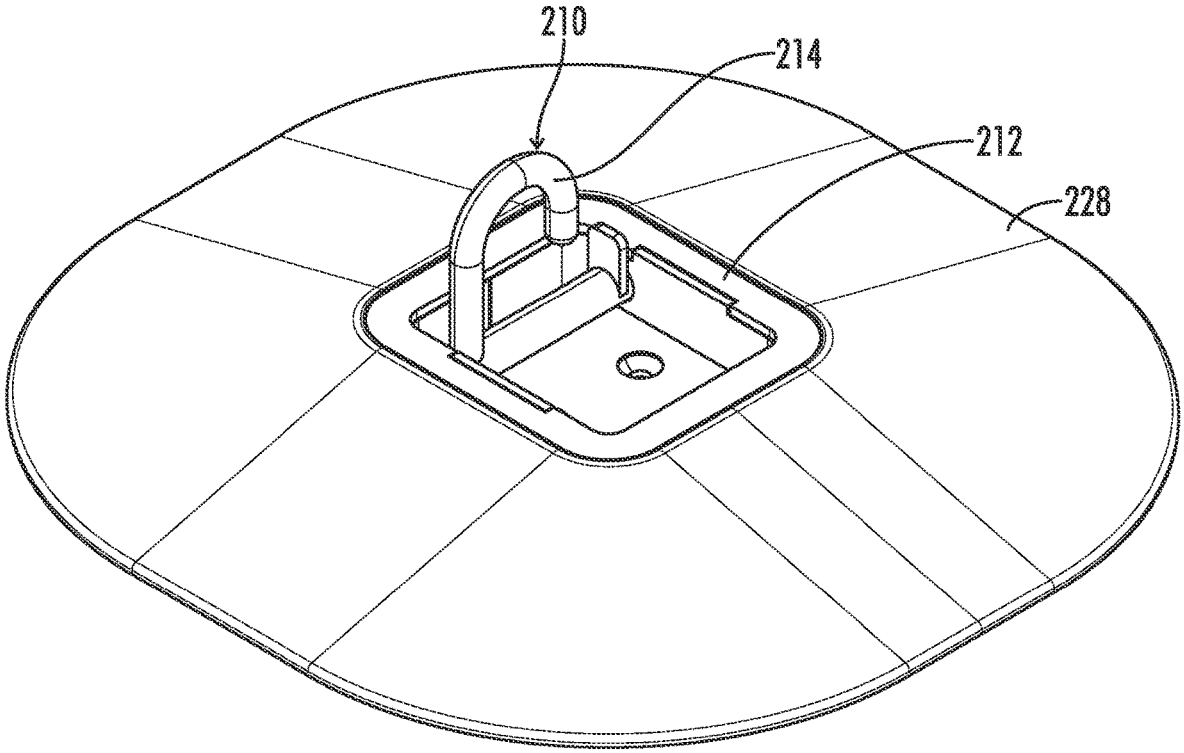
FIG. 36 is a front left top perspective view of the floor anchor of FIG. 11 positioned in a transition surround for surface mounting of the floor anchor in accordance with the present disclosure.
Figure 37:
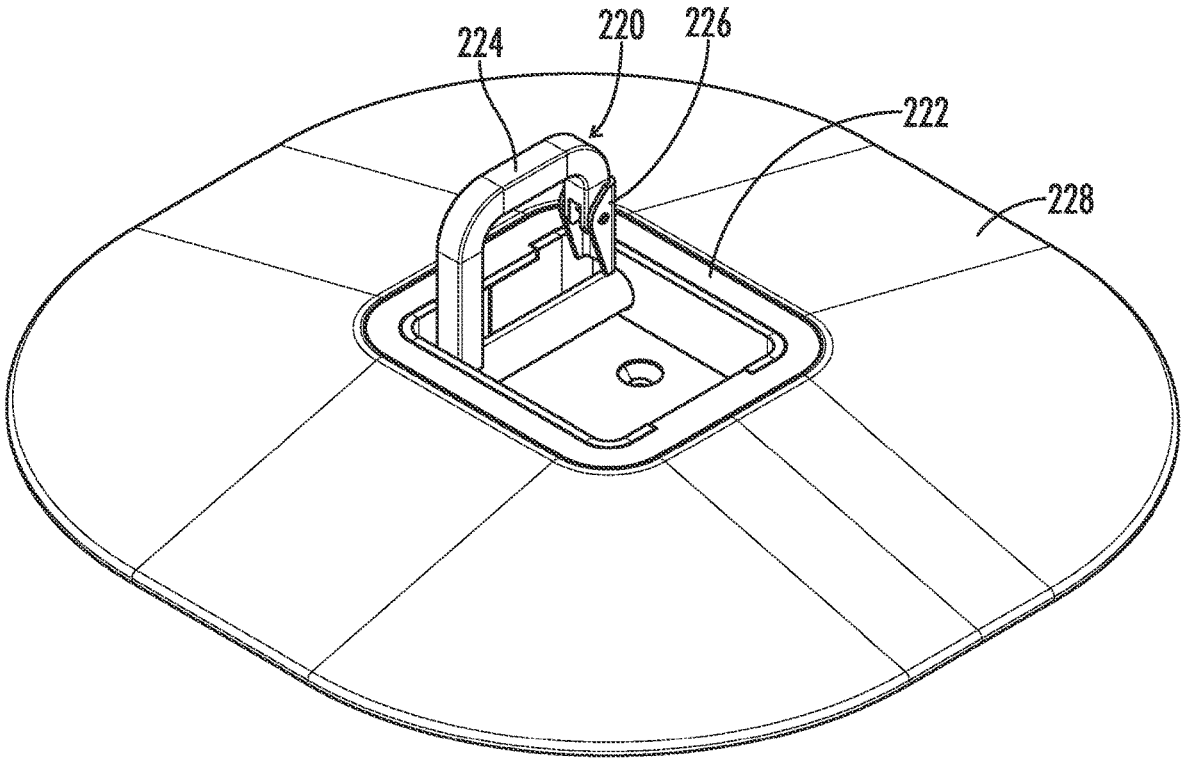
FIG. 37 is a front left top perspective view of the floor anchor of FIG. 11 positioned in the transition surround of FIG. 36 in accordance with the present disclosure.
Figure 38:
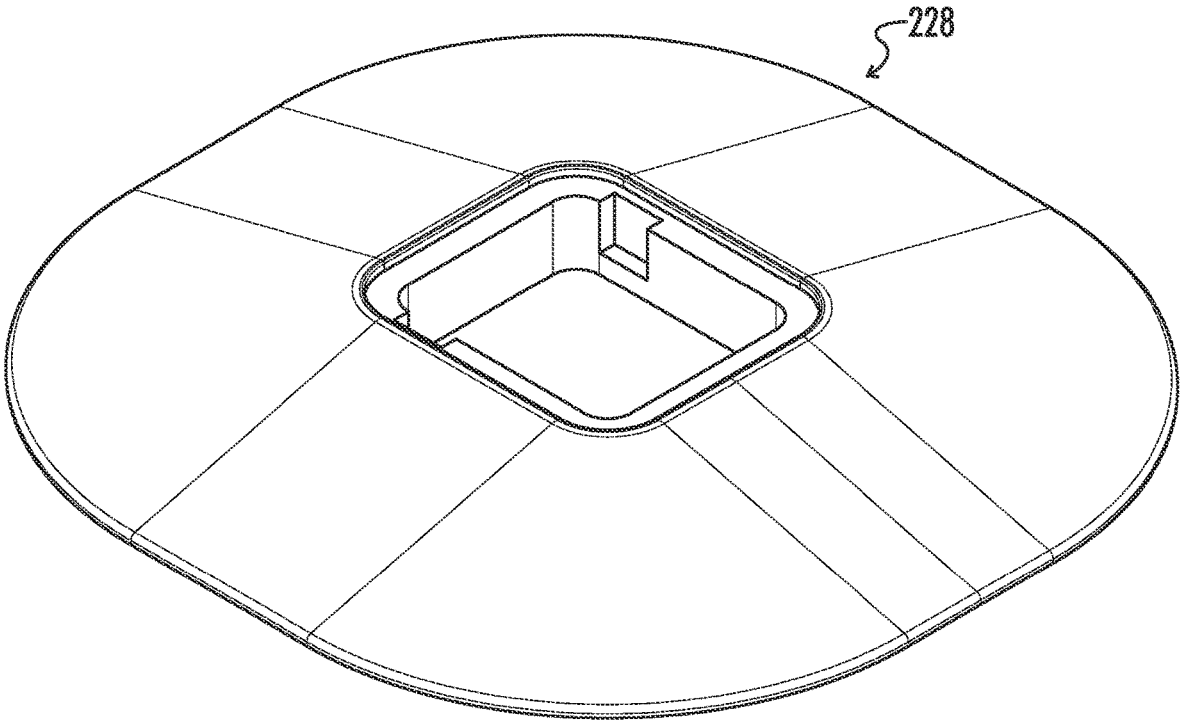
FIG. 38 is a front left top perspective view of the transition surround of FIG. 36 in accordance with the present disclosure.
Figure 39:
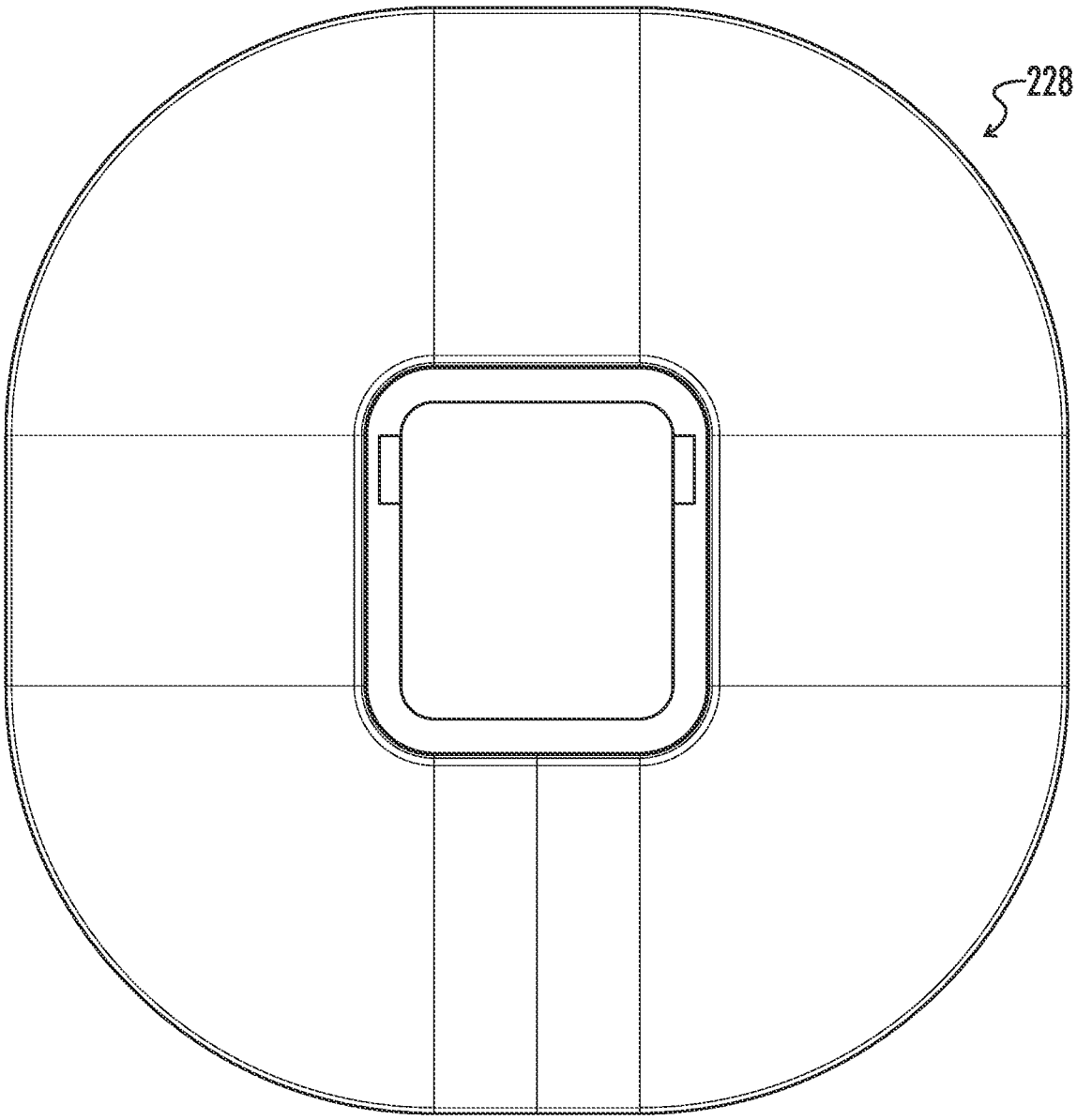
FIG. 39 is a top plan view of the transition surround of FIG. 36 in accordance with the present disclosure.
Figure 40A:
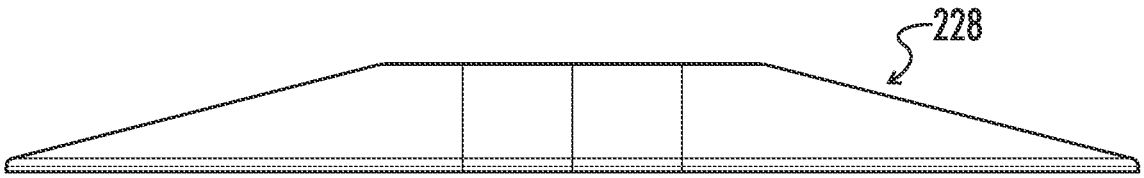
FIG. 40A is a front elevation view of the transition surround of FIG. 36, the rear elevation view being an identical mirror image thereto in accordance with the present disclosure.
Figure 40B:
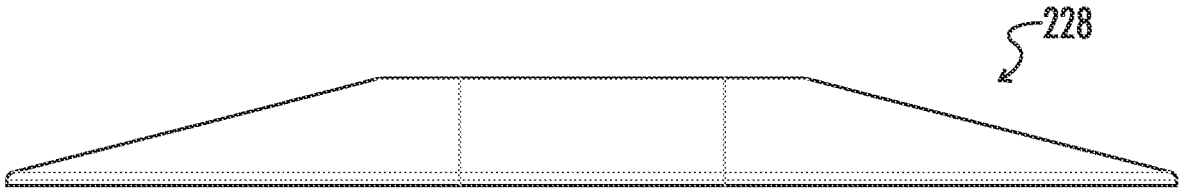
FIG. 40B is a left side elevation view of the transition surround of FIG. 36, the right side elevation view being an identical mirror image thereto in accordance with the present disclosure.
Figure 40C:
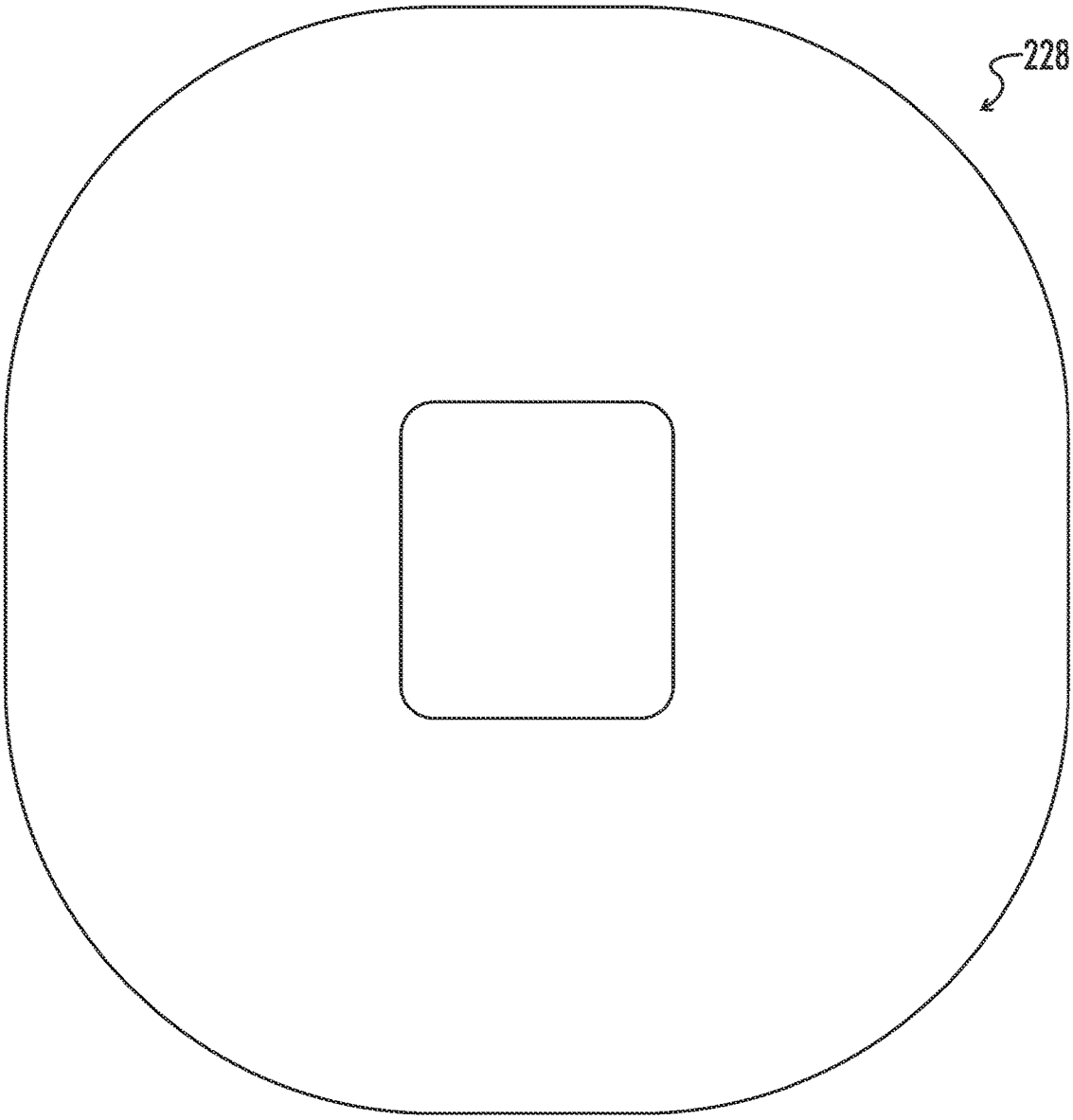
FIG. 40C is a bottom plan view of the transition surround of FIG. 36 in accordance with the present disclosure.
Figure 41:
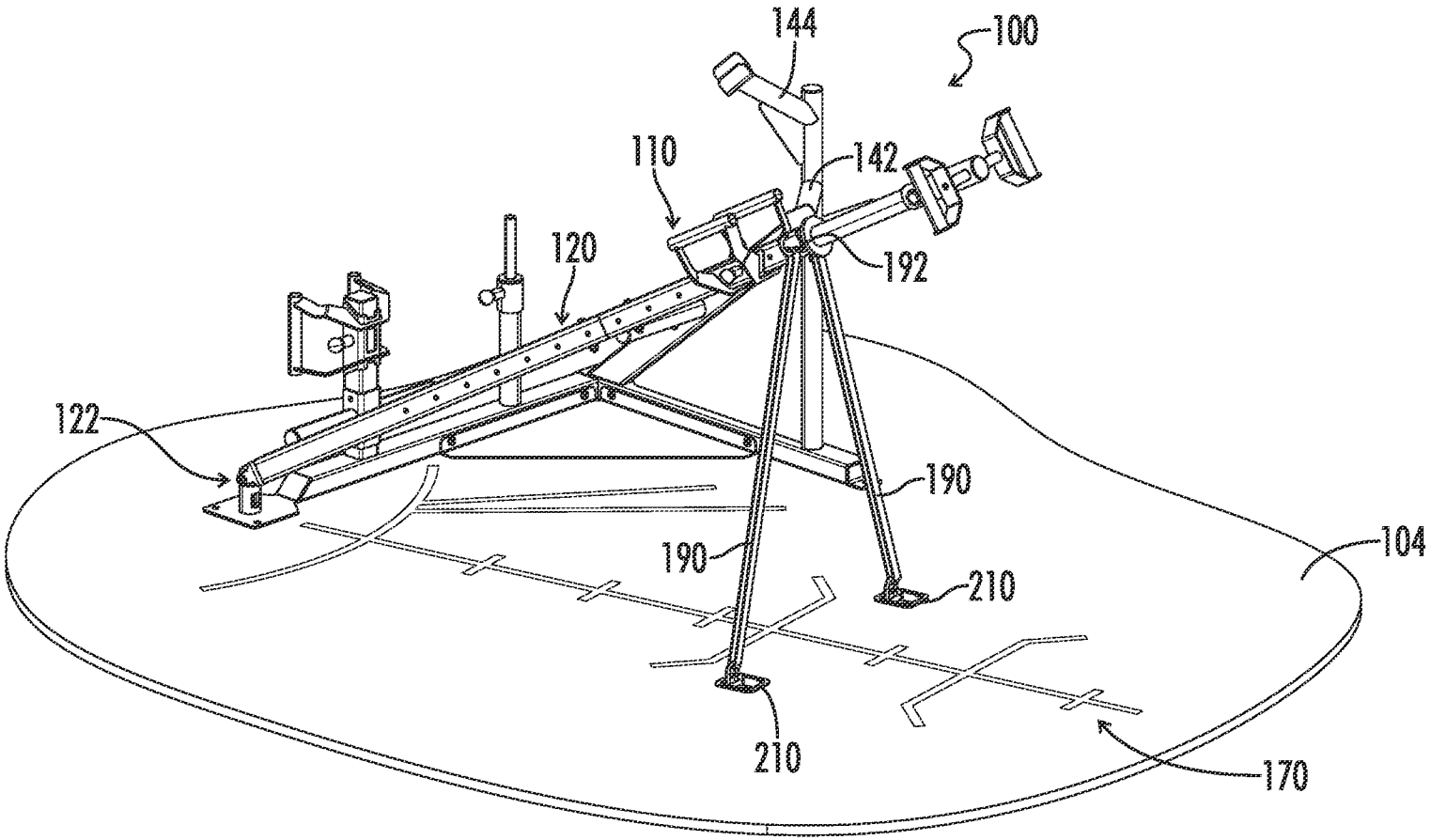
FIG. 41 is a front left top perspective view of the training system of FIG. 1 with the weight plates removed in accordance with the present disclosure.

In other embodiments, training system 100 may include a pair of floor anchors 220. When installed the pair of floor anchors 220 may be spaced apart similar to the pair of floor anchoes 210. As can best be seen in FIGS. 19-26G, the pair of floor anchors 220 may be similar to the pair of flush mounted floor anchors 210, in that each floor anchor of the pair of floor anchors 220 includes a housing 222 and a retractable hook 224 coupled to and positioned in the housing 222. As can best be seen in FIGS. 19-24, the retractable hook 224 may be configured in a retracted position when not in use so as to not trip or be a hazard to anyone walking around the space in which the training system 100 is installed. As can best be seen in FIGS. 25 and 26G, the retractable hook 214 may be configured in an extended position. The retractable hook 224 in this embodiment further includes a clasp 226. The clasp 226 is configured to ensure that each resistance band of the pair of resistance bands 190 does not accidently detach from the hook 224. Although not illustrated, the pair of floor anchors 210 may also include a clasp similar to that of the pair of floor anchors 220.

As can best be seen in FIG. 36-41, each floor anchor of the pair of floor anchors 220 may include transition surround 228 made from plastic, ABS, or some similar material. The transition surround 228 is useful when installing each floor anchor of the pair of floor anchors 220 on a ground surface 104 that is not conducive to flush mounting, such as concrete floors that do not include a rubber flooring installed thereon. The transition surround 228 may be configured to ease the transition between the floor surface 104 and an opening of the housing 222 wherein the retractable hook 224 is accessible. The transition surround 228 may be brightly colored so as to help persons walking near the training system 100 to avoid a potential tripping hazard presented by surface mounting the pair of floor anchors. The transition surround 228 may further be compatible with the pair of floor anchors 210, for instance when a user needs to surface mount the pair of floor anchors 210. The transition surround may include an inner lip for receiving the edges of the floor anchors 210, 220 flush with an upper surface of the transition surround.

In other embodiments, as can best be seen in FIGS. 27-35 the training system 100 may include a second embodiment of a simplified ground rotational trainer (GRT) apparatus 240 as opposed to the training apparatus 110. The simplified training apparatus 240 may include a square base plate 242 with a generally square support post 244 extending upwardly therefrom. The square base plate 242 may also be referred to herein as a base plate. The generally square support post 244 may also be referred to herein as a rectangular support post. The generally square support post 244 may include a front surface 250, a left surface 252, a right surface 254, and a rear surface 256, which may be collectively referred to as four side walls.

The simplified training apparatus 240 may include a landmine bracket 260 (substantially similar to the landmine bracket 122) coupled to the front surface 250 of the generally square support post 244 proximate to the square base plate 242. More generally, the support surface may be defined by one of the four side walls of the generally square support post 244. The landmine bracket 260 includes a cylindrical receptacle 262 configured to receive an end of a workout bar 264. The cylindrical receptacle 262 of the landmine bracket 260 is pivotally attached to the generally square support post 244 and is configured to pivot both vertically and horizontally relative to the generally square support post 244. In other embodiments (not shown), the simplified training apparatus 240 may include the workout bar 120 of the training apparatus 110. In accordance with said embodiment, the workout bar 120 and the cylindrical receptable 262 could be easily switched out so as to allow greater functionality of both the training apparatus 110 and the simplified training apparatus 240.

The left surface 252 of the generally square support post 244 may include a dock bracket 270 extending therefrom. The dock bracket 270 may extend from the left surface 252 such that it also extends beyond the front surface 250. As can best be seen in FIG. 33, the dock bracket 270 may be angled relative to the left surface 252 at a dock bracket angle 272. The dock bracket angle 272 may be an acute angle such that at least a portion of the dock bracket 270 is positioned forward of the front surface 250 of the generally square support post 244. The dock bracket 270 may include a dock bracket receptacle 274 coupled to a distal end thereof. The dock bracket receptacle 274 may be configured to receive the workout bar 264 such that the barbell is cradled within the dock bracket receptacle 274 and a distal end of the workout bar 264 is positioned off of the ground surface 104. The dock bracket receptacle 274 may be useful when performing overhead or similar movements which begin at a high position and which it may be difficult or impractical to lift off of the ground surface 104 to the high position for beginning to perform a given movement.

The right surface 254 of the generally square support post 244 may include a barbell storage bracket 280 and a handle 282 coupled thereto. The barbell storage bracket 280 may be coupled to the right surface 254 proximate to the square base plate 242. The handle 282 maybe coupled to the right surface 254 distally from the square base plate 242. The barbell storage bracket 280 may be coupled to the right surface 254 of the generally square support post such that a battle rope or the like (not shown) may be attached thereto. The barbell storage bracket 280 may be oriented vertically and parallel to a height of the generally square support post and include an open cylindrical receiver configured to receive and end of the workout bar 264.

The rear surface 256 of the generally square support post 244 may include a plurality of cylindrical pipes 290 extending therefrom. Each pipe of the plurality of cylindrical pipes 290 is configured to receive and store the weight plates 102.

The generally square support post 244 may include an upper surface 310 with a cylindrical pipe 312 extending vertically therefrom. The cylindrical pipe 312 and the plurality of a cylindrical pipes 290 include a profile and size similar to that, if not smaller, than that of an end of the workout bar 264 which is configured to receive the weight plates 102. The cylindrical pipe 312 is configured to receive a handle attachment 314 for storing the handle attachment when it is not in use. The handle attachment 314 may be similar to or identical to one of the plurality of workout attachment members 160.

Both the training apparatus 110 and the simplified training apparatus 240 are configured as stand-alone landmine workout apparatuses which include weight plate storage features and docking bracket features. Although not shown, the simplified training apparatus 240 may be compatible with many of the elements of the training system 100 such as the floor markings 170, the pairs of floor anchors 210, 240, and the pair of resistance bands 190.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful TRAINING SYSTEM, it is not intended that such references be construed as limitations upon the scope of this disclosure except as set forth in the following claims.

What is claimed is:

1. A training system comprising:

a pivotal bracket including a first portion and a second portion, the first portion being pivotally coupled to the second portion, the first portion couplable to a support surface;

a workout bar coupled to the second portion of the pivotal bracket, the workout bar including a cylindrical weight receiving portion positioned distal relative to the second portion of the pivotal bracket and a rectangular intermediate portion positioned between the second portion of the pivotal bracket and the cylindrical weight receiving portion; and a base station supported by a ground surface, the base station including:

first and second base supports, the first base support oriented perpendicular to the second base support;

a support plate extending from a free end of the first base support, a vertical bracket post extending from the support plate, the vertical bracket post including a plurality of points spaced along the vertical bracket post, the vertical bracket post defining the support surface;

a vertical support post extending from the second base support; and at least one dock bracket coupled to the vertical support post, the at least one dock bracket configured to receive the rectangular intermediate portion of the workout bar and position the cylindrical weight receiving portion of the workout bar offset from the ground surface;

wherein the first portion of the pivotal bracket is configured to be releasably coupled to one of the plurality of attachment points in the vertical bracket post.

2. The training system of claim 1, wherein:

the second portion of the pivotal bracket pivots omnidirectionally relative to the first portion of the pivotal bracket.

3. The training system of claim 1, wherein:

the pivotal bracket further includes a first pivot axis and a second pivot axis oriented perpendicular to the first pivot axis, the first pivot axis and the second pivot axis positioned between the first and second portions of the pivotal bracket; and the first pivot axis and the second pivot axis enable omnidirectional pivotal movement between the first and second portions of the pivotal bracket.

4. The training system of claim 1, wherein:

the workout bar includes a bar length and a square cross-sectional profile defined perpendicular to the bar length.

5. The training system of claim 1, wherein:

the workout bar includes a bar length; and the workout bar includes a plurality of pairs of holes defined through opposite sides of the workout bar, the plurality of pairs of holes spaced apart along the bar length.

6. The training system of claim 5, wherein:

each pair of the plurality of pairs of holes are aligned in a direction parallel to a horizontal axis of the pivotal bracket.

7. The training system of claim 6, further comprising:

an attachment member selectively couplable to at least one hole of the plurality of pairs of holes along the bar length.

8. The training system of claim 7, wherein:

the attachment member is a user engagement attachment; and the user engagement attachment includes a rectangular channel, first and second handles spaced apart from opposite side walls of the rectangular channel, and an engagement pin extending through one of the opposite side walls of the rectangular channel, the engagement pin configured to releasably engage one hole of the plurality of pairs of holes.

9. The training system of claim 7, wherein:

the attachment member is a band engagement attachment; and the band engagement attachment includes a rectangular channel and a pair of hooks extending from opposite side walls of the rectangular channel.

10. The training system of claim 1, further comprising:

a weight horn attachment selectively couplable to the rectangular intermediate portion of the workout bar, the weight horn attachment including a rectangular channel and a pair of weight receivers extending from opposite side walls of the rectangular channel.

11. The training system of claim 1, further comprising:

a user engagement attachment couplable to the cylindrical weight receiving portion of the workout bar, the user engagement attachment including at least one handle; and wherein the cylindrical weight receiving portion includes a hole defined closer to a free end of the cylindrical weight receiving portion than to the rectangular intermediate portion, further wherein the user engagement attachment includes an engagement pin configured to releasably engage the hole.

12. The training system of claim 1, wherein:

the workout bar is angled relative to the ground surface at an angle of at least 25 degrees when received by the at least one dock bracket.

13. A training system comprising:

a pivotal bracket including a first portion and a second portion, the first portion being pivotally coupled to the second portion, the first portion couplable to a support surface;

a workout bar coupled to the second portion of the pivotal bracket, the workout bar including a cylindrical weight receiving portion positioned distal relative to the second portion of the pivotal bracket and a rectangular intermediate portion positioned between the second portion of the pivotal bracket and the cylindrical weight receiving portion;

a pair of band anchors, each of the pair of band anchors including a housing couplable to one of the support surface or a ground surface and a retractable hook pivotally coupled within the housing, the pair of band anchors spaced apart from each other in a first direction and spaced apart from the pivotal bracket in a second direction perpendicular to the first direction; and at least one resistance band couplable between at least one of the pair of band anchors and at least one hook of a pair of hooks of a band engagement attachment coupled along the rectangular intermediate portion of the workout bar.

14. The training system of claim 13, wherein:

the second portion of the pivotal bracket pivots omnidirectionally relative to the first portion of the pivotal bracket.

15. The training system of claim 13, wherein:

the pivotal bracket further includes a first pivot axis and a second pivot axis oriented perpendicular to the first pivot axis, the first pivot axis and the second pivot axis positioned between the first and second portions of the pivotal bracket; and the first pivot axis and the second pivot axis enable omnidirectional pivotal movement between the first and second portions of the pivotal bracket.

16. A training system comprising:

a pivotal bracket including a first portion and a second portion, the first portion being pivotally coupled to the second portion, the first portion couplable to a support surface;

a workout bar coupled to the second portion of the pivotal bracket, the workout bar including a cylindrical weight receiving portion positioned distal relative to the second portion of the pivotal bracket and a rectangular intermediate portion positioned between the second portion of the pivotal bracket and the cylindrical weight receiving portion; and a base station supported by a ground surface, the base station including:

a base plate couplable to the ground surface;

a rectangular vertical support post extending from the base plate, the rectangular vertical support post including four side walls, one side wall of the four side walls defining the support surface; and a storage bracket coupled to the rectangular vertical support post above the pivotal bracket, the storage bracket including a rectangular channel and an engagement pin extending through one side wall of a pair of opposite side walls of the rectangular channel;

wherein the engagement pin is configured to releasably engage at least one hole of a plurality of pairs of holes defined along the rectangular intermediate portion of the weight bar.

17. The training system of claim 16, wherein:

the second portion of the pivotal bracket pivots omnidirectionally relative to the first portion of the pivotal bracket.

18. The training system of claim 16, wherein:

the pivotal bracket further includes a first pivot axis and a second pivot axis oriented perpendicular to the first pivot axis, the first pivot axis and the second pivot axis positioned between the first and second portions of the pivotal bracket; and the first pivot axis and the second pivot axis enable omnidirectional pivotal movement between the first and second portions of the pivotal bracket.

19. A training system comprising:

a pivotal bracket including a first portion and a second portion, the first portion being pivotally coupled to the second portion, the first portion couplable to a wall surface;

a workout bar coupled to the second portion of the pivotal bracket, the workout bar including a cylindrical weight receiving portion positioned distal relative to the second portion of the pivotal bracket and a rectangular intermediate portion positioned between the second portion of the pivotal bracket and the cylindrical weight receiving portion; and a storage bracket coupled to the wall surface above the pivotal bracket, the storage bracket including a rectangular channel and an engagement pin extending through one side wall of a pair of opposite side walls of the rectangular channel;

wherein the engagement pin is configured to releasably engage at least one hole of a plurality of pairs of holes defined along the rectangular intermediate portion of the weight bar.

20. The training system of claim 19, wherein:

the second portion of the pivotal bracket pivots omnidirectionally relative to the first portion of the pivotal bracket.

21. The training system of claim 19, wherein:

the pivotal bracket further includes a first pivot axis and a second pivot axis oriented perpendicular to the first pivot axis, the first pivot axis and the second pivot axis positioned between the first and second portions of the pivotal bracket; and the first pivot axis and the second pivot axis enable omnidirectional pivotal movement between the first and second portions of the pivotal bracket.

* * * * *